United States Patent [19]

Solberg et al.

[11] 4,433,048

[45] Feb. 21, 1984

[54] RADIATION-SENSITIVE SILVER BROMOIODIDE EMULSIONS, PHOTOGRAPHIC ELEMENTS, AND PROCESSES FOR THEIR USE

[75] Inventors: John C. Solberg, Rochester, N.Y.; Roger H. Piggin, Abbots Langley, United Kingdom; Herbert S. Wilgus, Conesus, N.Y.

[73] Assignee: Eastman Kodak Company, Rochester, N.Y.

[21] Appl. No.: 431,913

[22] Filed: Sep. 30, 1982

Related U.S. Application Data

[63] Continuation-in-part of Ser. No. 320,909, Nov. 12, 1981, abandoned.

[51] Int. Cl.[3] ..... G03C 1/02

[52] U.S. Cl. ..... 430/434; 430/495; 430/496; 430/503; 430/567; 430/569; 430/570; 430/599

[58] Field of Search ..... 430/567, 569, 570, 599, 430/495, 496, 503, 434

[56] References Cited

U.S. PATENT DOCUMENTS

| | | |
|---|---|---|
| 2,221,805 | 11/1940 | Leermakers . |
| 2,222,264 | 11/1940 | Nietz . |
| 2,388,859 | 11/1945 | Mannes . |
| 2,456,954 | 12/1948 | Knott . |
| 2,641,361 | 6/1953 | Damschroder . |
| 3,206,313 | 9/1965 | Porter . |
| 3,317,322 | 5/1967 | Porter . |
| 3,320,069 | 5/1967 | Illingsworth . |
| 3,402,046 | 9/1968 | Zwick . |
| 3,505,068 | 4/1970 | Beckett . |
| 3,894,871 | 7/1975 | Land . |
| 4,063,951 | 12/1977 | Bogg . |
| 4,067,739 | 1/1978 | Lewis . |
| 4,150,994 | 4/1979 | Maternaghan . |
| 4,184,877 | 1/1980 | Maternaghan . |
| 4,184,878 | 1/1980 | Maternaghan . |
| 4,210,450 | 7/1980 | Corben ..... 430/569 |

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 142329 | 11/1980 | Japan . |
| 1027146 | 4/1966 | United Kingdom . |
| 1477901 | 6/1977 | United Kingdom . |
| 1560963 | 2/1980 | United Kingdom . |
| 1570581 | 7/1980 | United Kingdom . |

OTHER PUBLICATIONS

Farnell, "The Relationship Between Speed and Grain Size", *The Journal of Photographic Science,* vol. 17, No. 6, 1969, pp. 116–125.

Tani, "Factors Influencing Photographic Sensitivity", J. Soc. *Photogr. Sci. Technol. Japan,* vol. 43, No. 6, 1980, pp. 335–346.

Duffin, *Photographic Emulsion Chemistry,* Focal Press, 1966, pp. 18, 66–72.

Zelikman and Levi *Making and Coating Photographic Emulsions,* Focal Press, 1964, p. 223.

deCugnac and Chateau, "Evolution of the Morphology of Silver Bromide Crystals During Physical Ripening", *Science et Industries Photographiques,* vol. 33, No. 2 (1962), pp. 121–125.

Trivelli and Smith, "The Effect of Silver Iodide Upon the Structure of Bromo-Iodide Precipitation Series", *The Photographic Journal,* vol. LXXX, Jul. 1940, pp. 285–288.

Dickinson, "Some Aspects of the Dye Sensitization of Photographic Emulsions", *The Photographic Journal,* vol. 90B, 1950, pp. 142–147.

Tani, "Photographic Effects of Electron and Positive Hole Traps in Silver Halides IX, Factors Influencing Desensitization Caused by Sensitizing and Desensitizing Dyes", *Photographic Science and Engineering,* vol. 18, Nos. 1–6, pp. 576–581.

*Primary Examiner*—Mary F. Downey

*Attorney, Agent, or Firm*—Carl O. Thomas

[57] ABSTRACT

Radiation-sensitive emulsions are disclosed comprised of a dispersing medium and silver bromoiodide grains. These emulsions contains tabular silver bromoiodide grains having a lower proportion of iodide in a central region than in a laterally displaced region, a thickness of less than 0.3 micron, and a diameter of at least 0.6 micron. These tubular grains exhibit an average aspect ratio of greater than 8:1 and account for at least 50 percent of the total projected area of the silver bromoiodide grains.

58 Claims, 13 Drawing Figures

RADIATION-SENSITIVE SILVER BROMOIODIDE EMULSIONS, PHOTOGRAPHIC ELEMENTS, AND PROCESSES FOR THEIR USE

This is a continuation-in-part of copending, commonly assigned U.S. Ser. No. 320,909, filed Nov. 12, 1981, now abandoned.

FIELD OF THE INVENTION

This invention relates to radiation-sensitive silver bromoiodide emulsions, photographic elements incorporating these emulsions, and processes for the use of the photographic elements.

BACKGROUND OF THE INVENTION a. Silver bromoiodide grains

Radiation-sensitive emulsions employed in photography are comprised of a dispersing medium, typically gelatin, containing embedded microcrystals—known as grains—of radiation-sensitive silver halide. Emulsions other than silver bromoiodide emulsions find only limited use in camera speed photographic elements. Silver bromoiodide grains do not consist of some crystals of silver bromide and others of silver iodide. Rather, all of the crystals contain both bromide and iodide. As ordinarily employed in photography silver bromoiodide grains contain a silver bromide crystal lattice into which silver iodide can be incorporated up to its solubility limit in silver bromide—that is, up to about 40 mole percent iodide, depending upon the temperature of grain formation. (Except as otherwise indicated, all references to halide percentages are based on silver present in the corresponding emulsion, grain, or grain region being discussed; e.g., a grain consisting of silver bromoiodide containing 40 mole percent iodide and also contains 60 mole percent bromide.) Iodide concentrations in silver bromoiodide emulsions reflect a practical balance between advantages produced by iodide, such as increased efficiency of latent image formation, increased native sensitivity, and better adsorption of addenda, and disadvantages which arise at higher concentrations, such as development inhibition and resistance to chemical sensitization.

Duffin, *Photographic Emulsion Chemistry,* Focal Press, 1966, p. 18, states:

An important factor to be considered in the case of iodobromide emulsions is the location of the iodide, which may be present mainly at the centre of the crystal, distributed throughout the grain or mainly on the outside. The actual location of the iodide is determined by the preparation conditions and will clearly have an influence on the physical and chemical properties of the crystal.

Since silver iodide is much less soluble than silver bromide, in a single run precipitation in which both iodide and bromide salts are initially entirely present in the reaction vessel and silver salt is run into the reaction vessel to form silver bromoiodide grains, silver iodide tends to be precipitated first and concentrated in the center of the grains. By performing a double-jet precipitation in which both iodide and bromide salts are concurrently run into the reaction vessel along with the silver salt, it is possible to distribute the silver iodide throughout the grain. By continuing iodide salt addition while stopping or diminishing bromide salt addition, it is possible to form a silver iodide or silver bromoiodide shell of higher iodide content on the grains. Illustrative of patents which selectively position silver iodide in the grains are Porter et al. U.S. Pat. Nos. 3,206,313 and 3,317,322, Beckett et al. U.S. Pat. No. 3,505,068, Corben U.S. Pat. No. 4,210,450, Klein et al. U.K. Pat. No. 1,027,146, and Walworth U.K. Pat. No. 1,477,901.

A great variety of regular and irregular grain shapes have been observed in silver halide photographic emulsions. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, page 223. Rods and tabular grains in varied portions have been frequently observed mixed in among other grain shapes, particularly where the pAg (the negative logarithm of silver ion concentration) of the emulsions have been varied during precipitation, as occurs, for example in single-jet precipitations.

Tabular silver bromide grains have been extensively studied, often in macro-sizes having no photographic utility. Tabular grains are herein defined as those having two substantially parallel crystal faces, each of which is substantially larger than any other single crystal face of the grain. The term "substantially parallel" as used herein is intended to include surfaces that appear parallel on direct or indirect visual inspection at 10,000 times magnification. The aspect ratio—that is, the ratio of diameter to thickness—of tabular grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques,* Vol. 33, No. 2 (1962), pp. 121–125.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli *and Smith observed a pronounced reduction in both grain size and aspect ratio with the introduction of iodide. Gutoff, "Nucleation and Growth Rates During the Precipitation of Silver Halide Photographic Emulsions", Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the highest average aspect ratio, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 teaches the preparation of silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwald ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publication Nos. 2,905,655 and 2,921,077 teach the formation of silver halide grains of flat twinned octahedral configuration by employing seed crystals which are at least 90 mole percent iodide. Lewis and Maternaghan report increased covering power. Maternaghan states that the emulsions are useful in camera films, both black-and-white and color. Bogg specifically reports an upper limit on aspect ratios to 7:1, and, from the very low aspect ratios obtained by the examples, the 7:1 aspect ratio appears unrealistically high. It appears from repeating examples and viewing the photomicrographs published that the aspect ratios realized by Lewis and Maternaghan were also less than 7:1. Japanese patent Kokai No. 142,329, published Nov. 6, 1980, appears to be essentially cumulative with Maternaghan, but is not restricted to the use of silver iodide seed grains.

Wilgus and Haefner U.S. Ser. No. 429,420, filed concurrently herewith and commonly assigned, titled High Aspect Ratio Silver Bromoiodide Emulsions And Processes For Their Preparation, which is a continuation-in-part of U.S. Ser. No. 320,905, filed Nov. 12, 1981, now abandoned, were the first to prepare high aspect ratio tabular grain silver bromoiodide emulsions. Wilgus and Haefner prepared tabular grain silver bromoiodide emulsions, wherein the tabular silver bromoiodide grains having a thickness of less than 0.3 micron and a diameter of at least 0.6 micron have an average aspect ratio of greater than 8:1 and account for at least 50 percent of the total projected surface area of the silver bromoiodide grain population. According to the process of Wilgus and Haefner the pBr (the negative logarithm of bromide ion concentration) of the dispersing medium within the reaction vessel is adjusted to a level of from 1.6 to 0.6 with the reaction vessel being initially substantially free of silver and iodide salts. To form high aspect ratio tabular silver bromoiodide grains silver, bromide, and iodide salts are concurrently added to the reaction vessel while maintaining the pBr of the reaction vessel above 0.6, preferably in the range of from 0.6 to 2.2.

High aspect ratio tabular grain silver bromoiodide emulsions have also been prepared by Daubendiek and Strong U.S. Ser. No. 429,587, filed concurrently herewith and commonly assigned, titled Preparing High Aspect Ratio Grains, which is a continuation-in-part of U.S. Ser. No. 320,906, filed Nov. 12, 1981, now abandoned. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron. The silver bromoiodide emulsions produced fall within the definition of Wilgus and Haefner, cited above.

b. Speed, granularity, and sensitization

Silver halide photography employs radiation-sensitive emulsions comprised of a dispersing medium, typically gelatin, containing embedded microcrystals—known as grains—of radiation-sensitive silver halide. During imagewise exposure a latent image center, rendering an entire grain selectively developable, can be produced by absorption of only a few quanta of radiation, and it is this capability that imparts to silver halide photography exceptional speed capabilities as compared to many alternative imaging approaches.

The sensitivity of silver halide emulsions has been improved by sustained investigation for more than a century. A variety of chemical sensitizations, such as noble metal (e.g., gold), middle chalcogen (e.g., sulfur and/or selenium), and reduction sensitizations, have been developed which, singly and in combination, are capable of improving the sensitivity of silver halide emulsions. When chemical sensitization is extended beyond optimum levels, relatively small increases in speed are accompanied by sharp losses in image discrimination (maximum density minus minimum density) resulting from sharp increases in fog (minimum density). Optimum chemical sensitization is the best balance among speed, image discrimination, and minimum density for a specific photographic application.

Usually the sensitivity of the silver halide emulsions is only negligibly extended beyond their spectral region of intrinsic sensitivity by chemical sensitization. The sensitivity of silver halide emulsions can be extended over the entire visible spectrum and beyond by employing spectral sensitizers, typically methine dyes. Emulsion sensitivity beyond the region of intrinsic sensitivity increases as the concentration of spectral sensitizer increases up to an optimum and generally declines rapidly thereafter. (See Mees, *Theory of the Photographic Process,* Macmillan, 1942, pp. 1067–1069, for background.)

Within the range of silver halide grain sizes normally encountered in photographic elements the maximum speed obtained at optimum sensitization increases linearly with increasing grain size. The number of absorbed quanta necessary to render a grain developable is substantially independent of grain size, but the density that a given number of grains will produce upon development is directly related to their size. If the aim is to produce a maximum density of 2, for example, fewer grains of 0.4 micron as compared to 0.2 micron in average diameter are required to produce that density. Less radiation is required to render fewer grains developable.

Unfortunately, because the density produced with the larger grains is concentrated at fewer grain sites, there are greater point-to-point fluctuations in density. The viewer's perception of point-to-point fluctuations in density is termed "graininess". The objective measurement of point-to-point fluctuations in density is termed "granularity". While quantitative measurements of granularity have taken different forms, granularity is most commonly measured as rms (root mean square) granularity, which is defined as the standard deviation of density within a viewing microaperture (e.g., 24 to 48 microns). Once the maximum permissible granularity (also commonly referred to as grain, but not to be confused with silver halide grains) for a specific emulsion layer is identified, the maximum speed which can be realized for that emulsion layer is also effectively limited.

From the foregoing it can be appreciated that over the years intensive investigation in the photographic art has rarely been directed toward obtaining maximum photographic speed in an absolute sense, but, rather, has been directed toward obtaining maximum speed at optimum sensitization while satisfying practical granularity or grain criteria. True improvements in silver halide emulsion sensitivity allow speed to be increased without increasing granularity, granularity to be reduced without decreasing speed, or both speed and granularity to be simultaneously improved. Such sensitivity improvement is commonly and succinctly referred to in the art as improvement in the speed-granularity relationship of an emulsion.

In FIG. 1 a schematic plot of speed versus granularity is shown for five silver halide emulsions 1, 2, 3, 4, and 5 of the same composition, but differing in grain size, each similarly sensitized, identically coated, and identically processed. While the individual emulsions differ in maximum speed and granularity, there is a predictable linear relationship between the emulsions, as indicated by the speed-granularity line A. All emulsions which can be joined along the line A exhibit the same speed-granularity relationship. Emulsions which exhibit true improvements in sensitivity lie above the speed-granularity line A. For example, emulsions 6 and 7, which lie on the common speed-granularity line B, are superior in their speed-granularity relationships to any one of the emulsions 1 through 5. Emulsion 6 exhibits a higher speed than emulsion 1, but no higher granularity. Emulsion 6 exhibits the same speed as emulsion 2, but at a much lower granularity. Emulsion 7 is of higher speed than emulsion 2, but is of a lower granularity than emulsion 3, which is of lower speed than emulsion 7. Emulsion 8, which falls below the speed-granularity line A, exhibits the poorest speed-granularity position shown in FIG. 1. Although emulsion 8 exhibits the highes photographic speed of any of the emulsions, its speed is realized only at a disproportionate increase in granularity.

The importance of speed-granularity relationship in photography has led to extensive efforts to quantify and generalize speed-granularity determinations. It is normally a simple matter to compare precisely the speed-granularity relationships of an emulsion series differing by a single characteristic, such as silver halide grain size. The speed-granularity relationships of photographic products which produce similar characteristic curves are often compared. However, universal quantitative speed-granularity comparisons of photographic elements have not been achieved, since speed-granularity comparisons become increasingly judgmental as other photographic characteristics differ. Further, comparisons of speed-granularity relationships of photographic elements which produce silver images (e.g., black-and-white photographic elements) with those which produce dye images (e.g., color and chromogenic photographic elements) involve numerous considerations other than the silver halide grain sensitivity, since the nature and origin of the materials producing density and hence accounting for granularity are much different. For elaboration of granularity measurements in silver and dye imaging attention is directed to "Understanding Graininess and Granularity", Kodak Publication No. F-20, Revised 11-79 (available from Eastman Kodak Company, Rochester, N.Y. 14650); Zwick, "Quantitative Studies of Factors Affecting Granularity", *Photographic Science and Engineering,* Vol. 9, No. 3, May-June, 1965; Ericson and Marchant, "RMS Granularity of Monodisperse Photographic Emulsions", *Photographic Science and Engineering,* Vol. 16, No. 4, July-August 1972, pp. 253-257; and Trabka, "A Random-Sphere Model for Dye Clouds", *Photographic Science and Engineering,* Vol. 21, No. 4, July-August 1977, pp. 183-192.

A silver bromoiodide emulsion having outstanding silver imaging (black-and-white) speed-granularity properties is illustrated by Illingsworth U.S. Pat. No. 3,320,069, which discloses a gelatino-silver bromoiodide emulsion in which the iodide preferably comprises from 1 to 10 mole percent of the halide. The emulsion is sensitized with a sulfur, selenium, or tellurium sensitizer. The emulsion, when coated on a support at a silver coverage of between 300 and 1000 mg per square foot (0.0929 $m^2$) and exposed on an intensity scale sensitometer, and processed for 5 minutes in Kodak Developer DK-50® (an N-methyl-p-aminophenol sulfate-hydroquinone developer) at 20° C. (68° F.), has a log speed of 280-400 and a remainder resulting from subtracting its granularity value from its log speed of between 180 and 220. Gold is preferably employed in combination with the sulfur group sensitizer, and thiocyanate may be present during silver halide precipitation or, if desired, may be added to the silver halide at any time prior to washing. (Uses of thiocyanate during silver halide precipitation and sensitization are illustrated by Leermakers U.S. Pat. No. 2,221,805, Nietz et al. U.S. Pat. No. 2,222,264, and Damschroder U.S. Pat. No. 2,642,361.) The Illingsworth emulsions also provide outstanding speed-granularity properties in color photography, although quantitative values for dye image granularity are not provided.

In a few instances the highest attainable photographic speeds have been investigated at higher than the normally useful levels of granularity. Farnell, "The Relationship Between Speed and Grain Size", *The Journal of Photographic Science,* Vol. 17, 1969, pp. 116-125, reports blue-speed investigations of silver bromide and bromoiodide emulsions in the absence of spectral sensitization. The author observed that with grain sizes greater than about 0.5 $micron^2$ in projected area (0.8 micron in diameter) no further increase in speed with increasing grain size, as expected based on the assumption that the number of absorbed quanta required for developability in independent of grain size, was observed. Actual declines in speed as a function of increasing grain size are reported. Farnell attributes the decline in sensitivity of large grains to their large size in relation to the limited average diffusion distance of photo-generated electrons which are required to produce latent image sites, since it is the proximity of a few atoms of $Ag^o$ produced by capture of photogenerated electrons that produces a latent image site.

Tani, "Factors Influencing Photographic Sensitivity", *J. Soc. Photogr. Sci. Technol. Japan,* Vol. 43, No. 6, 1980, pp. 335-346, is in agreement with Farnell and extends the discussion of reduced sensitivity of larger silver halide grains to additional causes attributable to the presence of spectral sensitizing dye. Tani reports that the sensitivity of spectrally sensitized emulsion is additionally influenced by (1) the relative quantum yield of spectral sensitization, (2) dye desensitization, and (3) light absorption by dyes. Tani notes that the relative quantum yield of spectral sensitization has been observed to be near unity and therefore not likely to be practically improved. Tani notes that light absorption by grains covered by dye molecules is proportional to grain volume when exposed to blue light and to grain surface area when the grain is exposed to minus-blue light. Thus, the magnitude of the increase in minus-blue sensitivity is, in general, smaller than the increase in blue sensitivity when the size of emulsion grains is increased. Attempts to increase light absorption by merely increasing dye coverage does not necessarily result in increased sensitivity, because dye desensitization increases as the amount of dye is increased. Desensitization is attributed to reduced latent image formation rather than reduced photogeneration of electrons. Tani suggests possible improvements in speed-granularity of larger silver halide grains by preparing core-shell emulsions to avoid desensitization. Internal doping of silver halide grains to allow the use of otherwise desensitizing dye levels is taught by Gilman et al. U.S. Pat. No. 3,979,213.

Kofron et al U.S. Ser. No. 429,407, filed concurrently herewith and commonly assigned, titled Sensitized High Aspect Ratio Silver Halide Emulsions And Photograhic Elements, which is a continuation-in-part of U.S. Ser. No. 320,904, filed Nov. 12, 1981, now abandoned, discloses significant advantages in speed-granularity relationship, sharpness, blue sensitivity, and blue and minus blue sensitivity differences for chemically and spectrally sensitized high aspect ratio tabular grain silver bromoiodide emulsions.

c. Sharpness

While granularity, because of its relationship to speed, is often a focal point of discussion relating to image quality, image sharpness can be addressed independently. Some factors which influence image sharpness, such as lateral diffusion of imaging materials during processing (sometimes termed "image smearing"), are more closely related to imaging and processing materials than the silver halide grains. On the other hand, because of their light scattering properties, silver halide grains themselves primarily affect sharpness during imagewise exposure. It is known in the art that silver halide grains having diameters in the range of from 0.2 to 0.6 micron exhibit maximum scattering of visible light.

Loss of image sharpness resulting from light scattering generally increases with increasing thickness of a silver halide emulsion layer. The reason for this can be appreciated by reference to FIG. 2. If a photon of light 1 is deflected by a silver halide grain at a point 2 by an angle $\theta$ measured as a declination from its original path and is thereafter absorbed by a second silver halide grain at a point 3 after traversing a thickness $t^1$ of the emulsion layer, the photographic record of the photon is displaced laterally by a distance x. If, instead of being absorbed within a thickness $t^1$, the photon traverses a second equal thickness $t^2$ and is absorbed at a point 4, the photographic record of the photon is displaced laterally by twice the distance x. It is therefore apparent that the greater the thickness displacement of the silver halide grains in a photographic element, the greater the risk of reduction in image sharpness attributable to light scattering. (Although FIG. 2 illustrates the principle in a very simple situation, it is appreciated that in actual practice a photon is typically reflected from several grains before actually being absorbed and statistical methods are required to predict its probable ultimate destination).

In multicolor photographic elements containing three or more superimposed silver halide emulsion layers an increased risk of reduction in image sharpness can be presented, since the silver halide grains are distributed over at least three layer thicknesses. In some applications thickness displacement of the silver halide grains is further increased by the presence of additional materials that either (1) increase the thicknesses of the emulsion layers themselves—as where dye-image-providing materials, for example, are incorporated in the emulsion layers or (2) form additional layers separating the silver halide emulsion layers, thereby increasing their thickness displacement—as where separate scavenger and dye-image-providing material layers separate adjacent emulsion layers. Further, in multicolor photographic elements there are at least three superimposed layer units, each containing at least one silver halide emulsion layer. Thus, there is a substantial opportunity for loss of image sharpness attributable to scattering. Because of the cumulative scattering of overlying silver halide emulsion layers, the emulsion layers further removed from the exposing radiation source can exhibit very significant reductions in sharpness.

Zwick U.S. Pat. No. 3,402,046 discusses obtaining crisp, sharp images in a green-sensitive emulsion layer of a multicolor photographic element. The green-sensitive emulsion layer lies beneath a blue-sensitive emulsion layer, and this relationship accounts for a loss in sharpness by the green-sensitive emulsion layer. Zwick reduces light scattering by employing in the overlying blue-sensitive emulsion layer silver halide grains which are at least 0.7 micron, preferably 0.7 to 1.5 microns, in average diameter, which is in agreement with the 0.6 micron diameter referred to above.

d. Blue and minus-blue speed separation

Silver bromoiodide emulsions possess sufficient native sensitivity to the blue portion of the spectrum to record blue radiation without blue spectral sensitization. When these emulsions are employed to record green and/or red (minus blue) light exposures, they are correspondingly spectrally sensitized. In black-and-white and monochromatic (e.g. chromogenic) photography the resulting orthochromatic or panchromatic sensitivity is advantageous.

In multicolor photography, the native sensitivity of silver bromoiodide in emulsions intended to record blue light is advantageous. However, when these silver halides are employed in emulsion layers intended to record exposures in the green or red portion of the spectrum, the native blue sensitivity is an inconvenience, since response to both blue and green light or both blue and red light in the emulsion layers will falsify the hue of the multicolor image sought to be reproduced.

In constructing multicolor photographic elements using silver bromoiodide emulsions the color falsification can be analyzed as two distinct concerns. The first concern is the difference between the blue speed of the green or red recording emulsion layer and its green or red speed. The second concern is the difference between the blue speed of each blue recording emulsion layer and the blue speed of the corresponding green or red recording emulsion layer. Generally in preparing a multicolor photographic element intended to record accurately image colors under daylight exposure conditions (e.g., 5500° K.) the aim is to achieve a difference of about an order of magnitude between the blue speed of each blue recording emulsion layer and the blue speed of the corresponding green or red recording emulsion layer. The art has recognized that such aim speed differences are not realized using silver bromoiodide emulsions unless employed in combination with one or more approaches known to ameliorate color falsification. Even then, full order of magnitude speed differences have not always been realized in product. However, even when such aim speed differences are realized, further increasing the separation between blue and minus blue speeds will further reduce the recording of blue exposures by layers intended to record minus blue exposures.

By far the most common approach to reducing exposure of red and green spectrally sensitized silver bromoiodide emulsion layers to blue light, thereby effectively reducing their blue speed, is to locate these emulsion layers behind a yellow (blue absorbing) filter layer. Both yellow filter dyes and yellow colloidal silver are commonly employed for this purpose. In a common multicolor layer format all of the emulsion layers are silver bromide or bromoiodide. The emulsion layers intended to record green and red exposures are located behind a yellow filter while the emulsion layer or layers intended to record blue light are located in front of the filter layer. (For specific examples refer to U.S. Patent and Trademark Office Class 430, PHOTOGRAPHIC CHEMISTRY, subclass 507).

This arrangement has a number of art-recognized disadvantages. While blue light exposure of green and red recording emulsion layers is reduced to tolerable levels, a less than ideal layer order arrangement is imposed by the use of a yellow filter. The green and red emulsion layers receive light that has already passed through both the blue emulsion layer or layers and the yellow filter. This light has been scattered to some extent, and image sharpness can therefore be degraded. Since the blue recording emulsion produces by far the least visually important record, its favored location nearest the source of exposing radiation does not contribute to image sharpness to the degree that would be realized by similar placement of the red or green emulsion layer. Further, the yellow filter is itself imperfect and actually absorbs to a slight extent in the green portion of the spectrum, which results in a loss of green speed. The yellow filter material, particularly where it is yellow colloidal silver, increases materials cost and accelerates required replacement of processing solutions, such as bleaching and bleach-fixing solutions.

Still another disadvantage associated with separating the blue emulsion layer or layers of a photographic element from the red and green emulsion layers by interposing a yellow filter is that the speed of the blue emulsion layer is decreased. This is because the yellow filter layer absorbs blue light passing through the blue emulsion layer or layers that might otherwise be reflected to enhance exposure. One approach for increasing speed is to move the yellow filter layer so that it does not lie immediately below the blue emulsion. This is taught by Lohmann et al. U.K. Pat. No. 1,560,963; however, the patent admits that blue speed enhancement is achieved only at the price of impaired color reproduction in the green and red sensitized emulsion layers lying above the yellow filter layer.

A number of approaches have been suggested for eliminating yellow filters, but each has produced its own disadvantages. Gaspar U.S. Pat. No. 2,344,084 teaches locating a green or red spectrally sensitized silver chloride or chlorobromide layer nearest the exposing radiation source, since these silver halides exhibit only negligible native blue sensitivity. Since silver bromide possesses high native blue sensitivity, it does not form the emulsion layer nearest the exposing radiation source, but forms an underlying emulsion layer intended to record blue light.

Mannes et al. U.S. Pat. No. 2,388,859 and Knott et al. U.S. Pat. No. 2,456,954 teach avoiding blue light contamination of the green and red recording emulsion layers by making these layers 50 or 10 times slower, respectively, than the blue recording emulsion layer. The emulsion layers are overcoated with a yellow filter to obtain a match in sensitivities of the blue, green and red recording emulsion layers to blue, green, and red light, respectively, and to increase the separation of the blue and minus blue speeds of the minus blue recording emulsion layers.

This approach allows the emulsion layers to be coated in any desired layer order arrangement, but retains the disadvantage of employing a yellow filter as well as additional disadvantages. In order to obtain the sensitivity differences in the blue and minus blue recording emulsion layers without the use of a yellow filter layer to implement the teachings of Mannes et al and Knott et al relatively much larger silver bromoiodide grains are employed in the blue recording emulsion layer. Attempts to obtain the desired sensitivity differences relying on differences in grain size alone cause the blue emulsion layers to be excessively grainy and/or the grain size of the minus blue recording emulsion layers to be excessively small and therefore of relatively slow speed. To ameliorate this difficulty it is known to increase the proportion of iodide in the grains of the blue recording emulsion layer, thereby disproportionately increasing its blue sensitivity without increasing its grain size. Still, if the minus blue recording emulsion layers are to exhibit more than very moderate photographic speeds, obtaining blue recording emulsion layers of at least 10 times greater speed is not possible within normally acceptable levels of grains, even with increased iodide in the blue recording emulsion layer.

While yellow filters are employed to reduce blue light striking underlying emulsion layers, they by no means eliminate the transmission of blue light. Thus, even when yellow filters are employed, additional benefits can be realized by the further separation of blue and minus blue sensitivities of silver bromoiodide emulsion layers intended to record in the minus blue portion of the spectrum.

e. Other prior art

Abbott and Jones U.S. Ser. No. 430,222, filed concurrently herewith and commonly assigned, titled Radiographic Elements Exhibiting Reduced Crossover, which is a continuation-in-part of U.S. Ser. No. 320,907, filed Nov. 12, 1981, now abandoned, discloses the use of high aspect ratio tabular grain silver halide emulsions in radiographic elements coated on both major surfaces of a radiation transmitting support to control crossover.

Wey U.S. Pat. No. 4,399,215, based on U.S. Ser. No. 429,403, filed concurrently herewith and commonly assigned, titled IMPROVED DOUBLE-JET PRECIPITATION PROCESSES AND PRODUCTS THEREOF, which is a continuation-in-part of U.S. Ser. No. 320,908, filed Nov. 12, 1981, now abandoned, discloses a process of preparing tabular silver chloride grains which are substantially internally free of both silver bromide and silver iodide. The emulsions have an average aspect ratio of greater than 8:1.

SUMMARY OF THE INVENTION

In one aspect this invention is directed to a radiation-sensitive emulsion comprised of a dispersing medium and silver bromoiodide grains, wherein at least 50 percent of the total projected area of said silver bromoiodide grains is provided by tabular silver bromoiodide grains having first and second opposed, substantially parallel major faces, a thickness of less than 0.3 micron, a diameter of at least 0.6 micron, and an average aspect ratio of greater than 18:1. The tabular silver bromoiodide grains are comprised of, in an amount sufficient to improve the photographic response of the emulsion, tabular silver bromoiodide grains having a central region extending between the major faces. The central region has a lower proportion of iodide than at least one laterally displaced region also extending between the major faces.

In another aspect, this invention is directed to a photographic element comprised of a support and one radiation-sensitive emulsion layer comprised of a radiation-sensitive emulsion as described above.

In still another aspect, this invention is directed to producing a visible photographic image by processing in an aqueous alkaline solution in the presence of a developing agent an imagewise exposed photographic element as described above.

The present invention offers unique and totally unexpected advantages. When emulsions according to the present invention are compared with high aspect ratio tabular grain bromoiodide emulsions differing significantly only in the iodide position within the tabular grains, improved speed-granularity relationships (e.g., higher photographic speeds at comparable granularity and reduced granularity at comparable photographic speeds) can be obtained. For example, the emulsions of the present invention are unexpectedly better in their photographic response than high aspect ratio tabular grain bromoiodide emulsions having the same iodide concentrations, but with the iodide substantially uniformly distributed within the tabular grains or concentrated toward the centers of the grains. Further, the high aspect ratio tabular grain bromoiodide emulsions of this invention are unexpectedly better in these same photographic properties than high aspect ratio tabular grain bromoiodide emulsions having iodide concentrations throughout at least equal to the surface iodide concentrations of the tabular grains of this invention. Still further, the high aspect ratio tabular grain bromoiodide emulsions of the present invention are superior in these same photographic properties to nontabular core-shell emulsions having comparable surface iodide concentrations. The emulsions of the present invention are particularly advantageous when spectrally sensitized and when employed to produce dye images. The emulsions of the present invention have been found to be unexpectedly advantageous in increasing dye yields when employing color developing agents and dye-forming couplers.

As taught by Kofron et al., cited above, the high aspect ratio tabular grain emulsions of this invention enhance sharpness of underlying emulsion layers when they are positioned to receive light that is free of significant scattering. The emulsions are particularly effective in this respect when they are located in the emulsion layers nearest the source of exposing radiation. When spectrally sensitized outside the blue portion of the spectrum, the emulsions exhibit a large separation in their sensitivity in the blue region of the spectrum as compared to the region of the spectrum to which they are spectrally sensitized. Minus blue sensitized tabular grain silver bromoiodide emulsions are much less sensitive to blue light than to minus blue light and do not require filter protection to provide acceptable minus blue exposure records when exposed to neutral light, such as daylight at 5500° K. The silver bromoiodide emulsions exhibit improved speed-granularity relationships as compared to previously known tabular grain emulsions and as compared to the best speed-granularity relationships heretofore achieved with silver bromoiodide emulsions generally. Very large increases in blue speed of the silver bromoiodide emulsions have been realized as compared to their native blue speed when blue spectral sensitizers are employed.

As taught by Abbott and Jones, cited above, comparisons of radiographic elements containing emulsions according to this invention with similar radiographic elements containing conventional emulsions show that reduced crossover can be attributed to the emulsions of the present invention. Alternatively, comparable crossover levels can be achieved with the emulsions of the present invention using reduced silver coverages.

Jones and Hill U.S. Ser. No. 430,092, filed concurrently herewith and commonly assigned, titled Photographic Image Transfer Film Unit, which is a continuation-in-part of U.S. Ser. No. 320,911, filed Nov. 12, 1981, now abandoned, discloses image transfer film units containing emulsions according to the present invention. The image transfer film units are capable of achieving a higher performance ratio of photographic speed to silver coverage (i.e., silver halide coated per unit area), faster access to a viewable transferred image, and higher contrast of transferred images with less time of development.

BRIEF DESCRIPTION OF THE DRAWINGS

This invention can be better appreciated by reference to the following detailed description considered in conjunction with the drawings, in which.

DESCRIPTION OF PREFERRED EMBODIMENTS

Figure 1:
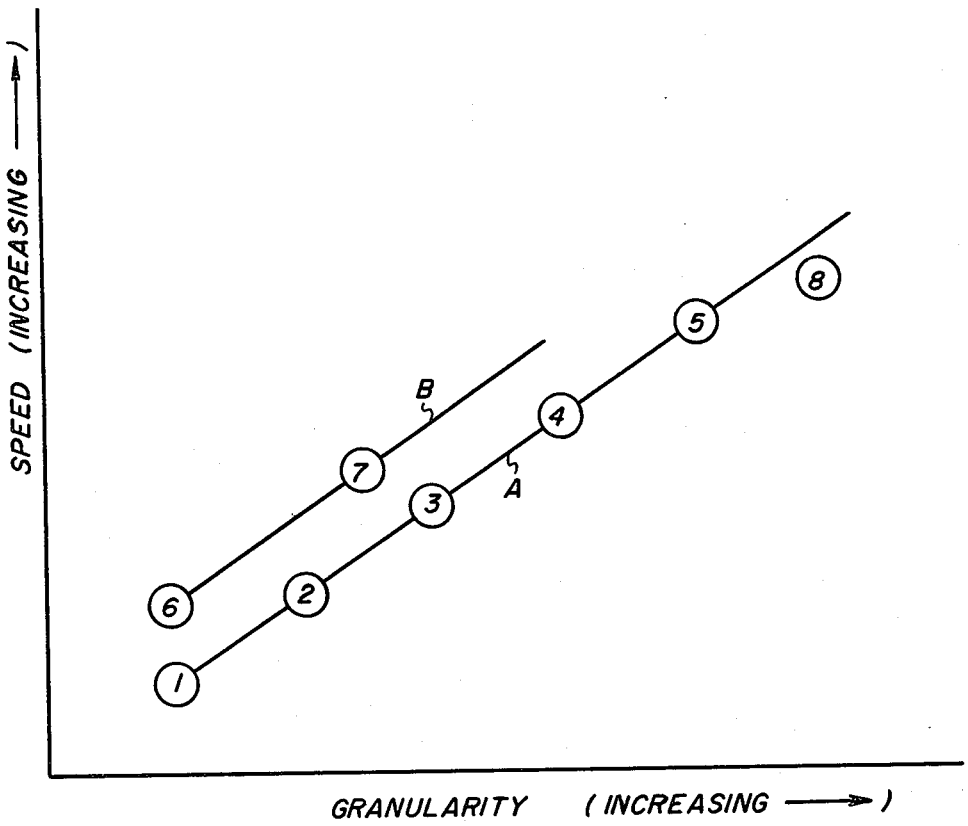
FIGS. 1, 12, and 13 are plots of speed versus granularity.

This invention relates to high aspect ratio tabular grain silver bromoiodide emulsions, to photographic elements which incorporate these emulsions, and to processes for the use of the photographic elements. As applied to the silver bromoiodide emulsions of the present invention the term "high aspect ratio" is herein defined as requiring that the silver bromoiodide grains having a thickness of less than 0.3 micron (optimally less than 0.2 micron) and a diameter of at least 0.6 micron have an average aspect ratio of greater than 8:1 and account for at least 50 percent of the total projected area of the silver halide grains. The tabular grains individually satisfying the thickness and diameter criteria set forth above are hereinafter referred to as "high aspect ratio tabular grains". (The term "high aspect ratio" is analogously applied to emulsions and grains of differing halide content.)

The advantages obtainable with the high aspect ratio tabular grain silver bromoiodide emulsions of the present invention are attributable to the unique positioning of the iodide within the high aspect ratio tabular grains. The high aspect ratio tabular grains are characterized by first and second opposed, substantially parallel major faces and a central region extending between the major faces containing a lower proportion of iodide than at least one laterally displaced region located in the same grain also extending between the major faces. In one preferred form the laterally displaced region is a laterally surrounding annular region. The central region usually forms the portion of the grain first produced during precipitation. However, in variant forms the central region can be introduced as precipitation progresses. For example, the central region can in some instances be annular, surrounding a previously precipitated region of higher iodide content.

The central region can consist essentially of silver bromide or silver bromoiodide. The central region preferably contains less than 5 mole percent iodide (optimally less than 3 mole percent iodide) and at least 1 mole percent less iodide than the laterally displaced region. The iodide concentration in the laterally displaced region can range upwardly to the saturation limit of silver iodide in the silver bromide crystal lattice at the temperature of precipitation—that is, up to about 40 mole percent at a precipitation temperature of 90° C. The laterally displaced region preferably contains from about 6 to 20 mole percent iodide.

The proportion of the high aspect ratio tabular grains formed by the central regions can be varied, depending upon a number of influencing factors, such as grain thicknesses and aspect ratios, iodide concentrations in the laterally displaced region, choice of developer, addenda, and the specific photographic end use. The proportion of the high aspect ratio tabular grains formed by the central regions can be routinely ascertained. Depending upon other factors, such as those indicated above, the central region can comprise from about 1 to 99 percent (by weight) of the high aspect ratio tabular grain. For most applications, such as with preferred grain thicknesses, aspect ratios, progressively varied iodide concentrations, and an annular laterally displaced region, the central region is preferably from about 2 to 50 percent of the high aspect ratio tabular grain, optimally from about 4 to 15 percent of the high aspect ratio tabular grain. On the other hand with abrupt differences in iodide concentrations between central and laterally displaced regions, the central region is preferably from about 97 to 75 percent of the tabular grain.

The unique iodide placement of this invention can be achieved merely by increasing the proportion of iodide present during the growth of the high aspect ratio tabular grains. As is well recognized by those skilled in the art, during the growth of tabular grains silver halide deposition occurs predominantly, if not entirely, at the edges of the grains. By proper choice of precipitation conditions tabular grains exhibit little, if any increase in thickness after initial nucleation. By abruptly changing the iodide concentration present during grain precipitation, it is possible to produce an abrupt increase in the iodide concentration of one or more laterally displaced edge regions as compared to the central region. In some instances the laterally displaced edge regions appear castellated. Alternatively, it is possible to progressively increase the iodide concentration so that there is a smooth gradation from the central region to a laterally displaced annular region. It is possible, although usually not preferred, to lower the iodide concentration of the outermost portion of the tabular grains.

It is an important feature of the present invention that the central regions extend between the opposed major faces of the tabular grains. It is recognized that the iodide content of the central region need not be uniform. For example, it is specifically contemplated that the iodide can and usually will increase near the major faces of the tabular grains. Thus, the iodide concentrations of the central and laterally displaced regions of the tabular grains set forth above are recognized as average iodide concentrations within these regions. While at the major faces the central and laterally displaced regions can exhibit the same surface iodide concentrations, it is preferred that the central regions differ by the amounts indicated above in iodide content from the laterally displaced regions within less than 0.035 micron, most preferably less than 0.025 micron, of the grain surfaces, measured prependicular to the major faces of the high aspect ratio tabular grains.

The preferred high aspect ratio tabular grain silver bromoiodide emulsions of the present invention are those wherein the silver bromoiodide grains having a thickness of less than 0.3 micron and a diameter of at least 0.6 micron have an average aspect ratio of at least 12:1 and optimally at least 20:1. Extremely high average aspect ratios (100:1 or even 200:1 or more) can be obtained. In a preferred form of the invention these silver bromoiodide grains satisfying the above thickness and diameter criteria account for at least 70 percent and optimally at least 90 percent of the total projected area of the silver bromoiodide grains.

It is appreciated that the thinner the tabular grains accounting for a given percentage of the projected area, the higher the average aspect ratio of the emulsion. Typically the tabular grains have an average thickness of at least 0.03 micron, although even thinner tabular grains can in principle be employed. It is recognized that the tabular grains can be increased in thickness to satisfy specialized applications. For example, Jones and Hill, cited above, contemplates the use of tabular grains having average thicknesses up to 0.5 micron in image transfer imaging. Average grain thicknesses of up to 0.5 micron are also discussed below for recording blue light. (For such applications all references to 0.3 micron in reference to aspect ratio determinations should be adjusted to 0.5 micron.) However, to achieve high aspect ratios without unduly increasing grain diameters, it is normally contemplated that the tubular grains of the emulsions of this invention will have an average thickness of less than 0.3 micron.

The grain characteristics described above of the silver bromoiodide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.3 micron and a diameter of at least 0.6 micron. From this the aspect ratio of each such tabular grain can be calculated, and the aspect ratios of all the grains in the sample meeting the less than 0.3 micron thickness and at least 0.6 micron diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the tabular silver bromoiodide grains meeting the thickness and diameter criteria can be summed, the projected areas of the remaining silver bromoiodide grains in the photomicrograph can be summed separately, and from the two sums the percentage of the total projected area of the silver bromoiodide grains provided by the tabular grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory,* Morgan and Morgan, New York, p. 15.

Figure 3:
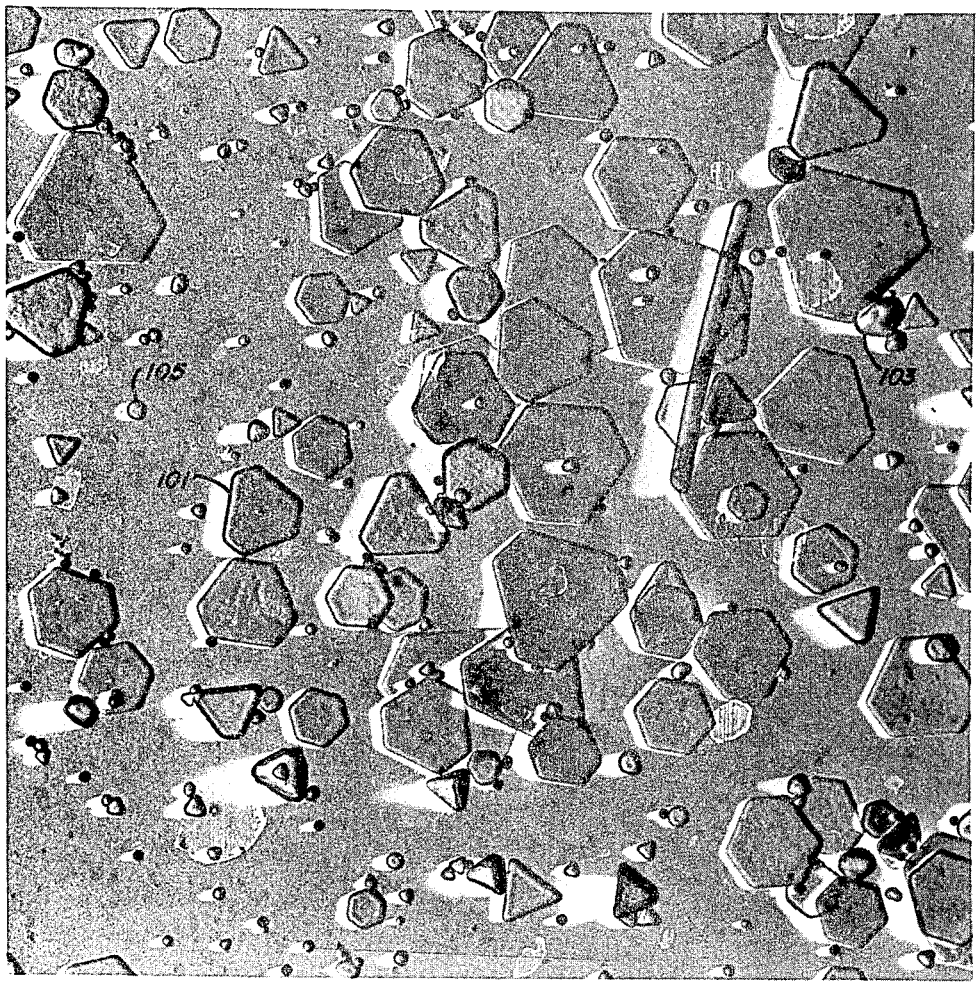
FIGS. 3 and 6 are photomicrographs of high aspect ratio tabular grain silver bromoiodide emulsions according to this invention.

FIG. 3 is an exemplary photomicrograph of an emulsion according to the present invention chosen to illustrate the variant grains that can be present. Grain 101 illustrates a tabular grain that satisfies the thickness and diameter criteria set forth above. It is apparent that the vast majority of the grains present in FIG. 3 are tabular grains which satisfy the thickness and diameter critera. These grains exhibit an average aspect ratio of 16:1. Also present in the photomicrograph are a few grains which do not satisfy the thickness and diameter critera. The grain 103, for example, illustrates a nontabular grain. It is of a thickness greater than 0.3 micron. The grain 105 illustrates a fine grain present that does not satisfy the diameter criterion. Depending upon the conditions chosen for emulsion preparation, more specifically discussed below, in addition to the desired tabular silver bromoiodide grains satisfying the thickness and diameter criteria secondary grain populations of largely nontabular grains, fine grains, or thick tabular grains can be present. Occasionally other nontabular grains, such as rods, can be present. While it is generally preferred to maximize the number of tabular grains satisfying the thickness and diameter criteria, the presence of secondary grain populations is specifically contemplated, provided the emulsions remain of high aspect ratio, as defined above.

High aspect ratio tabular grain silver bromoiodide emulsions can be prepared by controlling introduction of iodide salts in the precipitation process which forms a part of the Wilgus and Haefner invention. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 precent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is contemplated to maintain the pBr of the reaction vessel at or above 0.6, preferably above 1.1. (As herein employed, pBr is defined as the negative logarithm of bromide ion concentration. pH, pI, and pAg are similarly defined for hydrogen, iodide, and silver ion concentrations, respectively.)

During precipitation silver, bromide, and iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.6, the latter being particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide are precipitated in preference to chloride, it is also possible to employ silver chlorobromide and silver chlorobromiodide grains.) The silver halide grains are preferably very fine—e.g., less than 0.1 micron in mean diameter.

Subject to the iodide concentration and pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. it is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al. European Patent Application No. 80102242, and Wey "Growth Mechanism of AgBr Crystals in Gelatin Solution", *Photographic Science and Engineering,* Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

Although the preparation of the high aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of Wilgus and Haefner is described by Daubendiek and Strong, cited above and here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron.

The desired position and concentration of iodide in the high aspect ratio tabular grains of the silver bromoiodide emulsions of this invention can be achieved by controlling the introduction of iodide salts. To provide a central region of limited iodide concentration the introduction of iodide salts can be initially delayed or limited until after the central region of the grain is formed. Since silver iodide is much less soluble than other silver halides, much less iodide salt than bromide salt is in solution during precipitation even when the rates of bromide and iodide salt introduction are equal. Thus, nearly all of the iodide introduced precipitates immediately, with halide ion in solution being provided principally by bromide. Stated another way, iodide is incorporated into the portion of the grain being grown when it is introduced into the reaction vessel. However, some migration of iodide within the grain structure nevertheless can occur. For example, the proportion of the iodide present in the central region has been observed to be slightly higher than predicted based solely on the proportion of bromide and iodide salts being concurrently introduced during formation of the central grain regions. Minor adjustments to compensate for iodide migration into the central grain regions are well within the skill of the art.

By adjusting the proportion of iodide in the halide salts being introduced during precipitation it is possible either gradually or abruptly to increase the level of iodide in the laterally displaced regions of the high aspect ratio tabular grains. In a variant form it is specifically contemplated to terminate iodide or bromide and iodide salt addition to the reaction vessel prior to the termination of silver salt addition so that the bromide ions in the solution react with the silver salt. This results in a shell of silver bromide being formed on the tabular silver bromoiodide grains.

Modifying compounds can be present during silver bromoiodide precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold, and Group VIII noble metals, can be present during silver halide precipitation, as illustrated by Arnold et al. U.S. Pat. No. 1,195,432, Hochstetter U.S. Pat. No. 1,951,933, Trivelli et al. U.S. Pat. No. 2,448,060, Overman U.S. Pat. No. 2,628,167, Mueller et al. U.S. Pat. No. 2,950,972, Sidebotham U.S. Pat. No. 3,488,709, Rosecrants et al. U.S. Pat. No. 3,737,313, Berry et al. U.S. Pat. No. 3,772,031, Atwell U.S. No. 4,269,927, and Research Disclosure, Vol. 134, June 1975, Item 13452. Research Disclosure and its predecessor, Product Licensing Index, are publications of Industrial Opportunities Ltd.; Homewell, Havant; Hampshire, P09 1EF, United Kingdom. The tabular grain emulsions can be internally reduction sensitized during precipitation, as illustrated by Moisar et al. *Journal of Photographic Science,* Vol. 25, 1977, pp.19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al. U.S. Pat. No. 3,821,002, Oliver U.S. Pat. No. 3,031,304 and Claes et al., *Photographische Korrespondenz,* Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, Finnicum et al. U.S. Pat. No. 4,147,551, Verhille et al. U.S. Pat. No. 4,171,224, Calamur U.K. Patent Application No. 2,022,431A, Saito et al. German OLS Nos. 2,555,364 and 2,556,885, and *Research Disclosure,* Volume 166, February 1978, Item 16662.

In forming the tabular grain silver bromoiodide emulsions a dispersing medium is initially contained within the reaction vessel. In the preferred form the dispersing medium is comprised on an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among these conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al. U.S. Pat. Nos. 2,614,928 and '929, Lowe et al. U.S. Pat. Nos. 2,691,582, 2,614,930, '931, 2,327,808 and 2,448,534, Gates et al. U.S. Pat. Nos. 2,787,545 and 2,956,880, Himmelmann et al. U.S. Pat. No. 3,061,436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al U.S. Pat. No. 3,227,571, Boyer et al. U.S. Pat. No. 3,532,502, Malan U.S. Pat. No. 3,551,151, Lohmer et al. U.S. Pat. No. 4,108,609, Luciani et al. U.K. Pat. No. 1,186,790, Hori et al. U.K. Pat. No. 1,489,080 and Belgian Pat. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No. 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488,708, Whiteley et al. U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al. U.S. Pat. No. 3,879,205, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. No. 2,957,767, Dawson et al. U.S. Pat. No. 2,893,867, Smith et al. U.S. Pat. Nos. 2,860,986 and 2,904,539, Ponticello et al. U.S. Pat. Nos. 3,929,482 and 3,860,428, Ponticello U.S. Pat. No. 3,939,130, Dykstra U.S. Pat. No. 3,411,911 and Dykstra et al. Canadian Patent No. 774,054, Ream et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat. Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during silver halide precipitation, but rather are conventionally added to the emulsion prior to coating. The vehicle materials, including particularly the hydrophilic colloids, s well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver bromoiodide emulsions according to the present invention. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al. U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al. U.S. Pat. No. 3,737,313, here incorporated by reference, can be employed.

The tabular grain high aspect ratio silver bromoiodide emulsions of the present invention are preferably washed to remove soluble salts. The soluble salts can be removed by decantation, filtration, and/or chill setting and leaching, as illustrated by Craft U.S. Pat. No. 2,316,845 and McFall et al. U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al. U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated emulsion, as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al. German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular silver bromoiodide grains after the completion of precipitation to avoid increasing their thickness and reducing their aspect ratio.

Once the high aspect ratio tabular grain emulsions have been formed they can be shelled to produce a core-shell emulsion by procedures well known to those skilled in the art. Any photographically useful silver salt can be employed in forming shells on the high aspect ratio tabular grain emulsions prepared by the present process. Techniques for forming silver salt shells are illustrated by Berriman U.S. Pat. No. 3,367,778, Porter et al. U.S. Pat. Nos. 3,206,313 and 3,317,322, Morgan U.S. Pat. No. 3,917,485, and Maternaghan, cited above. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline. Wey and Wilgus U.S. Ser. No. 431,854, filed concurrently herewith and commonly assigned, titled Novel Silver Chlorobromide Emulsions and Processes For Their Preparation, which is a continuation-in-part of U.S. Ser. No. 320,899, filed Nov. 12, 1981, now abandoned, both here incorporated by reference, specifically teaches procedures for shelling tabular grains without necessarily reducing the aspect ratios of the resulting core-shell grains as compared to the tabular grains employed as core grains. Evans, Daubendiek, and Raleigh U.S. Ser. No. 431,912, filed concurrently herewith and commonly assigned, titled Photographic Image Transfer Film Unit Employing Reversal Emulsions, which is a continuation-in-part of U.S. Ser. No. 320,891, filed Nov. 12, 1981, now abandoned, both here incorporated by reference, specifically discloses the preparation of high aspect ratio core-shell tabular grain emulsions for use in forming direct reversal images.

Although the procedures for preparing tabular silver bromoiodide grains described above will produce high aspect ratio tabular grain emulsions in which the tabular grains satisfying the thickness and diameter criteria for aspect ratio account for at least 50 percent of the total projected area of the total silver bromoiodide grain population, it is recognized that advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al. U.S. Pat. No. 3,326,641.

It is generally most convenient to prepare high aspect ratio tabular grain silver bromoiodide emulsions according to the present invention in which substantially the entire tabular grain population, particularly those tabular grains satisfying the thickness and diameter criteria set forth above, incorporate a central region and at least one laterally displaced region of higher iodide content. Once such an emulsion is prepared it can be blended with another high aspect ratio tabular grain silver halide emulsion, such as a high aspect ratio tabular grain silver bromoiodide emulsion having a substantially uniform iodide concentration, as described by Wilgus and Haefner, cited above, or with iodide concentrated toward the central region of the grain. The resulting blended emulsions in general exhibit the improved photographic response of this invention, as described above, in direct relation to the proportion of the silver bromoiodide present in the form of high aspect ratio tabular silver bromoiodide grains of lower iodide concentration in a central region than a laterally displaced region. While the emulsions of the present invention need only contain sufficient high aspect ratio tabular silver bromoiodide grains having a higher proportion of iodide in at least one laterally displaced region than in a central region to produce an improved photographic response, it is preferred that at least 50 percent, optimally at least 90 percent, by weight, of the high aspect ratio tabular silver bromoiodide grains in the emulsions of this invention have a central region containing a lower proportion of iodide than in a laterally displaced region, as described above.

The high aspect ratio tabular grain emulsions of the present invention can be chemically sensitized. They can be chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al. U.S. Pat. No. 1,623,499, Matthies et al. U.S. Pat. No. 1,673,522, Waller et al. U.S. Pat. No. 2,399,083, Damschroder et al. U.S. Pat. No. 2,642,361, McVeigh U.S. Pat. No. 3,297,447, Dunn U.S. Pat. No. 3,297,446, McBride U.K. Pat. No. 1,315,755, Berry et al. U.S. Pat. No. 3,772,031, Gilman et al. U.S. Pat. No. 3,761,267, Ohi et al. U.S. Pat. No. 3,857,711, Klinger et al. U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361; sulfur containing compounds of the type disclosed in Lowe et al. U.S. Pat. No. 2,521,926, Williams et al. U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al. U.S. Pat. No. 2,131,038, Dostes U.S. Pat. No. 3,411,914, Kuwabara et al. U.S. Pat. No. 3,554,757, Oguchi et al. U.S. Pat. No. 3,565,631, Oftedahl U.S. Pat. No. 3,901,714, Walworth Canadian Patent No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al. U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al. U.S. Pat. No. 2,983,609, Oftedahl et al. *Research Disclosure,* Vol. 136, August 1975, Item 13654, Lowe et al. U.S. Pat. Nos. 2,518,698 and 2,739,060, Roberts et al. U.S. Pat. Nos. 2,743,182 and '183, Chambers et al. U.S. Pat. No. 3,026,203 and Bigelow et al. U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the high aspect ratio tabular grain silver bromoiodide emulsions of the present invention are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

In addition to being chemically sensitized the high aspect ratio tabular grain silver bromoiodide emulsions of the present invention are also spectrally sensitized. It is specifically contemplated to employ spectral sensitizing dyes that xhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenzolium, selenazolinium, imidazolium, imidazolinium, benoxazolium, benzothiazolium, benzoselenazolium, benzimidazolium, naphthoxazolium, naphthothiazolium, nahthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al. U.S. Pat. No. 2,131,038 and Shiba et al. U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al.), pp. 175–178 (Leubner) and pp. 475–485 (Gilman). Oxidation and reduction potentials can be measured as described by R. F. Large in *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver bromoiodide emulsions are those found in U.K. Pat. No. 742,112, Brooker U.S. Pat. Nos. 1,846,300, '301, '302, '303, '304, 2,078,233 and 2,089,729, Brooker et al. U.S. Pat. Nos. 2,165,338, 2,213,238, 2,231,658, 2,493,747, '748, 2,526,632, 2,739,964 (U.S. Pat. No. 24,292), 2,778,823, 2,917,516, 3,352,857, 3,411,916 and 3,431,111, Wilmanns et al. U.S. Pat. No. 2,295,276, Sprague U.S. Pat. Nos. 2,481,698 and 2,503,776, Carroll et al. U.S. Pat. Nos. 2,688,545 and 2,704,714, Larive et al. U.S. Pat. No. 2,921,067, Jones U.S. Pat. No. 2,945,763, Nys et al. U.S. Pat. No. 3,282,933, Schwann et al. U.S. Pat. No. 3,397,060, Riester U.S. Pat. No. 3,660,102, Kampfer et al. U.S. Pat. No. 3,660,103, Taber et al. U.S. Pat. Nos. 3,335,010, 3,352,680 and 3,384,486, Lincoln et al. U.S. Pat. No. 3,397,981, Fumia et al. U.S. Pat. Nos. 3,482,978 and 3,623,881, Spence et al. U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al. U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bistriazinylaminostilbenes, as taught by McFall et al. U.S. Pat. No. 2,933,390; sulfonated aromatic compounds, as taught by Jones et al. U.S. Pat. No. 2,937,089; mercaptosubstituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain silver bromoiodide emulsions of this invention in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al., "The Adsorption of Sensitizing Dyes in Photographic Emulsions", *Journal of Phys. Chem.*, Vol. 56, p. 1065, 1952; Spence et al., "Desensitization of Sensitizing Dyes", *Journal of Physical and Colloid Chemistry*, Vol. 56, No. 6, June 1948, pp. 1090–1103; and Gilman et al. U.S. Pat. No. 3,979,213. Optimum dye concentration levels can be chosen by procedures taught by Mees, *Theory of the Photographic Process*, Macmillan, pp. 1067–1069, cited above.

Although native blue sensitivity of silver bromoiodide is usually relied upon in the art in emulsion layers intended to record exposure to blue light, significant advantages can be obtained by the use of blue spectral sensitizers. Where it is intended to expose emulsions according to the present invention in their region of native sensitivity, advantages in sensitivity can be gained by increasing the thickness of the tabular grains. For example, it is preferred to increase grain thicknesses as described above in connection with Jones and Hill, cited above. Specifically, in one preferred form of the invention the emulsions are blue sensitized silver bromoiodide emulsions in which the tabular grains having a thickness of less than 0.5 micron and a diameter of at least 0.6 micron have an average aspect ratio of greater than 8:1, preferably at least 12:1 and account for at least 50 percent of the total projected area of the silver halide grains present in the emulsion, preferably 70 percent and optimally at least 90 percent. In the foregoing description 0.3 micron can, of course, be substituted for 0.5 micron without departing from the invention.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al. U.S. Pat. No. 3,628,960, and Locker et al. U.S. Pat. No. 4,225,666. As taught by Locker et al., it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al., it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

As taught by Kofron et al., cited above, high aspect ratio tabular grain silver bromoiodide emulsions can exhibit higher speed-granularity relationships when chemically and spectrally sensitized than have been heretofore realized using low aspect ratio tabular grain silver bromoiodide emulsions and/or silver bromoiodide emulsions of the highest known speed-granularity relationships. Best results have been achieved using minus blue spectral sensitizing dyes.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-1}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky U.S. Ser. No. 431,855, filed concurrently herewith and commonly assigned, titled Controlled Site Epitaxial Sensitization, which is a continuation-in-part of U.S. Ser. No. 320,920, filed Nov. 12, 1981, now abandoned, both of which are here incorporated by reference, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form of the invention, the high aspect ratio tabular grain silver bromoiodide emulsions of the present invention contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washing techniques. In various of the preferred forms indicated above the tabular silver bromoiodide grains can have another silver salt at their surface, such as silver thiocyanate, silver chloride, or silver bromide, although the other silver salt may be present below detectable levels.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the silver halide grains of an emulsion have been characterized, it is possible to estimate from further product analysis and performance evaluation whether an emulsion layer of a product appears to be substantially optimally chemically and spectrally sensitized in relation to comparable commercial offerings of other manufacturers. To achieve the sharpness advantages of the present invention it is immaterial whether the silver halide emulsions are chemically or spectrally sensitized efficiently or inefficiently.

Once high aspect ratio tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson U.S. Ser. No. 430,574, filed concurrently herewith and commonly assigned, titled Forehardened Photographic Elements and Processes for Their Use, which is a continuation-in-part of U.S. Ser. No. 320,911, filed Nov. 12, 1981, now abandoned, both of which are here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al. U.S. Pat. No. 3,232,764; blocked dialdehydes, as illustrated by Kaszuba U.S. Pat. No. 2,586,168, Jeffreys U.S. Pat. No. 2,870,013, and Yamamoto et al. U.S. Pat. No. 3,819,608; α-diketones, as illustrated by Allen et al. U.S. Pat. No. 2,725,305; active esters of the type described by Burness et al. U.S. Pat. No. 3,542,558; sulfonate esters, as illustrated by Allen et al. U.S. Pat. Nos. 2,725,305 and 2,726,162; active halogen compounds, as illustrated by Burness U.S. Pat. No. 3,106,468, Silverman et al. U.S. Pat. No. 3,839,042, Ballantine et al. U.S. Pat. No. 3,951,940 and Himmelmann et al. U.S. Pat. No. 3,174,861; s-triazines and diazines, as illustrated by Yamamoto et al. U.S. Pat. No. 3,325,287, Anderau et al. U.S. Pat. No. 3,288,775 and Stauner et al. U.S. Pat. No. 3,992,366; epoxides, as illustrated by Allen et al. U.S. Pat. No. 3,047,394, Burness U.S. Pat. No. 3,189,459 and Birr et al. German Patent No. 1,085,663; aziridines, as illustrated by Allen et al. U.S. Pat. No. 2,950,197, Burness et al. U.S. Pat. No. 3,271,175 and Sato et al. U.S. Pat. No. 3,575,705; active olefins having two or more active vinyl groups (e.g. vinylsulfonyl groups), as illustrated by Burness et al. U.S. Pat. Nos. 3,490,911, 3,539,644 and 3,841,872 (U.S. Pat. No. 29,305), Cohen U.S. Pat. No. 3,640,720, KLeist et al. German Patent No. 872,153 and Allen U.S. Pat. No. 2,992,109; blocked active olefins, as illustrated by Burness et al. U.S. Pat. No. 3,360,372 and Wilson U.S. Pat. No. 3,345,177; carbodiimides, as illustrated by Blout et al. German Patent No. 1,148,446; isoxazolium salts unsubstituted in the 3-position, as illustrated by Burness et al. U.S. Pat. No. 3,321,313; esters of 2-alkoxy-N-carboxydihydroquinoline, as illustrated by Bergthaller et al. U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al. U.S. Pat. No. 3,792,021, and vinyl sulfones containing other hardening functional groups, as illustrated by Sera et al. U.S. Pat. No. 4,028,320; and polymeric hardeners, such as dialdehyde starches, as illustrated by Jeffreys et al. U.S. Pat. No. 3,057,723, and copoly(acrolein-methacrylic acid), as illustrated by Himmelmann et al. U.S. Pat. No. 3,396,029.

The use of forehardeners in combination is illustrated by Sieg et al. U.S. Pat. No. 3,497,358, Dallon et al. U.S. Pat. No. 3,832,181 and 3,840,370 and Yamamoto et al. U.S. Pat. No. 3,898,089. Hardening accelerators can be used, as illustrated by Sheppard et al. U.S. Pat. No. 2,165,421, Kleist German Patent No. 881,444, Riebel et al. U.S. Pat. No. 3,628,961 and Ugi et al. U.S. Pat. No. 3,901,708. The patents illustrative of hardeners and hardener combinations are here incorporated by reference.

Instability which increases minimum density in negative type emulsion coatings (i.e., fog) or which increases minimum density or decreases maximum density in direct-positive emulsion coatings can be protected against by incorporation of stabilizers, antifoggants, antikinking agents, latent image stabilizers and similar addenda in the emulsion and contiguous layers prior to coating. Many of the antifoggants which are effective in emulsions can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings stabilizers and antifoggants can be employed, such as halide ions (e.g., bromide salts); chloropalladates and chloropalladites, as illustrated by Trivelli et al. U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al. U.S. Pat. No. 2,728,663; selenols and diselenides, as illustrated by Brown et al. U.K. Pat. No. 1,336,570 and Pollet et al. U.K. Pat. No. 1,282,303; quaternary ammonium salts of the type illustrated by Allen et al. U.S. Pat. No. 2,694,716, Brooker et al. U.S. Pat. No. 2,131,038, Graham U.S. Pat. No. 3,342,596 and Arai et al. U.S. Pat. No. 3,954,478; azomethine desensitizing dyes, as illustrated by Thiers et al. U.S. Pat. No. 3,630,744; isothiourea derivatives, as illustrated by Herz et al. U.S. Pat. No. 3,220,839 and Knott et al. U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al. U.S. Pat. No. 2,751,297; azotriazoles and azotetrazoles, as illustrated by Baldassarri et al. U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure,* Vol. 134, June 1975, Item 13452, and Vol. 148, August 1976, Item 14851, and Nepker et al. U.K. Pat. No. 1,338,567; mercaptotetrazoles, -triazoles and -diazoles, as illustrated by Kendell et al. U.S. Pat. No. 2,403,927, Kennard et al. U.S. Pat. No. 3,266,897, *Research Disclosure,* Vol. 116, December 1973, Item 11684, Luckey et al. U.S. Pat. No. 3,397,987 and Salesin U.S. Pat. No. 3,708,303; azoles, as illustrated by Peterson et al. U.S. Pat. No. 2,271,229 and *Research Disclosure,* Item 11684, cited above; purines, as illustrated by Sheppard et al. U.S. Pat. No. 2,319,090, Birr et al. U.S. Pat. No. 2,152,460, *Research Disclosure,* Item 13452, cited above, and Dostes et al. French Patent No. 2,296,204 and polymers of 1,3-dihydroxy(and/or 1,3-carbamoxy)-2-methylenepropane, as illustrated by Saleck et al. U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al. U.S. Pat. No. 2,597,915, and sulfinamides, as illustrated by Nishio et al. U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al. U.S. Pat. No. 2,716,062, U.K. Pat. No. 1,466,024 and Habu et al. U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Pat. No. 1,158,059 and aldoximines, amides, anilides and esters, as illustrated by Butler et al. U.K. Pat. No. 988,052.

The emulsions can be protected from fog and desensitization caused by trace amounts of metals such as copper, lead, tin, iron and the like, by incorporating addenda, such as sulfocatechol-type compounds, as illustrated by Kennard et al. U.S. Pat. No. 3,236,652; aldoximines, as illustrated by Carroll et al. U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Pat. No. 897,497 and Stevens et al. U.K. Pat. No. 1,039,471 and quinoline derivatives, as illustrated by Dersch et al. U.S. Pat. No. 3,446,618.

Among stabilizers useful in protecting the emulsion layers against dichroic fog are addenda, such as salts of nitron, as illustrated by Barbier et al. U.S. Pat. Nos. 3,679,424 and 3,820,998; mercaptocarboxylic acids, as illustrated by Willems et al. U.S. Pat. No. 3,600,178, and addenda listed by E. J. Birr, *Stabilization of Photographic Silver Halide Emulsions,* Focal Press, London, 1974, pp. 126–128.

Among stabilizers useful in protecting emulsion layers against development fog are addenda such as azabenzimidazoles, as illustrated by Bloom et al. U.K. Pat. No. 1,356,142 and U.S. Pat. No. 3,575,699, Rogers U.S. Pat. No. 3,473,924 and Carlson et al. U.S. Pat. No. 3,649,267; substituted benzimidazoles, benzothiazoles, benzotriazoles and the like, as illustrated by Brooker et al. U.S. Pat. No. 2,131,038, Land U.S. Pat. No. 2,704,721, Rogers et al. U.S. Pat. No. 3,265,498; mercapto-substituted compounds, e.g., mercaptotetrazoles, as illustrated by Dimsdale et al. U.S. Pat. No. 2,432,864, Rauch et al. U.S. Pat. No. 3,081,170, Weyerts et al. U.S. Pat. No. 3,260,597, Grasshoff et al. U.S. Pat. No. 3,674,478 and Arond U.S. Pat. No. 3,706,557; isothiourea derivatives, as illustrated by Herz et al. U.S. Pat. No. 3,220,839, and thiodiazole derivatives, as illustrated by von Konig U.S. Pat. No. 3,364,028 and von Konig et al. U.K. Pat. No. 1,186,441.

Where hardeners of the aldehyde type are employed, the emulsion layers can be protected with antifoggants, such as monohydric and polyhydric phenols of the type illustrated by Sheppard et al. U.S. Pat. No. 2,165,421; nitro-substituted compounds of the type disclosed by Rees et al. U.K. Pat. No. 1,269,268; poly(alkylene oxides), as illustrated by Valbusa U.K. Pat. No. 1,151,914, and mucohalogenic acids in combination with urazoles, as illustrated by Allen et al. U.S. Pat. Nos. 3,232,761 and 3,232,764, or further in combination with maleic acid hydrazide, as illustrated by Rees et al. U.S. Pat. No. 3,295,980.

To protect emulsion layers coated on linear polyester supports addenda can be employed such as parabanic acid, hydantoin acid hydrazides and urazoles, as illustrated by Anderson et al. U.S. Pat. No. 3,287,135, and piazines containing two symmetrically fused 6-member carbocyclic rings, especially in combination with an aldehyde-type hardening agent, as illustrated in Rees et al. U.S. Pat. No. 3,396,023.

Kink desensitization of the emulsions can be reduced by the incorporation of thallous nitrate, as illustrated by Overman U.S. Pat. No. 2,628,167; compounds, polymeric latices and dispersions of the type disclosed by Jones et al. U.S. Pat. Nos. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al. U.S. Pat. No. 3,033,680; water-soluble interpolymers of the type disclosed by Rees et al. U.S. Pat. No. 3,536,491; polymeric latices prepared by emulsion polymerization in the presence of poly(alkylene oxide), as disclosed by Pearson et al. U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions, as illustrated by Abbott et al. U.S. Pat. No. 3,295,976, Barnes et al. U.S. Pat. No. 3,545,971, Salesin U.S. Pat. No. 3,708,303, Yamamoto et al. U.S. Pat. No. 3,615,619, Brown et al. U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al. U.S. Pat. No. 3,843,364, Priem et al. U.S. Pat. No. 3,867,152, Adachi et al. U.S. Pat. No. 3,967,965 and Mikawa et al. U.S. Pat. Nos. 3,947,274 and 3,954,474.

In addition to increasing the pH or decreasing the pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekiel et al. U.K. Pat. No. 1,394,371, Jefferson U.S. Pat. No. 3,843,372, Jefferson et al. U.K. Pat. No. 1,412,294 and Thurston U.K. Pat. No. 1,343,904; carbonyl-bisulfite addition products in combination with hydroxybenzene or aromatic amine developing agents, as illustrated by Seiter et al. U.S. Pat. No. 3,424,583; cycloalkyl-1,3-diones, as illustrated by Beckett et al. U.S. Pat. No. 3,447,926; enzymes of the catalase type, as illustrated by Matejec et al. U.S. Pat. No. 3,600,182; halogen-substituted hardeners in combination with certain cyanine dyes, as illustrated by Kumai et al. U.S. Pat. No. 3,881,933; hydrazides, as illustrated by Honig et al. U.S. Pat. No. 3,386,831; alkenylbenzothiazolium salts, as illustrated by Arai et al. U.S. Pat. No. 3,954,478; soluble and sparingly soluble mercaptides, as illustrated by Herz U.S. Pat. No. 4,374,196, commonly assigned and here incorporated by reference; hydroxy-substituted benzylidene derivatives, as illustrated by Thurston U.K. Pat. No. 1,308,777 and Ezekiel et al. U.K. Pat. Nos. 1,347,544 and 1,353,527; mercapto-substituted compounds of the type disclosed by Sutherns U.S. Pat. No. 3,519,427; metal-organic complexes of the type disclosed by Matejec et al. U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al. U.S. Pat. No. 3,910,791; combinations of iridium and rhodium compounds, as disclosed by Yamasue et al. U.S. Pat. No. 3,901,713; sydnones or sydnone imines, as illustrated by Noda et al. U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda are disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the high aspect ratio tabular grain emulsions of the present invention with each other, discussed above, or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I. It is specifically contemplated to blend the emulsions as described in sub-paragraph F of Paragraph I. When a relatively fine grain silver chloride emulsion is blended with or coated adjacent the emulsions of the present invention, a further increase in the contrast and/or sensitivity—i.e., speed-granularity relationship—of the emulsion can result, as taught by Russell U.S. Pat. No. 3,140,179 and Gadowsky U.S. Pat. No. 3,152,907.

In their simplest form photographic elements according to the present invention employ a single emulsion layer containing a high aspect ratio tabular grain silver bromoiodide emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. No. 3,411,908 and Joseph et al. U.S. Pat. No. 3,630,740, over polystyrene and polyester film supports, as illustrated by Crawford et al. U.S. Pat. No. 3,630,742, or can be employed as unitary flexible reflection supports, as illustrated by Venor et al. U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al. U.S. Pat. No. 2,739,070.

Preferred polyester film supports are comprised of linear polyester, such as illustrated by Alles et al. U.S. Pat. No. 2,627,088, Wellman U.S. Pat. No. 2,720,503, Alles U.S. Pat. No. 2,779,684 and Kibler et al. U.S. Pat. No. 2,901,466. Polyester films can be formed by varied techniques, as illustrated by Alles, cited above, Czerkas et al. U.S. Pat. No. 3,663,683 and Williams et al. U.S. Pat. No. 3,504,075, and modified for use as photographic film supports, as illustrated by Van Stappen U.S. Pat. No. 3,227,576, Nadeau et al. U.S. Pat. No. 3,501,301, Reedy et al. U.S. Pat. No. 3,589,905, Babbitt et al. U.S. Pat. No. 3,850,640, Bailey et al. U.S. Pat. No. 3,888,678, Hunter U.S. Pat. No. 3,904,420 and Mallinson et al. U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al. U.S. Pat. Nos. 3,725,070 and 3,793,249; Wilson *Research Disclosure,* Vol. 118, February 1974, Item 11833, and Vol. 120, April 1974, Item 12046; Conklin et al. *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application No. W080/01614, published Aug. 7, 1980, (Belgian Patent No. 881,513, Aug. 1, 1980, corresponding), Blazey et al. U.S. Pat. No. 4,307,165, and Gilmour et al. U.S. Ser. No. 293,080, filed Aug. 17, 1981, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, N.Y., 1977, and *Neblette's Handbook of Photography and Reprography-Materials, Processes and Systems, VanNostrand* Reinhold Company, 7th Ed., 1977.

Included among the processing methods are web processing, as illustrated by Tregillus et al U.S. Pat. No.

3,179,517; stabilization processing, as illustrated by Herz et al. U.S. Pat. No. 3,220,839, Cole U.S. Pat. No. 3,615,511, Shipton et al. U.K. Pat. No. 1,258,906 and Haist et al. U.S. Pat. No. 3,647,453; monobath processing as described in Haist, *Monobath Manual,* Morgan and Morgan, Inc., 1966, Schuler U.S. Pat. No. 3,240,603, Haist et al. U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al. U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al. U.S. Pat. No. 3,232,761; roller transport processing, as illustrated by Russel et al. U.S. Pat. Nos. 3,025,779 and 3,515,556, Masseth U.S. Pat. No. 3,573,914, Taber et al. U.S. Pat. No. 3,647,459 and Rees et al. U.K. Pat. No. 1,269,268; alkaline vapor processing, as illustrated by *Product Licensing Index,* Vol. 97, May 1972, Item 9711, Goffe et al. U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al. U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted corresponding in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al. U.S. Pat. No. 3,113,864, Vittum et al. U.S. Pat. Nos. 3,002,836, 2,271,238 and 2,362,598, Schwan et al. U.S. Pat. No. 2,950,970, Carroll et al. U.S. Pat. No. 2,592,243, Porter et al. U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al. U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al., *Die Chemie,* Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al. U.S. Pat Nos. 2,423,730, 2,772,162, 2,895,826, 2,710,803, 2,407,207, 3,737,316 and 2,367,531, Loria et al. U.S. Pat Nos. 2,772,161, 2,600,788, 3,006,759, 3,214,437 and 3,253,924, McCrossen et al. U.S. Pat. No. 2,875,057, Bush et al U.S. Pat. No. 2,908,573, Gledhill et al. U.S. Pat. No. 3,034,892, Weissberger et al. U.S. Pat. Nos. 2,474,293, 2,407,210, 3,062,653, 3,265,506 and 3,384,657, Porter et al. U.S. Pat. No. 2,343,703, Greenhalgh et al. U.S. Pat. No. 3,127,269, Feniak et al. U.S. Pat. Nos. 2,865,748, 2,933,391 and 2,865,751, Bailey et al. U.S. Pat. No. 3,725,067, Beavers et al. U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al. U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al. U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Patent No. 726,651, Schulte et al. U.K. Pat. No. 1,248,924 and Whitmore et al. U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al. U.S. Pat. No. 3,148,062; Barr et al. U.S. Pat. No. 3,227,554, Barr U.S. Pat. No. 3,733,201, Sawdey U.S. Pat. No. 3,617,291, Groet et al. U.S. Pat. No. 3,703,375, Abbott et al. U.S. Pat. No. 3,615,506, Weissberger et al. U.S. Pat. No. 3,265,506, Seymour U.S. Pat. No. 3,620,745, Marx et al. U.S. Pat.

No. 3,632,345, Mader et al. U.S. Pat. No. 3,869,291, U.K. Pat. No. 1,201,110, Oishi et al. U.S. Pat. No. 3,642,485, Verbrugghe U.K. Pat. No. 1,236,767, Fujiwhara et al. U.S. Pat. No. 3,770,436 and Matsuo et al. U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al. German OLS No. 2,529,350 and U.S. Pat. Nos. 3,928,041, 3,958,993 and 3,961,959, Odenwalder et al. German OLS No. 2,448,063, Tanaka et al. German OLS 2,610,546, Kikuchi et al. U.S. Pat. No. 4,049,455 and Credner et al. U.S. Pat. No. 4,052,213. DIR compounds which oxidatively cleave can be employed, as illustrated by Porter et al. U.S. Pat. No. 3,379,529, Green et al. U.S. Pat. No. 3,043,690, Barr U.S. Pat. No. 3,364,022, Duennebier et al. U.S. Pat. No. 3,297,445 and Rees et al. U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al. U.S. Pat. No. 3,892,572.

The photographic elements can incorporate colored dye-forming couplers, such as those employed to form integral masks for negative color images, as illustrated by Hanson U.S. Pat. No. 2,449,966, Glass et al. U.S. Pat. No. 2,521,908, Gledhill et al. U.S. Pat. No. 3,034,892, Loria U.S. Pat. No. 3,476,563, Lestina U.S. Pat. No. 3,519,429, Friedman U.S. Pat. No. 2,543,691, Puschel et al. U.S. Pat. No. 3,028,238, Menzel et al. U.S. Pat. No. 3,061,432 and Greenhalgh U.K. Pat. No. 1,035,959, and/or competing couplers, as illustrated by Murin et al. U.S. Pat. No. 3,876,428, Sakamoto et al. U.S. Pat. No. 3,580,722, Puschel U.S. Pat. No. 2,998,314, Whitmore U.S. Pat. No. 2,808,329, Salminen U.S. Pat. No. 2,742,832 and Weller et al. U.S. Pat. No. 2,689,793.

The photographic elements can include image dye stabilizers. Such image dye stabilizers are illustrated by U.K. Pat. No. 1,326,889, Lestina et al. U.S. Pat. Nos. 3,432,300 and 3,698,909, Stern et al. U.S. Pat. No. 3,574,627, Brannock et al. U.S. Pat. No. 3,573,050, Arai et al. U.S. Pat. No. 3,764,337 and Smith et al. U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al. U.S. Pat. No. 3,822,129, Bissonette U.S. Pat. Nos. 3,834,907 and 3,902,905, Bissonette et al. U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al. U.S. Pat. No. 3,754,923, Piller et al. U.S. Pat. No. 3,749,576, Yoshida et al. U.S. Pat. No. 3,738,839, Froelich et al. U.S. Pat. No. 3,716,368, Piller U.S. Pat. No. 3,655,388, Williams et al. U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al. U.S. Pat. Nos. 3,202,511 and 3,178,291 and Anderau et al. U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al. U.S. Pat. No. 3,684,513, Watanabe et al. U.S. Pat. No. 3,615,493, Wilson et al. U.S. Pat. No. 3,503,741, Boes et al. U.S. Pat. No. 3,340,059, Gompf et al. U.S. Pat. No. 3,493,372 and Puschel et al. U.S. Pat. No. 3,561,970, can be employed.

It is common practice in forming dye images in silver halide photographic elements to remove the silver which is developed by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al. *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al. U.S. Pat. No. 3,620,747.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al. U.S. Pat. No. 2,252,718, Schwan et al. U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annula,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al. U.S. Pat. No. 3,647,452, Puschel et al. German Patent No. 1,257,570 and U.S. Pat. Nos. 3,457,077 and 3,467,520, Accary-Venet et al. U.K. Pat. No. 1,132,736, Schranz et al. German Patent No. 1,259,700, Marx et al. German Patent No. 1,259,701 and Muller-Bore German OLS No. 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

The present invention can be employed to produce multicolor photographic images, as taught by Kofron et al., cited above. Generally any conventional multicolor imaging element containing at least one silver halide emulsion layer can be improved merely by adding or substituting a high aspect ratio tabular grain emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. A high aspect ratio tubular grain emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively.

In a specific preferred form of a minus blue sensitized high aspect ratio tabular grain silver bromoiodide emulsion according to the invention forms at least one of the emulsion layers intended to record green or red light in a triad of blue, green, and red recording emulsion layers of a multicolor photographic element and is positioned to receive during exposure of the photographic element to neutral light at 5500° K. blue light in addition to the light the emulsion is intended to record. The relationship of the blue and minus blue light the layer receives can be expressed in terms of Δ log E, where $$\Delta \log E = \log E_T - \log E_B$$

log $E_T$ being the log of exposure to green or red light the tabular grain emulsion is intended to record and log $E_B$ being the log of concurrent exposure to blue light the tabular grain emulsion also receives. (In each occurrence exposure, E, is in meter-candle-seconds, unless otherwise indicated.)

As taught by Kofron et al., cited above, Δ log E can be less than 0.7 (preferably less than 0.3) while still obtaining acceptable image replication of a multicolor subject. This is surprising in view of the high proportion of grains present in the emulsions of the present invention having an average diameter of greater than 0.7 micron. If a comparable nontabular or lower aspect ratio tabular grain emulsion of like halide composition and average grain diameter is substituted for a high aspect ratio tabular grain silver bromoiodide emulsion of the present invention a higher and usually unacceptable level of color falsification will result. In a specific preferred form of the invention at least the minus blue recording emulsion layers of the triad of blue, green, and red recording emulsion layers are silver bromoiodide emulsions according to the present invention. It is specifically contemplated that the blue recording emulsion layer of the triad can advantageously also be a high aspect ratio tabular grain emulsion according to the present invention. In a specific preferred form of the invention the tabular grains present in each of the emulsion layers of the triad having a thickness of less than 0.3 micron have an average grain diameter of at least 1.0 micron, preferably at least 2 microns. In a still further preferred form of the invention the multicolor photographic elements can be assigned an ISO speed index of at least 180.

The multicolor photographic elements of Kofron et al., cited above, need contain no yellow filter layer positioned between the exposure source and the high aspect ratio tabular grain green and/or red emulsion layers to protect these layers from blue light exposure, or the yellow filter layer, if present, can be reduced in density to less than any yellow filter layer density heretofore employed to protect from blue light exposure red or green recording emulsion layers of photographic elements intended to be exposed in daylight. In one specifically preferred form no blue recording emulsion layer is interposed between the green and/or red recording emulsion layers of the triad and the source of exposing radiation. Therefore the photographic element is substantially free of blue absorbing material between the green and/or red emulsion layers and incident exposing radiation. If, in this instance, a yellow filter layer is interposed between the green and/or red recording emulsion layers and incident exposing radiation, it accounts for all of the interposed blue density.

Although only one green or red recording high aspect ratio tabular grain silver bromoiodide emulsion as described above is required, the multicolor photographic element contains at least three separate emulsions for recording blue, green, and red light, respectively. The emulsions other than the required high aspect ratio tabular grain green or red recording emulsion can be of any convenient conventional form. Various conventional emulsions are illustrated by *Research Disclosure,* Item 17643, cited above, Paragraph I, Emulsion preparation and types, here incorporated by reference. In a preferred form of the invention of Kofron et al, cited above, all of the emulsion layers contain silver bromide or bromoiodide grains. In a particularly preferred form at least one green recording emulsion layer and at least one red recording emulsion layer is comprised of a high aspect ratio tabular grain emulsion according to this invention. If more than one emulsion layer is provided to record in the green and/or red portion of the spectrum, it is preferred that at least the faster emulsion layer contain high aspect ratio tabular grain emulsion as described above. It is, of course, recognized that all of the blue, green, and red recording emulsion layers of the photographic element can advantageously be tabular grain emulsions according to this invention, if desired.

The present invention is fully applicable to multicolor photographic elements as described above in which the speed and contrast of the blue, green, and red recording emulsion layers vary widely. The relative blue insensitivity of green or red spectrally sensitized high aspect ratio tabular grain silver bromoiodide emulsion layers according to this invention allow green and/or red recording emulsion layers to be positioned at any location within a multicolor photographic element independently of the remaining emulsion layers and without taking any conventional precautions to prevent their exposure by blue light.

The present invention is particularly useful with multicolor photographic elements intended to replicate colors accurately when exposed in daylight. Photographic elements of this type are charcterized by producing blue, green, and red exposure records of substantially matched contrast and limited speed variation when exposed to a 5500° K. (daylight) source. The term "substantially matched contrast" as employed herein means that the blue, green, and red records differ in contrast by less than 20 (preferably less than 10) precent, based on the contrast of the blue record. The limited speed variation of the blue, green, and red records can be expressed as a speed variation ($\Delta$log E) of less than 0.3 log E, where the speed variation is the larger of the differences between the speed of the green or red record and the speed of the blue record.

Both contrast and log speed measurements necessary for determining these relationships of the photographic elements can be determined by exposing a photographic element at a color temperature of 5500° K. through a spectrally nonselective step wedge, such as a carbon test object, and processing the photographic element, preferably under the processing conditions contemplated in use. By measuring the blue, green, and red densities of the photographic element to transmission of blue light of 435.8 nm in wavelength, green light of 546.1 nm in wavelength, and red light of 643.8 nm in wavelength, as described by American Standard PH2.1-1952, published by American National Standards Institute (ANSI), 1430 Broadway, New York, N.Y. 10018, blue, green, and red characteristic curves can be plotted for the photographic element. If the photographic element has a reflective support rather than a transparent support, reflection densities can be substituted for transmission densities. From the blue, green, and red characteristic curves speed and contrast can be ascertained by procedures well known to those skilled in the art. The specific speed and contrast measurement procedure followed is of little significance, provided each of the blue, green, and red records are identically measured for purposes of comparison. A variety of standard sensitometric measurement procedures for multicolor photographic elements intended for differing photographic applications have been published by ANSI. The following are representative: American Standard PH2.21-1979, PH2.47-1979, and PH2.27-1979.

The multicolor photographic elements of Kofron et al., cited above, capable of replicating accurately colors when exposed in daylight offer significant advantages over conventional photographic elements exhibiting these characteristics. In the photographic elements of Kofron et al the limited blue sensitivity of the green and red spectrally sensitized tabular silver bromoiodide emulsion layers of this invention can be relied upon to separate the blue speed of the blue recording emulsion layer and the blue speed of the minus blue recording emulsion layers. Depending upon the specific application, the use of tabular silver bromoiodide grains in the green and red recording emulsion layers can in and of itself provide a desirably large separation in the blue response of the blue and minus blue recording emulsion layers.

In some applications it may be desirable to increase further blue speed separations of blue and minus blue recording emulsion layers by employing conventional blue speed separation techniques to supplement the blue speed separations obtained by the presence of the high aspect ratio tabular grains. For example, if a photographic element places the fastest green recording emulsion layer nearest the exposing radiation source and the fastest blue recording emulsion layer farthest from the exposing radiation source, the separation of the blue speeds of the blue and green recording emulsion layers, though a full order of magnitude (1.0 log E) different when the emulsions are separately coated and exposed, may be effectively reduced by the layer order arrangement, since the green recording emulsion layer receives all of the blue light during exposure, but the green recording emulsion layer and other overlying layers may absorb or reflect some of the blue light before it reaches the blue recording emulsion layer. In such circumstance employing a higher proportion of iodide in the blue recording emulsion layer can be relied upon to supplement the tabular grains in increasing the blue speed separation of the blue and minus blue recording emulsion layers. When a blue recording emulsion layer is nearer the exposing radiation source than the minus blue recording emulsion layer, a limited density yellow filter material coated between the blue and minus blue recording emulsion layers can be employed to increase blue and minus blue separation. In no instance, however, is it necessary to make use of any of these conventional speed separation techniques to the extent that they in themselves provide an order of magnitude difference in the blue speed separation or an approximation thereof, as has heretofore been required in the art (although this is not precluded if exceptionally large blue and minus blue speed separation is desired for a specific application). Thus, the multicolor photographic elements replicate accurately image colors when exposed under balanced lighting conditions while permitting a much wider choice in element construction than has heretofore been possible.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al. U.S. Pat. No. 2,937,086 and/or in interlayers containing scavengers are provided between adjacent color-forming layer units, as illustrated by Weissberger et al. U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

At least one green or red recording emulsion layer containing tabular silver bromide or bromoiodide grains as described above is located in the multicolor photographic element to receive an increased proportion of blue light during imagewise exposure of the photographic element. The increased proportion of blue light reaching the high aspect ratio tabular grain emulsion layer can result from reduced blue light absorption by an overlying yellow filter layer or, preferably, elimination of overlying yellow filter layers entirely. The increased proportion of blue light reaching the high aspect ratio tabular emulsion layer can result also from repositioning the color-forming layer unit in which it is contained nearer to the source of exposing radiation. For example, gren and red recording color-forming layer units containing green and red recording high aspect ratio tabular emulsions, respectively, can be positioned nearer to the source of exposing radiation than a blue recording color-forming layer unit.

The multicolor photographic elements can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. Alternative layer arrangements can be better appreciated by reference to the following preferred illustrative forms.

| Layer Order Arrangement I |
|---|
| Exposure |
| ↓ |
| B |
| IL |
| TG |
| IL |

-continued

| TR |
|---|

| Layer Order Arrangement II |
|---|
| Exposure |
| ↓ |
| TFB |
| IL |
| TFG |
| IL |
| TFR |
| IL |
| SB |
| IL |
| SG |
| IL |
| SR |

| Layer Order Arrangement III |
|---|
| Exposure |
| ↓ |
| TG |
| IL |
| TR |
| IL |
| B |

| Layer Order Arrangement IV |
|---|
| Exposure |
| ↓ |
| TFG |
| IL |
| TFR |
| IL |
| TSG |
| IL |
| TSR |
| IL |
| B |

| Layer Order Arrangement V |
|---|
| Exposure |
| ↓ |
| TFG |
| IL |
| TFR |
| IL |
| TFB |
| IL |
| TSG |
| IL |
| TSR |
| IL |
| SB |

| Layer Order Arrangement VI |
|---|
| Exposure |
| ↓ |
| TFR |
| IL |
| TB |
| IL |
| TFG |
| IL |
| TFR |
| IL |
| SG |
| IL |
| SR |

| Layer Order Arrangement VII |
|---|
| Exposure |
| ↓ |
| TFR |
| IL |
| TFG |
| IL |
| TB |
| IL |
| TFG |
| IL |
| TSG |
| IL |

-continued

| |
|---|
| TFR |
| IL |
| TSR |

| Layer Order Arrangement VIII |
|---|
| Exposure |
| ↓ |
| TFR |
| IL |
| FB |
| SB |
| IL + YF |
| FG |
| SG |
| IL |
| FR |
| SR |

where

B, G, and R designate blue, green, and red recording color-forming layer units, respectively, of any conventional type;

T appearing before the color-forming layer unit B, G, or R indicates that the emulsion layer or layers contain a high aspect ratio tabular grain silver bromoiodide emulsions, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement;

YF indicates a yellow filter material; and

IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through VIII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Turning first to Layer Order Arrangement I, it can be seen that the photographic element is substantially free of yellow filter material. However, following conventional practice for elements containing yellow filter material, the blue recording color-forming layer unit lies nearest the source of exposing radiation. In a simple form each color-forming layer unit is comprised of a single silver halide emulsion layer. In another form each color-forming layer unit can contain two, three, or more different silver halide emulsion layers. When a triad of emulsion layers, one of highest speed from each of the color-forming layer units, are compared, they are preferably substantially matched in contrast, and the photographic speed of the green and red recording emulsion layers differ from the speed of the blue recording emulsion layer by less than 0.3 log E. When there are two, three, or more different emulsion layers differing in speed in each color-forming layer unit, there are preferably two, three, or more triads of emulsion layers in Layer Order Arrangement I having the stated contrast and speed relationship. The absence of yellow filter material beneath the blue recording color-forming unit increases the photographic speed of this unit.

It is not necessary that the interlayers be substantially free of yellow filter material in Layer Order Arrangement I. Less than conventional amounts of yellow filter material can be located between the blue and green recording color-forming units without departing from the teachings of this invention. Further, the interlayer separating the green and red recording color-forming layer units can contain up to conventional amounts of yellow filter material without departing from the invention. Where conventional amounts of yellow filter material are employed, the red recording color-forming unit is not restricted to the use of tabular silver bromoiodide grains, as described above, but can take any conventional form, subject to the contrast and speed considerations indicated.

To avoid repetition, only features that distinguish Layer Order Arrangements II through VIII from Layer Order Arrangement I are specifically discussed. In Layer Order Arrangement II, rather than incorporate faster and slower blue, red, or green recording emulsion layers in the same color-forming layer unit, two separate blue, green, and red recording color-forming layer units are provided. Only the emulsion layer or layers of the faster color-forming units need contain tabular silver bromoiodide grains, as described above. The slower green and red recording color-forming layer units because of their slower speeds as well as the overlying faster blue recording color-forming layer unit, are adequately protected from blue light exposure without employing a yellow filter material. The use of high aspect ratio tabular grain silver bromoiodide emulsions in the emulsion layer or layers of the slower green and/or red recording color-forming layer units is, of course, not precluded. In placing the faster red recording color-forming layer unit above the slower green recording color-forming layer unit, increased speed can be realized, as taught by Eeles et al. U.S. Pat. No. 4,184,876, Ranz et al. German OLS No. 2,704,797, and Lohman et al. German OLS Nos. 2,622,923, 2,622,924, and 2,704,826.

Layer Order Arrangement III differs from Layer Order Arrangement I in placing the blue recording color-forming layer unit farthest from the exposure source. This then places the green recording color-forming layer unit nearest and the red recording color-forming layer unit nearer the exposure source. This arrangement is highly advantageous in producing sharp, high quality multicolor images. The green recording color-forming layer unit, which makes the most important visual contribution to multicolor imaging, as a result of being located nearest the exposure source is capable of producing a very sharp image, since there are no overlying layers to scatter light. The red recording color-forming layer unit, which makes the next most important visual contribution to the multicolor image, receives light that has passed through only the green recording color-forming layer unit and has therefore not been scattered in a blue recording color-forming layer unit. Though the blue recording color-forming layer unit suffers in comparison to Layer Order Arrangement I, the loss of sharpness does not offset the advantages realized in the green and red recording color-forming layer units, since the blue recording color-forming layer unit makes by far the least significant visual contribution to the multicolor image produced.

Layer Order Arrangement IV expands Layer Order Arrangement III to include separate faster and slower high aspect ratio tabular grain emulsion containing green and red recording color-forming layer units. Layer Order Arrangement V differs from Layer Order Arrangement IV in providing an additional blue recording color-forming layer unit above the slower green, red, and blue recording color-forming layer units. The faster blue recording color-forming layer unit employs high aspect ratio tabular grain silver bromoiodide emulsion, as described above. The faster blue recording color-forming layer unit in this instance acts to absorb blue light and therefore reduces the proportion of blue light reaching the slower green and red recording color-forming layer units. In a variant form, the slower green and red recording color-forming layer units need not employ high aspect ratio tabular grain emulsions.

Layer Order Arrangement VI differs from Layer Order Arrangement IV in locating a tabular grain blue recording color-forming layer unit between the green and red recording color-forming layer units and the source of exposing radiation. As is pointed out above, the tabular grain blue recording color-forming layer unit can be comprised of one or more tabular grain blue recording emulsion layers and, where multiple blue recording emulsion layers are present, they can differ in speed. To compensate for the less favored position the red recording color-forming layer units would otherwise occupy, Layer Order Arrangement VI also differs from Layer Order Arrangement IV in providing a second fast red recording color-forming layer unit, which is positioned between the tabular grain blue recording color-forming layer unit and the source of exposing radiation. Because of the favored location which the second tabular grain fast red recording color-forming layer unit occupies it is faster than the first fast red recording layer unit if the two fast red-recording layer units incorporate identical emulsions. It is, of course, recognized that the first and second fast tabular grain red recording color-forming layer units can, if desired, be formed of the same or different emulsions and that their relative speeds can be adjusted by techniques well known to those skilled in the art. Instead of employing two fast red recording layer units, as shown, the second fast red recording layer unit can, if desired, be replaced with a second fast green recording color-forming layer unit. Layer Order Arrangement VII can be identical to Layer Order Arrangement VI, but differs in providing both a second fast tabular grain red recording color-forming layer unit and a second fast tabular grain green recording color-forming layer unit interposed between the exposing radiation source and the tabular grain blue recording color-forming layer unit.

Layer Order Arrangement VIII illustrates the addition of a high aspect ratio tabular grain red recording color-forming layer unit to a conventional multicolor photographic element. Tabular grain emulsion is coated to lie nearer the exposing radiation source than the blue recording color-forming layer units. Since the tabular grain emulsion is comparitively sensitized to blue light, the blue light striking the tabular grain emulsion does not unacceptably degrade the red record formed by the tabular grain red recording color-forming layer unit. The tabular grain emulsion can be faster than the silver halide emulsion present in the conventional fast red recording color-forming layer unit. The faster speed can be attributable to an intrinsically faster speed, the tabular grain emulsion being positioned to receive red light prior to the fast red recording color-forming layer unit in the conventional portion of the photographic element, or a combination of both. The yellow filter material in the interlayer beneath the blue recording color-forming layer units protects the conventional minus blue (green and red) color-forming layer units from blue exposure. Whereas in a conventional multicolor photographic element the red recording color-forming layer units are often farthest removed from the exposing radiation source and therefore tend to be slower and/or less sharp than the remaining color-forming layer units, in Arrangement VIII the red record receives a boost in both speed and sharpness from the additional tabular grain red recording color-forming layer unit. Instead of an additional tabular grain red recording color-forming layer unit, an additional tabular grain green recording color-forming unit can alternatively be added, or a combination of both tabular grain red and green recording color-forming layer units can be added. Although the conventional fast red recording layer unit is shown positioned between the slow green recording layer unit, it is appreciated that the relationship of these two units can be inverted, as illustrated in Layer Order Arrangement VI, for example.

There are, of course, many other advantageous layer order arrangements possible, Layer Order Arrangements I through VIII being merely illustrative. In each of the various Layer Order Arrangements corresponding green and red recording color-forming layer units can be interchanged—i.e., the faster red and green recording color-forming layer units can be interchanged in position in the various layer order arrangements and additionally or alternatively the slower green and red recording color-forming layer units can be interchanged in position.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

It is the relatively large separation in the blue and minus blue sensitivities of the green and red recording color-forming layer units containing tabular grain silver bromoiodide emulsions that permits reduction or elimination of yellow filter materials and/or the employment of novel layer order arrangements. One technique that can be employed for providing a quantitative measure of the relative response of green and red recording color-forming layer units to blue light in multicolor photographic elements is to expose through a step tablet a sample of a multicolor photographic element according to this invention employing first a neutral exposure source—i.e., light at 5500° K.—and thereafter to process the sample. A second sample is then identically exposed, except for the interposition of a Wratten 98 filter, which transmits only light between 400 and 490 nm, and thereafter identically processed. Using blue, green, and red transmission densities determined according to American Standard PH2.1-1952, as described above, three dye characteristic curves can be plotted for each sample. The difference in blue speed of the blue recording color-forming layer unit(s) and the blue speed of the green or red recording color-forming layer unit(s) can be determined from the relationship:

$$(B_{W98}-G_{W98})-(B_N-G_N) \quad \text{(A)}$$

or $$(B_{W98}-R_{W98})-(B_N-R_N) \quad \text{(B)}$$

where $B_{W98}$ is the blue speed of the blue recording color-forming layer unit(s) exposed through the Wratten 98 filter;

$G_{W98}$ is the blue speed of the green recording color-forming layer unit(s) exposed through the Wratten 98 filter;

$R_{W98}$ is the blue speed of the red recording color-forming layer unit(s) exposed through the Wratten 98 filter;

$B_N$ is the blue speed of the blue recording color-forming layer unit(s) exposed to neutral (5500° K.) light;

$G_N$ is the green speed of the green recording color-forming layer unit(s) exposed to neutral (5500° K.) light; and $R_N$ is the red speed of the red recording color-forming layer unit(s) exposed to neutral (5500° K.) light.

(The above description imputes blue, green, and red densities to the blue, green, and red recording color-forming layer units, respectively, ignoring unwanted spectral absorption by the yellow, magenta, and cyan dyes. Such unwanted spectral absorption is rarely of sufficient magnitude to affect materially the results obtained for the purposes they are here employed.)

The multicolor photographic elements in the absence of any yellow filter material exhibit a blue speed by the blue recording color-forming layer units which is at least 6 times, preferably at least 8 times, and optimally at least 10 times the blue speed of green and/or red recording color-forming layer units containing high aspect ratio tabular grain emulsions, as described above. By way of comparison, an example below demonstrates that a conventional multicolor photographic element lacking yellow filter material exhibits a blue speed difference between the blue recording color-forming layer unit and the green recording color-forming layer unit(s) of less than 4 times (0.55 log E) as compared to nearly 10 times (0.95 log E) for a comparable multicolor photographic element according to the present invention. This comparison illustrates the advantageous reduction in blue speed of green recording color-forming layer units that can be achieved using high aspect ratio tabular grain silver bromoiodide emulsions.

Another measure of the large separation in the blue and minus blue sensitivities of multicolor photographic elements is to compare the green speed of a green recording color-forming layer unit or the red speed of a red recording color-forming layer unit to its blue speed. The same exposure and processing techniques described above are employed, except that the neutral light exposure is changed to a minus blue exposure by interposing a Wratten 9 filter, which transmits only light beyond 490 nm. The quantitative difference being determined is $$G_{W9}-G_{W98} \quad \text{(C)}$$

or $$R_{W9}-R_{W98} \quad \text{(D)}$$

where $G_{W98}$ and $R_{W98}$ are defined above;

$G_{W9}$ is the green speed of the green recording color-forming layer unit(s) exposed through the Wratten 9 filter; and $R_{W9}$ is the red speed of the red recording color-forming layer unit(s) exposed through the Wratten 9 filter. (Again unwanted spectral absorption by the dyes is rarely material and is ignored.)

Red and green recording color-forming layer units containing tabular grain silver bromoiodide emulsions, as described above, exhibit a difference between their speed in the blue region of the spectrum and their speed in the portion of the spectrum to which they are spectrally sensitized (i.e., a difference in their blue and minus blue speeds) of at least 10 times (1.0 log E), preferably at least 20 times (1.3 log E). In an example below the difference is greater than 20 times (1.35 log E) while for the comparable conventional multicolor photographic element lacking yellow filter material this difference is less than 10 times (0.95 log E).

In comparing the quantitative relationships A to B and C to D for a single layer order arrangement, the results will not be identical, even if the green and red recording color-forming layer units are identical (except for their wavelengths of spectral sensitization). The reason is that in most instances the red recording color-forming layer unit(s) will be receiving light that has already passed through the corresponding green recording color-forming layer unit(s). However, if a second layer order arrangement is prepared which is identical to the first, except that the corresponding green and red recording color-forming layer units have been interchanged in position, then the red recording color-forming layer unit(s) of the second layer order arrangement should exhibit substantially identical values for relationships B and D that the green recording color-forming layer units of the first layer order arrangement exhibit for relationships A and C, respectively. Stated more succinctly, the mere choice of green spectral sensitization as opposed to red spectral sensitization does not significantly influence the values obtained by the above quantitative comparisons. Therefore, it is common practice not to differentiate green and red speeds in comparison to blue speed, but to refer to green and red speeds generically as minus blue speeds.

Figure 2:
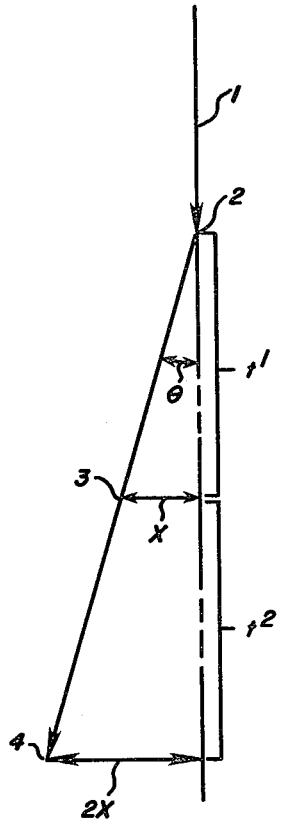
FIGS. 2 and 4 are schematic diagrams related to scattering.

As described by Kofron et al., cited above, the high aspect ratio tabular grain silver bromoiodide emulsions of the present invention are advantageous because of their reduced high angle light scattering as compared to nontabular and lower aspect ratio tabular grain emulsions. As discussed above with reference to FIG. 2, the art has long recognized that image sharpness decreases with increasing thickness of one or more silver halide emulsion layers. However, from FIG. 2 it is also apparent that the lateral component of light scattering (x and 2x) increases directly with the angle $\theta$. To the extent that the angle $\theta$ remains small, the lateral displacement of scattered light remains small and image sharpness remains high.

Figure 4:
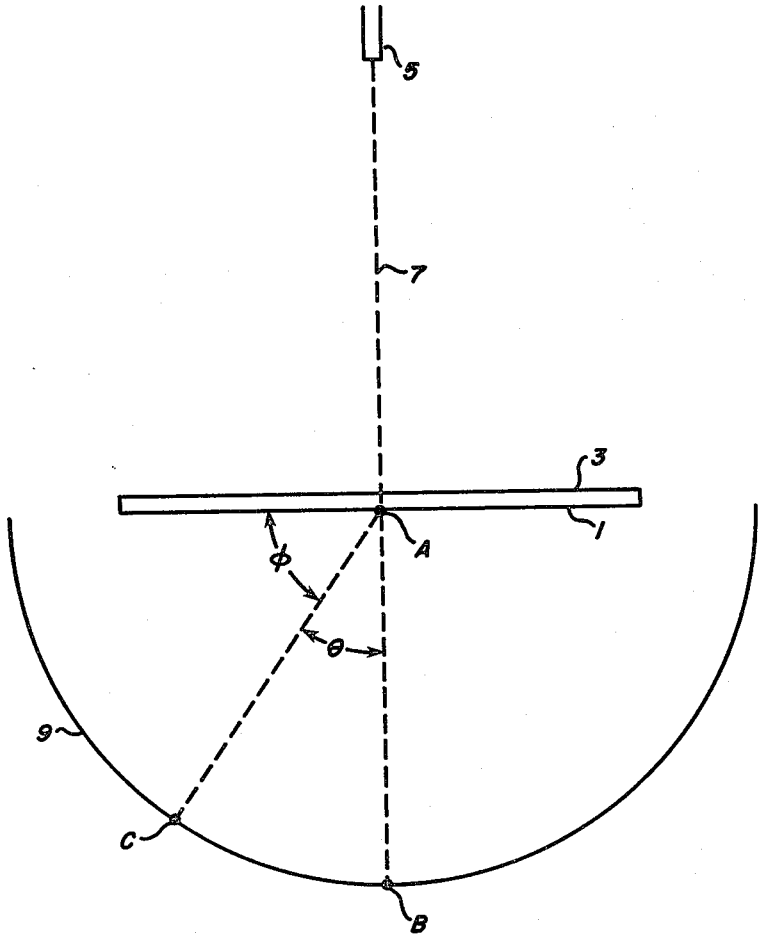

Advantageous sharpness characteristics obtainable with high aspect ratio tabular grain emulsions of the present invention are attributable to the reduction of high angle scattering. This can be quantitatively demonstrated. Referring to FIG. 4, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 4 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181–191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 4 the angle $\phi$ is shown as the complement of the angle $\phi$. The angle of scattering is herein discussed by reference to the angle $\phi$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific prepared form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

In addition to producing the sharpness advantages indicated above at the average diameters indicated it is also noted that the high aspect ratio rabular grain emulsions avoid a number of disadvantages encountered by conventional emulsions in these large average grain diameters. First, it is difficult to prepare conventional, nontabular emulsions with average grain diameters above 2 microns. Second, referring to Farnell, cited above, it is noted that Farnell pointed to reduced speed performance at average grain diameters above 0.8 micron. Further, in employing conventional emulsions of high average grain diameters a much larger volume of silver is present in each grain as compared to tabular grains of comparable diameter. Thus, unless conventional emulsions are coated at higher silver coverages, which, of course, is a very real practical disadvantage, the graininess produced by the conventional large diameter grain-containing emulsions is higher than with the emulsions of this invention having the same average grain diameters. Still further, if large diameter grain-containing conventional emulsions are employed, with or without increased silver coverages, then thicker coatings are required to accommodate the corresponding large thicknesses of the larger diameter grains. However, tabular grain thicknesses can remain very low even while diameters are above the levels indicated to obtain sharpness advantages. Finally, the sharpness advantages produced by tabular grains are in part a distinct function of the shape of the grains as distinguished from merely their average diameters and therefore capable of rendering sharpness advantages over conventional nontabular grains.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages in an emulsion layer that underlies a high aspect ratio tabular grain silver bromoiodide emulsion layer according to the present invention it is preferred that the the tabular grain emulsion layer be positioned to receive light that is free of significant scattering (preferably positioned to receive substantially specularly transmitted light). Stated another way, improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness. In a specifically preferred form each emulsion layer which lies nearer the exposing radiation source than another image recording emulsion layer is a high aspect ratio tabular grain emulsion layer. Layer Order Arrangements II, III, IV, V, VI, and VII described above, are illustrative of multicolor photographic element layer arrangements which are capable of imparting significant increases in sharpness to underlying emulsion layers.

Although the advantageous contribution of high aspect ratio tabular grain silver bromoiodide emulsions to image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing high aspect ratio tabular grain emulsions according to this invention in layers nearest the exposing radiation source the sharpness of underlying emulsion layers will be improved.

EXAMPLES

The invention can be better appreciated by reference to the following specific examples:

In each of the examples the contents of the reaction vessel were stirred vigorously throughout silver and halide salt introductions; the term "percent" means percent by weight, unless otherwise indicated; and the term "M" stands for molar concentration, unless otherwise indicated. All solutions, unless otherwise indicated are aqueous solutions.

EXAMPLE 1

A 1.7 μm silver bromoiodide (overall average iodide content 8.9 mole percent) tabular grain emulsion was prepared by a double-jet precipitation technique utilizing accelerated flow.

To a 4.5 liter aqueous gelatin solution (Solution A, 0.17 molar potassium bromide, 1.5 percent by weight bone gelatin) at 55° C. and pBr 0.77 were added by double-jet addition with stirring at the same constant flow rate over a two minute period (consuming 1.36 percent of the total silver), an aqueous potassium bromide solution (Solution C, 2.15 molar) and an aqueous silver nitrate solution (Solution F, 2.0 molar). Simultaneously, at the same flow rate, an aqueous potassium bromide solution (Solution B, 2.15 molar) was run into Solution C. Solutions B and C were stopped after two minutes; the pBr was adjusted to 1.14 with Solution F at 55° C. An aqueous solution (Solution D) of potassium bromide (1.87 molar) and potassium iodide (0.24 molar) was run simultaneously into Solution C utilizing accelerated flow rate (3.2X from start to finish) over 21.4 minutes. At the same time, Solution C was added to the reaction vessel with Solution F by double-jet addition utilizing the same accelerated flow rate profile (consuming 83.7 percent of the total silver used) and maintaining pBr 1.14. Solutions D, C, and F were halted.

Aqueous solutions of potassium iodide (Solution E, 0.34 molar) and silver nitrate (Solution G, 2.0 molar) were added then by double-jet addition at the same flow rate until pBr 2.83 at 55° C. was attained (15.0 percent of total silver used). 5.88 Moles of silver were used to prepare this emulsion.

The emulsion was cooled to 35° C., an aqueous phthalated gelatin solution (11.5 percent, 1.2 liters) was added and the emulsion was coagulation washed twice.

FIG. 3 represents a 10,000 times magnification carbon replica electron micrograph of the emulsion prepared by this example. The average grain diameter is 1.7 microns and the average grain thickness is 0.11 micron. The tabular grains have an average aspect ratio of 16:1 and account for >80 percent of the total projected area of the silver bromoiodide grains.

Figure 5:
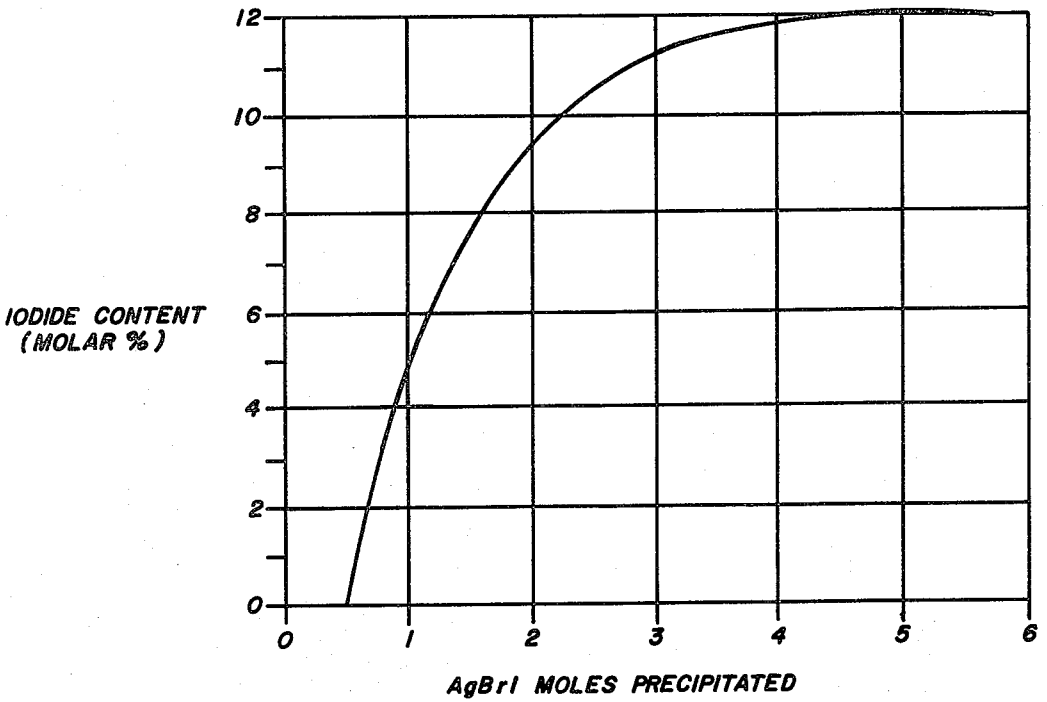
FIG. 5 is a plot of iodide content versus moles of silver bromoiodide precipitated.

In FIG. 5 a plot is presented of the total moles of silver bromoiodide precipitated versus the mole percent iodide. Initially the iodide constituted a very small percent of the total halide. At the end of precipitation iodide constituted 12 mole percent of the total halide and thus increased from a very low level in a central region to a much higher level in a laterally displaced surrounding annular region.

EXAMPLE 2

An approximately 1.7 μm silver bromoiodide (overall average iodide content 7 mole percent) tabular grain emulsion was prepared by a double-jet precipitation technique utilizing accelerated flow.

To a 4.5 liter aqueous bone gelatin solution (Solution A, 0.17 molar potassium bromide, 1.5 percent by weight gelatin) at 55° C. and pBr 0.77 were added by double-jet addition with stirring at the same flow over a two minute period (consuming 1.58 percent of the total silver), an aqueous potassium bromide solution (Solution B, 2.33 molar) and an aqueous silver nitrate solution (Solution D, 2.0 molar). At two minutes, Solution B was halted and Solution D was added at a constant flow rate for 10.7 minutes (consuming 8.43 percent of the total silver) until pBr 1.14 at 55° C. was attained.

Solution C (1.94 molar KBr and 0.18 molar KI) and Solution D were added to the reaction vessel by double-jet addition utilizing accelerated flow (4.3X from start to finish) over a 22 minute period (consuming 88.4 percent of total silver used) at pBr 1.14. Solution E (2.0 molar $AgNO_3$) was added next at constant flow rate until pBr 2.83 was attained (1.61 percent of total silver used). 5.08 Moles of silver were used to prepared this emulsion.

The emulsion was cooled to 35° C., combined with 0.5 liter of an aqueous phthalated gelatin solution (25 percent by weight gelatin) and coagulation washed twice.

Figure 6:
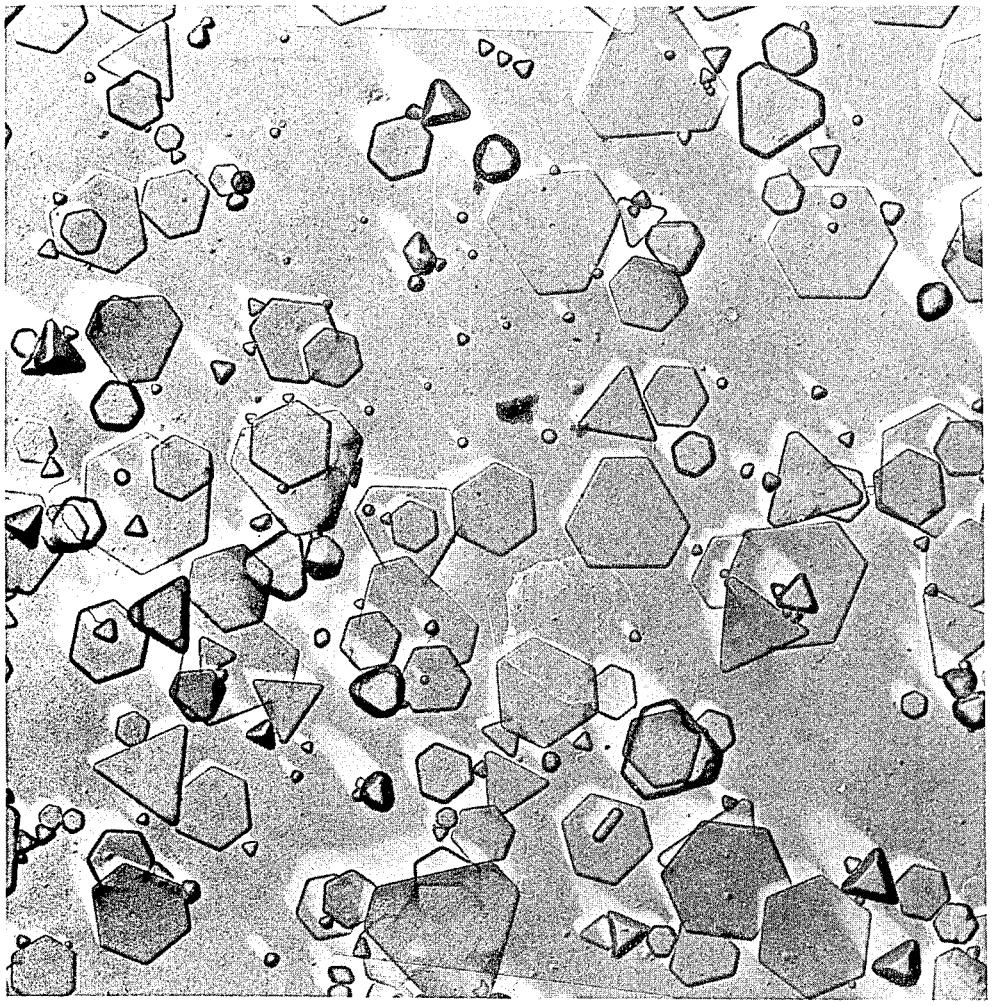
Figure 7:
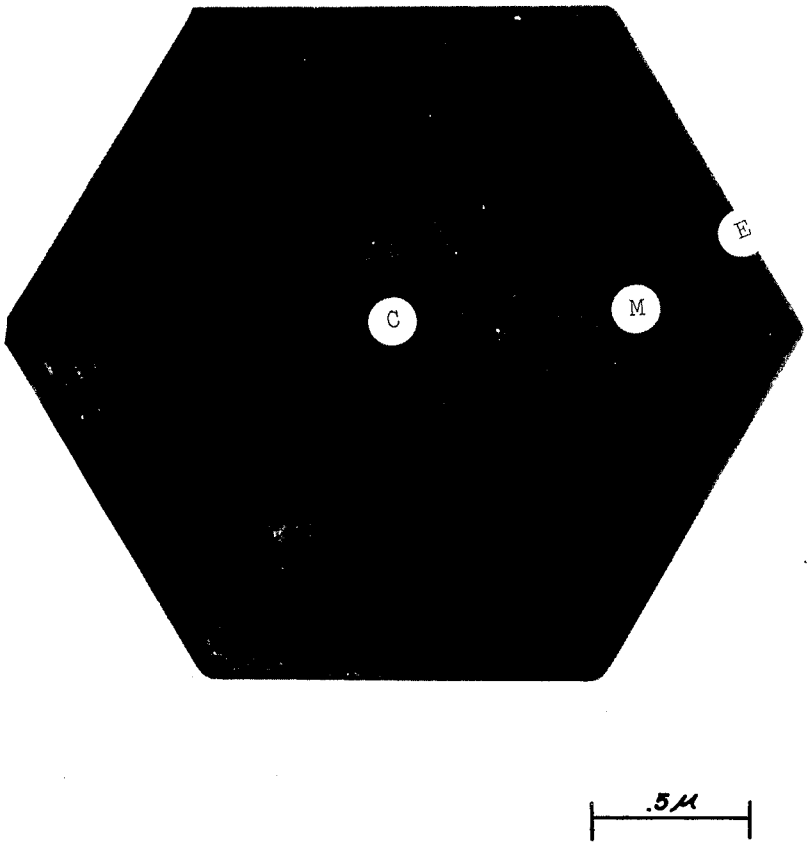
FIGS. 7 through 11 are photomicrographs of individual high aspect ratio tabular grains according to this invention.
Figure 8:
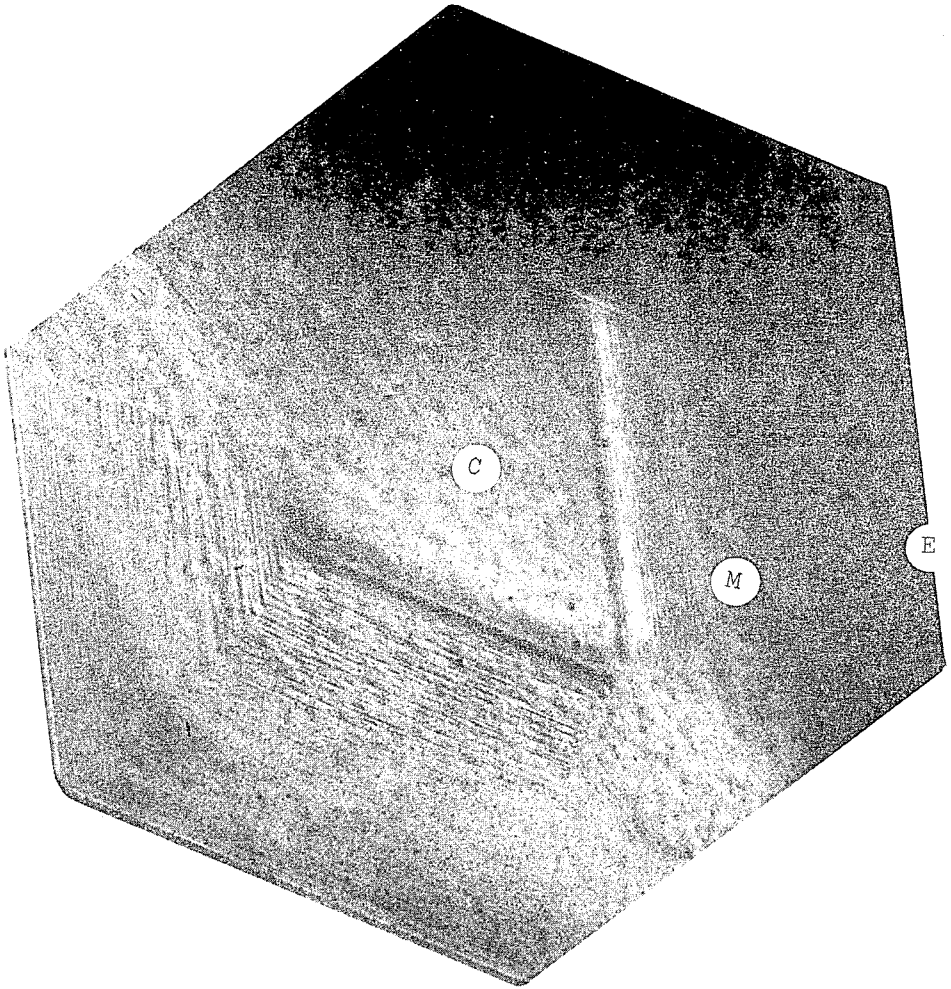
Figure 9:
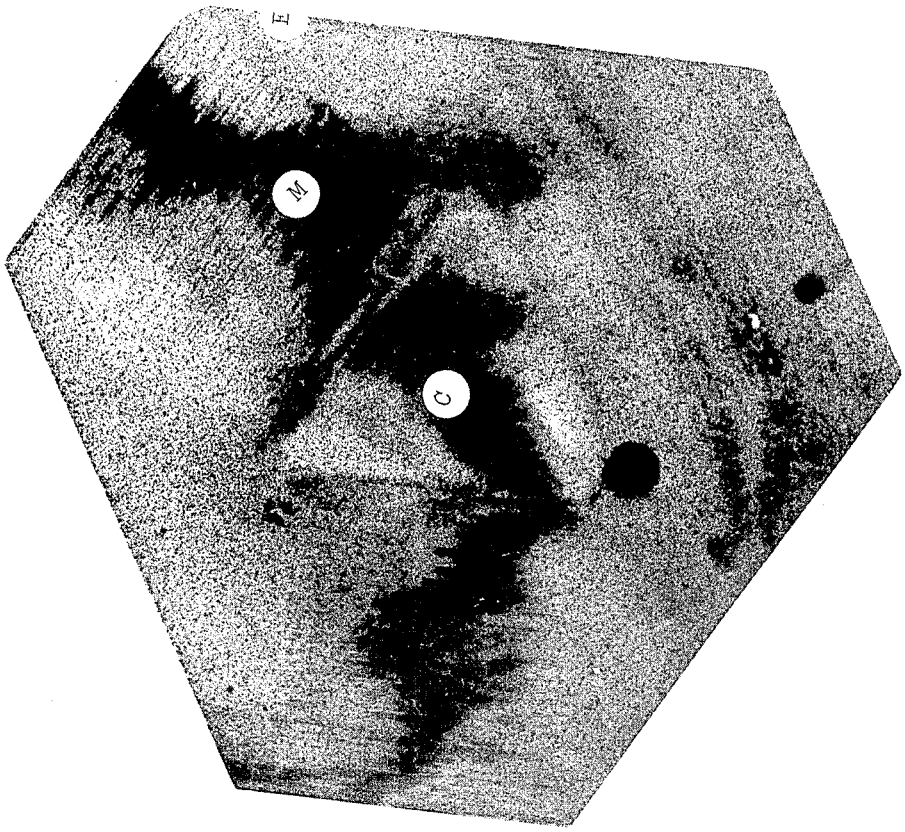
Figure 10:
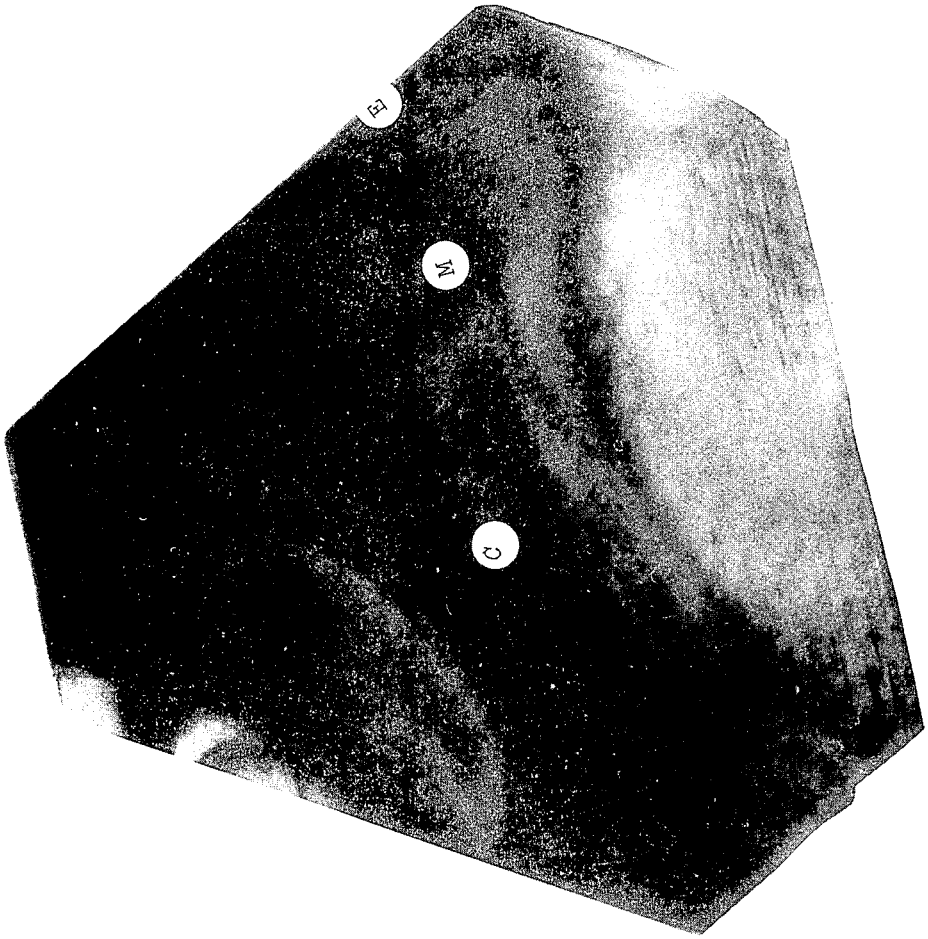
Figure 11:
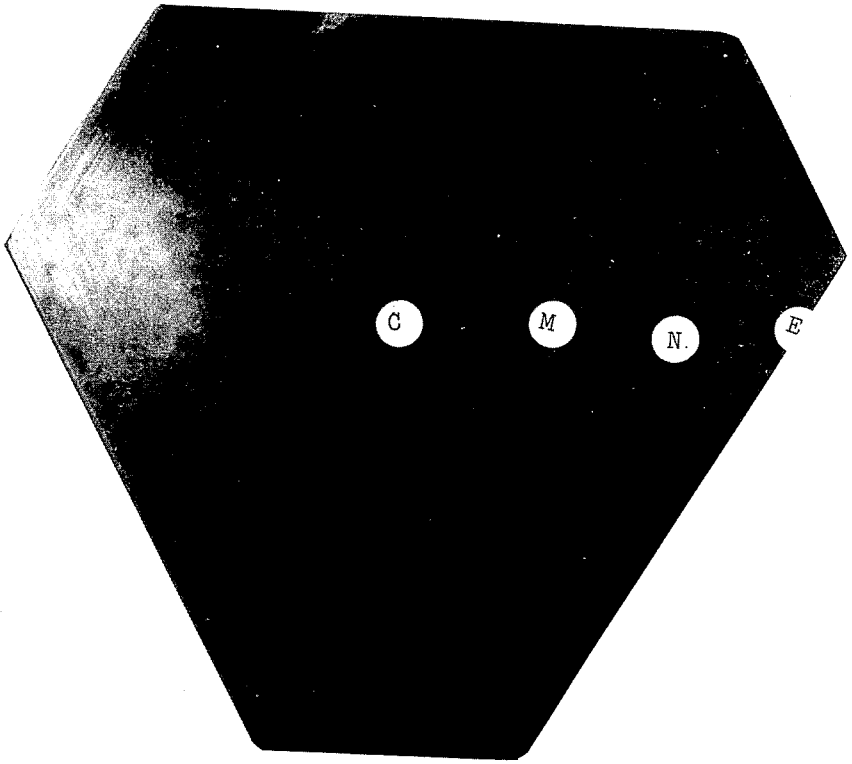

FIG. 6 represents a 10,000 times magnification carbon replica electron micrograph of the emulsion prepared by this example. The average grain diameter is 1.7 microns and the average grain thickness is approximately 0.06 micron. The tabular grains have an average aspect ratio of from about 28:1 and account for greater than 70 percent of the total projected area of the silver bromoiodide grains.

EXAMPLE 3

A high aspect ratio tabular grain silver bromoiodide emulsion with a substantially uniform iodide profile throughout the grains according to the teachings of Wilgus and Haefner, cited above, designated Control 1, was prepared. A preparation procedure similar to that of Example 2 was employed, but iodide was present in the reaction vessel from the start of precipitation, and iodide was substantially uniformly distributed through the silver bromoiodide grains produced at an average concentration of 9.0 mole percent. The emulsion exhibited an average grain diameter of 2.8 microns and the average thickness was 0.12 micron. The tabular grains had an average aspect ratio of about 23:1 and accounted for >80 percent of the total projected area of the silver bromoiodide grains.

Control 1 was chemically sensitized for 15 minutes at 65° C. with 100 mg/Ag mole sodium thiocyanate, 7 mg/Ag mole sodium thiosulfate pentahydrate, 3 mg/Ag mole potassium tetrachloroaurate, and 30.4 mg/Ag mole 3-methylbenzothiazolium iodide, and spectrally sensitized with 695 mg/Ag mole anhydro-5-chloro-9-ethyl-5'-phenyl-3'-(3-sulfobutyl)-3-(sulfopropyl) oxacarbocyanine hydroxide, sodium salt, hereinafter designated Sensitizer A, and with 670 mg/Ag mole anhydro-11-ethyl-1,1'-bis(3-sulfopropyl)naphth[1,2-d] oxazolocarbocyanine hydroxide, sodium salt, hereinafter designated Sensitizer B.

A second high aspect ratio tabular grain silver bromoiodide emulsion with a substantially uniform iodide profile throughout the grains according to the teachings of Wilgus and Haefner, cited above, designated Control 2, was prepared. The preparation procedure was essentially similar to that employed for Control 1, except that the silver bromoiodide grains contained a substantially uniform iodide concentration of 12.0 mole percent. The emulsion exhibited an average grain diameter of 3.2 microns and the average thickness was 0.12 micron. The tabular grains had an average aspect ratio of 27:1 and account for greater than 80 percent of the total projected area of the silver bromoiodide grains.

Control 2 was chemically and spectrally sensitized. Chemical and spectral sensitization was similar to Control 1, except that the level of sodium thiosulfate pentahydrate was increased to 18 mg/Ag mole, the level of potassium tetrachloroaurate was increased to 10 mg/Ag mole, and the level of 3-methylbenzothiazolium iodide was decreased to 15.2 mg/Ag mole. Also, the emulsion was finished for 5 minutes rather than 15 minutes at 65° C. Also, 870 mg/mole of Sensitizer A and 838 mg/mole Sensitizer B were employed.

An emulsion according to this invention, hereinafter designated Example 3, was prepared similarly as described in Example 1. The high aspect ratio tabular silver bromoiodide grains produced exhibited a surface iodide concentration of 12 mole percent and an average iodide concentration of 8.9 mole percent, reflecting the much lower iodide concentration in a central region as compared to laterally displaced surrounding annular region. The emulsion exhibited an average grain diameter of 2.1 microns and average thickness of 0.12 micron. The tabular grains had an average aspect ratio of about 17:1 and accounted for >80 percent of the total grain projected area. The emulsion was optimally chemically and spectrally sensitized. Chemical and spectral sensitization was similar to Control 1, except that Sensitizer A was employed in a concentration of 870 mg/Ag mole and Sensitizer B was added at 838 mg/Ag mole. Also the emulsion was chemically finished for 5 minutes at 65° C. If Controls 1 and 2 had been chemically and spectrally sensitized identically as Emulsion 3, their sensitization would have been less than optimum for the chemical and spectral sensitizers employed, and their photographic properties (e.g., speed-granularity relationship) would have been degraded.

By comparing the Example 3 emulsion with Control 1 and Control 2 it can be seen that Control 1 had about the same percent iodide as the Example 3 emulsion, but with the iodide being substantially uniformly distributed within the grain. Control 2 had about the same surface iodide concentration as the Example 3 emulsion, but with the iodide level being substantially uniformly distributed throughout the grain. Thus, a direct comparison of uniform iodide distribution grains at both the average and surface iodide levels of the grains of the invention is afforded. (The differences in the details of chemical and spectral sensitization were insufficient to account for significant differences in photographic performance.)

Example 3, Control 1, and Control 2 emulsions were separately coated in a single-layer, single color magenta format on cellulose triacetate support at 1.07 g/m$^2$ silver and 2.5 g/m$^2$ gelatin. Each element also contained 0.75 g/m$^2$ magenta coupler A, 1-(6-chloro-2,4-dimethylphenyl)-3-[α-(m-pentadecylphenoxy)butyramido]-5-pyrazolone, 3.2 g/Ag mole of potassium 5-sec-octadecylhydroquinone-2-sulfonate, and 3.6 g/Ag mole of 4-hydroxy-6-methyl-1,3,3a,7-tetraazaindene. The coatings contained a 0.90 g/m$^2$ gelatin overcoat and were hardened with 0.46 percent by weight of bis(vinylsulfonyl methyl)ether based on total gel content. Exposure was for 1/100 second through a 0 to 4.0 step tablet (plus Wratten No. 9 filter and 1.75 neutral density filter) to a 6000 W 3000° K. tungsten light source. Processing was conducted at 37.7° C. in a color developer of the type described in the *British Journal of Photography Annual*, 1979, pp. 204–206, with development times of 3¼ and 4¼ minutes being used to obtain substantially matched contrasts for the differing samples to facilitate granularity comparisons.

The relative green sensitivity and the rms granularity of each of the photographic elements processed was determined. (The rms granularity is measured by the method described by H. C. Schmidt, Jr. and J. H. Altman, *Applied Optics*, 9, pp 871–874, April 1970.) The rms granularity was determined at a density of 0.60 above fog. The emulsions appeared to have essentially similar granularity, but the emulsion according to the invention, Example 3, exhibited a superior speed. Thus, the speed-granularity position of the invention was superior to that of the controls. (The speed-granularity relationships of the controls were essentially the same.) Specifically, the speed-granularity position of Example 3 was estimated to be +15 to +20 log speed units faster than Control 1 or Control 2. Log speed is defined as 100 (1-log E), log E being measured at a density of 0.6 above fog. Although the Example 3 emulsion exhibited a higher speed than the control emulsions at a comparable granularity, it can be appreciated from the discussion of speed and granularity that the emulsions of this invention can therefore exhibit a lower granularity at a comparable speed or some combination of improved speed and improved granularity. In other words, not just speed, but the speed-granularity relationship of the emulsions of the present invention as well are improved.

EXAMPLES 4 AND 5

Two high aspect ratio tabular grain silver bromoiodide emulsions were prepared according to the present invention. The emulsion hereinafter referred to as Example 4 was precipitated so that the concentration of iodide was abruptly increased as the tabular grains were being grown. A second emulsion hereinafter referred to as Example 5 was precipitated under conditions in which the iodide concentration was increased in a graded manner during precipitation.

The Example 4 emulsion were prepared as follows:

To a 4.5 liter aqueous bone gelatin solution (Solution A, 0.17 molar potassium bromide, 1.5 percent by weight gelatin) at 55° C. and pBr 0.77 were added by double-jet addition with stirring at the same flow rate over a two minute period (consuming 0.95 percent of the total silver), an aqueous potassium bromide solution (Solution B-1, 3.30 molar), and an aqueous silver nitrate solution (Solution C-1, 3.00 molar).

After two minutes, Solution B-1 was halted. Solution C-1 was continued at a constant flow rate until pBr 1.14 at 55° C. was attained. Then aqueous solutions of potassium bromide (Solution B-2, 3.00 molar), potassium iodide (Solution B-3, 0.37 molar) and silver nitrate (Solution C-1) were added at pBr 1.14 by triple-jet addition at an accelerated flow rate (10X from start to finish) until Solution C-1 was exhausted (approximately 34 minutes; 89.5 percent of total silver used).

Aqueous solutions of silver nitrate (Solution C-2, 3.00 molar) and Solution B-3 were added then by double-jet addition at constant flow rate until pBr 2.83 at 55° C. was attained (9.53 percent of total silver consumed). Approximately 6.3 moles of silver were used to prepare this emulsion.

The emulsion was cooled to 35° C., combined with 0.90 liter of aqueous phthalated gelatin solution (18.1 percent by weight gelatin) and coagulation washed twice. The emulsion had an average tabular grain diameter of 2.4 microns, an average tabular grain thickness of 0.09 micron, and an average aspect ratio of 26.6:1, with the tabular grains accounting for greater than 80 percent of the total projected area of silver bromoiodide grains.

The Example 5 emulsion was prepared as follows:

To a 6.0 liter aqueous bone gelatin solution (Solution A, 0.17 molar potassium bromide, 1.5 percent by weight gelatin) at 55° C. and pBr 0.77 were added by double-jet addition over a two minute period (consuming 0.96 percent of the total silver), an aqueous solution of potassium bromide (Solution B, 2.14 molar), and an aqueous solution of silver nitrate (Solution F, 2.01 molar). Simultaneously, an aqueous solution of potassium bromide (Solution C, 2.35 molar) was run into Solution B at the same flow rate.

After the initial two minutes, Solutions B and C were halted. Solution F was continued (consuming 7.71 percent of the total silver) until pBr 1.14 at 55° C. was attained (approximately 16 minutes). Solutions B and F were added by double-jet addition then to the reaction vessel at an accelerated flow rate (4.43X from start to finish) at pBr 1.14 and 55° C. until Solution F was exhausted (80.6 percent of total silver used). Simultaneously an aqueous solution (Solution D) of potassium bromide (1.89 molar) and potassium iodide (0.25 molar) was added at the same accelerated flow rate to Solution B.

When Solution F was exhausted, aqueous solutions of potassium iodide (Solution E, 0.24 molar) and silver nitrate (Solution G, 2.00 molar) were added simultaneously (10.75 percent of total silver used) at constant flow rate to the reaction vessel until pBr 2.83 at 55° C. was attained (approximately 11 minutes).

The emulsion was cooled to 35° C., combined with 1.5 liters of an aqueous phthalated gelatin solution (13 percent by weight gelatin) and coagulation washed twice. A total of 8.34 moles of silver were used to prepare this emulsion. This emulsion had an average tubular grain diameter of 2.1 microns, an average tabular grain thickness of 0.12 micron, and an average aspect ratio of 17:1, with the tabular grains accounting for greater than 80 percent of the total projected area of the silver bromoiodide grains.

The iodide distribution in the resulting Example 4 and 5 emulsions was examined by electron microscopy. The technique for examination was that described by J. I. Goldstein and D. B. Williams, "X-ray Analysis in the TEM/STEM", *Scanning Electron Microscopy*/1977, Vol. 1, IIT Research Institute, March 1977, p. 651. Grains to be examined were placed on a microscope grid and cooled to the temperature of liquid nitrogen. A focused beam of electrons was impinged on a 0.2 micron spot on each grain to be examined for composition. The samples were examined at 80 kilovolts acclerating voltage. The electron beam stimulated the emission of X-rays. By measuring the intensity and energy of the X-rays emitted it was possible to determine the ratio of iodide to bromide in the grain at the spot of electron impingement. To provide controls for the determination of iodide concentration, tabular grains consisting essentially of silver bromide and nontabular grains consisting essentially of silver iodide were also examined.

The results are summarized below in Table I.

TABLE I

| | | Mole percent Iodide | | | |
|---|---|---|---|---|---|
| Example | FIG. | Spot C | Spot M | Spot N | Spot E |
| 4 | 7 | 5.1 | 11.5 | | 11.7 |
| 4 | 8 | 3.7 | 10.8 | | 11.0 |
| 4 | 9 | 4.3 | 11.2 | | 11.1 |
| 5 | 10 | 2.4 | 7.6 | | 10.3 |
| 5 | 11 | 2.9 | 4.4 | 8.3 | 10.1 |

In looking at Table I it can be seen that Example 4 emulsion in which the concentration of iodide was abruptly increased during the run exhibited a very similar iodide concentration both in a mid-grain region (Spot M) and at an edge region of the grain (Spot E). The iodide concentration at the mid-grain and edge locations were higher than in the central region (Spot C). On the other hand, for the Example 5 emulsion in which the percentage of iodide present during precipitation was gradually increased, a progressive increase in iodide content from the central region (Spot C) to the edge region (Spot E) is noted. While this is shown with a single mid-grain measurement (Spot M), examining a second mid-grain region (Spot N) further highlights the gradual increase in iodide present in progressing from the center to the edge of the grains.

EXAMPLES 6 THROUGH 9 TO ILLUSTRATE SPEED/GRANULARITY RELATIONSHIPS

A series of silver bromoiodide emulsions of varying aspect ratio were prepared as described below. The physical descriptions of the emulsions are given in Table II below.

EXAMPLE 6

To 5.5 liters of a 1.5 percent gelatin, 0.17 M potassium bromide solution at 80° C., were added with stirring and by double-jet, 2.2 M potassium bromide and 2.0 M silver nitrate solutions over a two minute period, while maintaining a pBr of 0.8 (consuming 0.56 percent of the total silver used). The bromide solution was stopped and the silver solution continued for 3 minutes (consuming 5.52 percent of the total silver used). The bromide and silver solutions were then run concurrently maintaining pBr 1.0 in an accelerated flow (2.2X from start to finish—i.e., 2.2 times faster at the end than at the start) over 13 minutes (consuming 34.8 percent of the total silver used). The bromide solution was stopped and the silver solution run for 1.7 minutes (consuming 6.44 percent of the total silver used). A 1.8 M potassium bromide solution which was also 0.24 M in potassium iodide was added with the silver solution for 15.5 minutes by double-jet in an accelerated flow (1.6X from start to finish), consuming 45.9 percent of the total silver used, maintaining a pBr of 1.6. Both solutions were stopped and a 5 minute digest using 1.5 g sodium thiocyanate/Ag mole was carried out. A 0.18 M potassium iodide solution and the silver solution were double-jetted at equal flow rates until a pBr of 2.9 was reached (consuming 6.8 percent of the total silver used). A total of approximately 11 moles of silver was used. The emulsion was cooled to 30° C., and washed by the coagulation method of Yutzy and Russell U.S. Pat. No. 2,614,929. To the emulsion at 40° C. were added 464 mg/Ag mole of the green spectral sensitizer, anhydro-5-chloro-9-ethyl-5'-phenyl-3'-(3-sulfobutyl)-3-(3-sulfopropyl)-oxacarbocyanine hydroxide, sodium salt, and the pAg adjusted to 8.4 after a 20 minute hold. To the emulsion was added 3.5 mg/Ag mole of sodium thiosulfate pentahydrate and 1.5 mg/Ag mole of potassium tetrachloroaurate. The pAg was adjusted to 8.1 and the emulsion was then heated for 5 minutes at 65° C.

EXAMPLE 7

To 5.5 liters of a 1.5 percent gelatin, 0.17 M potassium bromide solution at 80° C., pH 5.9, were added with stirring and by double-jet 2.1 M potassium bromide and 2.0 M silver nitrate solutions over a two minute period while maintaining a pBr of 0.8 (consuming 0.53 percent of the total silver used). The bromide solution was stopped and the silver solution continued for 4.6 minutes at a rate consuming 8.6 percent of the total silver used. The bromide and silver solutions were then run concurrently for 13.3 minutes, maintaining a pBr of 1.2 in an accelerated flow (2.5X from start to finish), consuming 43.6 percent of the total silver used. The bromide solution was stopped and the silver solution run for one minute (consuming 4.7 percent of the total silver used).

A 2.0 M potassium bromide solution which was also 0.30 M in potassium iodide was double-jetted with the silver solution for 13.3 minutes in an accelerated flow (1.5X from start to finish), maintaining a pBr of 1.7, and consuming 35.9 percent of the total silver used. To the emulsion was added 1.5 g/Ag mole of sodium thiocyanate and the emulsion was held for 25 minutes. A 0.35 M potassium iodide solution and the silver solution were double-jetted at a constant equal flow rate for approximately 5 minutes until a pBr of 3.0 was reached (consuming approximately 6.6 percent of the total silver used). The total silver consumed was approximately 11 moles. A solution of 350 g of phthalated gelatin in 1.2 liters of water was then added, the emulsion cooled to 30° C., and washed by the coagulation method of Example 6. The emulsion was then optimally spectrally and chemically sensitized in a manner similar to that described for Example 6. Phthalated gelatin is described in Yutzy et al. U.S. Pat. Nos. 2,614,928 and '929.

EXAMPLE 8

To 30.0 liters of a 0.8 percent gelatin solution containing 0.10 M potassium bromide at 75° C. were added with stirring and by double-jet, 1.2 M potassium bromide and 1.2 M silver nitrate solution over a 5 minute period while maintaining a pBr of 1.0 (consuming 2.1 percent of the total silver used). A 5.0 liter solution containing 17.6 percent phthalated gelatin was then added, and the emulsio held for one minute. The silver nitrate solution was then run into the emulsion until a pBr of 1.35 was attained, consuming 5.24 percent of the total silver used. A 1.06 M potassium bromide solution which was also 0.14 M in potassium iodide was double-jetted with the silver solution in an accelerated flow (2X from start to finish) consuming 92.7 percent of the total silver used, and maintaining pBr 1.35. A total of approximately 20 moles of silver was used. The emulsion was cooled to 35° C., coagulation washed and optimally spectrally and chemically sensitized in a manner similar to that described for Example 6.

EXAMPLE 9

To 4.5 liters of a 1.5 percent gelatin, 0.17 M potassium bromide solution at 55° C., pH 5.6, were added with stirring and by double-jet, 1.8 M potassium bromide and 2.0 M silver nitrate solutions at a constant equal rate over a period of one minute at a pBr of 0.8 (consuming 0.7 percent of the total silver used). The bromide, silver, and a 0.26 M potassium iodide solution were then run concurrently at an equal constant rate over 7 minutes, maintaining pBr 0.8, and consuming 4.8 percent of the total silver used. The triple run was then continued over an additional period of 37 minutes maintaining pBr 0.8 in an accelerated flow (4X from start to finish), consuming 94.5 percent of the total silver used. A total of approximately 5 silver moles was used. The emulsion was cooled to 35° C., 1.0 liter of water containing 200 g of phthalated gelatin was added, and the emulsion was coagulation washed. The emulsion was then optimally spectrally and chemically sensitized in a manner similar to that described in Example 6.

CONTROL 3

This emulsion was precipitated in the manner described in U.S. Pat. No. 4,184,877 of Maternaghan.

To a 5 percent solution of gelatin in 17.5 liters of water at 65° C. were added with stirring and by double-jet 4.7 M ammonium iodide and 4.7 M silver nitrate solutions at a constant equal flow rate over a 3 minute period while maintaining a pI of 2.1 (consuming approximately 22 percent of the silver used in the seed grain preparation). The flow of both solutions was then adjusted to a rate consuming approximately 78 percent of the total silver used in the seed grain preparation over a period of 15 minutes. The run of the ammonium iodide solution was then stopped, and the addition of the silver nitrate solution continued to a pI of 5.0. A total of approximately 56 moles of silver was used in the preparation of the seed grains emulsion. The emulsion was cooled to 30° C. and used as a seed grain emulsion for further precipitation as described hereinafter. The average diameter of the seed grains was 0.24 micron.

A 15.0 liter 5 percent gelatin solution containing 4.1 moles of the 0.24 μm AgI emulsion (as prepared above) was heated to 65° C. A 4.7 M ammonium bromide solution and a 4.7 M silver nitrate solution were added by double-jet at an equal constant flow rate over a period of 7.1 minutes while maintaining a pBr of 4.7 (consuming 40.2 percent of the total silver used in the precipitation on the seed grains). Addition of the ammonium bromide solution alone was then continued until a pBr of approximately 0.9 was attained at which time it was stopped. A 2.7 liter solution of 11.7 M ammonium hydroxide was then added, and the emulsion was held for 10 minutes. The pH was adjusted to 5.0 with sulfuric acid, and the double-jet introduction of the ammonium bromide and silver nitrate solution was resumed for 14 minutes maintaining a pBr of approximately 0.9 and at a rate consuming 56.8 percent of the total silver consumed. The pBr was then adjusted to 3.3 and the emulsion cooled to 30° C. A total of approximately 87 moles of silver was used. 900 g of phthalated gelatin were added, and the emulsion was coagulation washed.

The pAg of the emulsion was adjusted to 8.8 and to the emulsion was added 4.2 mg/Ag mole of sodium thiosulfate pentahydrate and 0.6 mg/Ag mole of potassium tetrachloroaurate. The emulsion was then heat finished for 16 minutes at 80° C., cooled to 40° C., 387 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

CONTROL 4

This emulsion is of the type described in Illingsworth U.S. Pat. No. 3,320,069.

To 42.0 liters of a 0.050 M potassium bromide, 0.012 M potassium iodide and 0.051 M potassium thiocyanate solution at 68° C. containing 1.25 percent phthalated gelatin, were added by double-jet with stirring at equal flow rates a 1.32 M potassium bromide solution which was also 0.11 M in potassium iodide and a 1.43 M silver nitrate solution, over a period of approximately 40 minutes. The precipitation consumed 21 moles of silver. The emulsion was then cooled to 35° C. and coagulation washed by the method of Yutzy and Frame U.S. Pat. No. 2,614,928.

The pAg of the emulsion was adjusted to 8.1 and to the emulsion was added 5.0 mg/Ag mole of sodium thiosulfate pentahydrate and 2.0 mg/Ag mole of potassium tetrachloroaurate. The emulsion was then heat finished at 65° C., cooled to 40° C., 464 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

CONTROL 5

This emulsion is of the type described in Illingsworth U.S. Pat. No. 3,320,069.

To 42.0 liters of a 0.050 M potassium bromide, 0.012 M potassium iodide, and 0.051 M potasium thiocyanate solution at 68° C. containing 1.25 percent phthalated gelatin were added by double-jet with stirring at equal flow rates a 1.37 M potassium bromide solution which was also 0.053 M in potassium iodide, and a 1.43 M silver nitrate solution, over a period of approximately 40 minutes. The precipitation consumed 21 moles of silver. The emulsion was then cooled to 35° C. and coagulation washed in the same manner as Control 4.

The pAg of the emulsion was adjusted to 8.8 and to the emulsion was added 10 mg/Ag mole of sodium thiosulfate pentahydrate and 2.0 mg/Ag mole of potassium tetrachloroaurate. The emulsion was then heat finished at 55° C., cooled to 40° C., 387 mg/Ag mole of the green spectral sensitizer, anhydro-5-chloro-9-ethyl-5'-phenyl-3'-(3-sulfobutyl)-3-(3-sulfopropyl)oxacarbocyanine hydroxide, sodium salt, was added and the emulsion was held for 10 minutes. Chemical and spectral sensitization was optimum for the sensitizers employed.

TABLE II

PHYSICAL DESCRIPTIONS OF EMULSION 1-7

| | Emulsion No. | Iodide Content (M % I) | Tabular Grain Diameter (μm) | Tabular Grain Thickness (μm) | Average Aspect Ratio | % of Projected Area |
|---|---|---|---|---|---|---|
| Example | 6 | 6 | ≈3.8 | 0.14 | 27:1 | >50 |
| Example | 7 | 1.2 | ≈3.8 | 0.14 | 27:1 | 75 |
| Example | 8 | 12.0 | 2.8 | 0.15 | 19:1 | >90 |
| Example | 9 | 12.3 | 1.8 | 0.12 | 15:1 | >50 |
| Control | 3 | 4.7 | 1.4 | 0.42 | 3.3:1 | |
| Control | 4 | 10 | 1.1 | ≈0.40 | 2.8:1 | |
| Control | 5 | 5 | 1.0 | ≈0.40 | 2.5:1 | |

Emulsions 6 through 9 were high aspect ratio tabular grains emulsions within the definition limits of this patent application. Although some tabular grains of less than 0.6 micron in diameter were included in computing the tabular grain average diameters and percent projected area in these and other examples, except where their exclusion is specifically recited, insufficient small diameter grains were present to alter significantly the numbers reported. To obtain a representative average aspect ratio for the grains of the control emulsions the average grain diameter was compared to the average grain thickness. Although not measured, the projected area that could be attributed to the few tabular grains meeting the less than 0.3 micron thickness and 0.6 micron diameter criteria was in each instance estimated by visual inspection to account for very little, if any, of the total projected area of the total grain population of the control emulsions.

The chemically and spectrally sensitized emulsions were separately coated in a single-layer magenta format on a cellulose triacetate film support. Each coated element comprised silver halide emulsions at 1.07 g/m$^2$ silver, gelatin at 2.14 g/m$^2$, to which a solvent dispersion of the magenta image-forming coupler 1-(2,4-dimethyl-6-chlorophenyl)-3-[α-(3-n-pentadecylphenoxy)-butyramido]-5-pyrazolone at 0.75 g/m$^2$ coupler, the antistain agent 5-sec-octadecylhydroquinone-2-sulfonate, potassium salt at 3.2 g/Ag mole, and the antifoggant 4-hydroxy-6-methyl-1,3,3a,7-tetraazindene at 3.6 g/Ag mole had been added previously. An overcoat layer, comprising gelatin at 0.88 g/m$^2$ and the hardener bis(-vinylsulfonylmethyl)ether at 1.75 percent based on total gelatin weight, was applied.

The resulting photographic elements were exposed for 1/100 of a second through a 0–3.0 density step tablet plus a Wratten No. 9 filter and 1.26 neutral density filter, to a 600 W, 3000° K. tungsten light source. Processing was accomplished at 37.7° C. in a color process of the type described in the *British Journal of Photography Annual,* 1979, pp. 204–206. The development times were varied to produce fog densities of about 0.10. The relative green sensi-tivity and the rms granularity were determined for each of the photographic elements. (The rms granu-larity is measured by the method described by H. C. Schmitt, Jr. and J. H. Altman, *Applied Optics,* 9, pp. 871–874, April 1970.)

Figure 12:
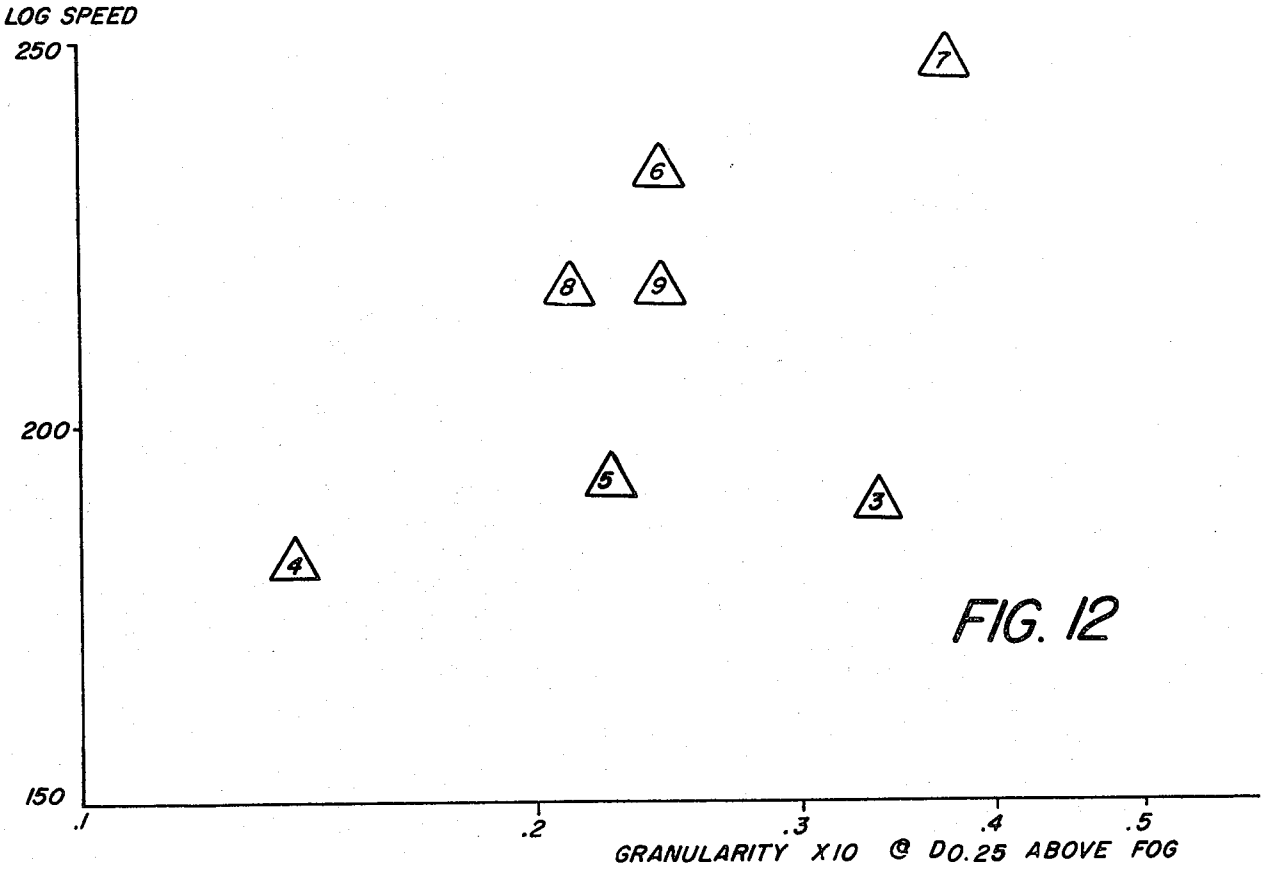

The speed-granularity relationship for these coatings is conveniently shown on a plot of Log Green Speed vs. rms Granularity X 10 in FIG. 12. It is clearly shown in FIG. 12 that optimally chemically and spectrally sensitized silver bromoiodide emulsions having high aspect ratios exhibit a much better speed-granularity relationship than do the low aspect ratio silver bromoiodide emulsions 3, 4, and 5.

It should be noted that the use of a single-layer format, where all the silver halide emulsions are coated at equal silver coverage and with a common silver/coupler ratio, is the best format to illustrate the speed-granularity relationship of a silver halide emulsion without introducing complicating interactions. For example, it is well known to those skilled in the photographic art that there are many methods of improving the speed-granularity relation of a color photographic element. Such methods include multiple-layer coating of the silver halide emulsion units sensitive to a given region of the visible spectrum. This technique allows control of granularity by contolling the silver/coupler ratio in each of the layers of the unit. Selecting couplers on the basis of reactivity is also known as a method of modifying granularity. The use of competing couplers, which react with oxidized color developer to either form a soluble dye or a colorless compound, is a technique often used. Another method of reducing granularity is the use of development inhibitor releasing couplers and compounds.

EXAMPLE 10

A multicolor, incorporated coupler photographic element was prepared by coating the following layers on a cellulose triacetate film support in the order recited:

| | |
|---|---|
| Layer 1 | Slow Cyan Layer—comprising a red-sensitized silver bromoiodide grains, gelatin, cyan image-forming coupler, colored coupler, and DIR coupler. |
| Layer 2 | Fast Cyan Layer—comprising a faster red-sensitized silver bromoiodide grains, gelatin, cyan image-forming coupler, colored coupler, and DIR coupler. |
| Layer 3 | Interlayer—comprising gelatin and 2,5-di-sec-dodecylhydroquinone antistain agent. |
| Layer 4 | Slow Magenta Layer—comprising a green-sensitized silver bromoiodide grains (1.48 g/m$^2$ silver), gelatin (1.21 g/m$^2$), the magenta coupler 1-(2,4,6-trichlorophenyl)-3-[3-(2,4-diamylphenoxyacetamido)-benzamido]-5-pyrazolone (0.88 g/m$^2$), the colored coupler 1-(2,4,6-trichlorophenyl)-3-[α-(3-tert-butyl-4-hydroxyphenoxy)tetradecanamido-2-chloroanilino]-4-(3,4-dimethoxy)-phenylazo-5-pyrazolone (0.10 g/m$^2$), the DIR coupler 1-{4-[α-(2,4-di-tert-amylphenoxy)butyramido]phenyl}-3-pyrrolidino-4-(1-phenyl-5-tetrazolylthio)-5-pyrazolone (0.02 g/m$^2$) and the antistain agent 5-sec-octadecylhydroquinone-2-sulfonate, potassium salt (0.09 g/m$^2$). |
| Layer 5 | Fast Magenta Layer—comprising a faster green-sensitized silver bromoiodide grains (1.23 g/m$^2$ silver), gelatin (0.88 g/m$^2$), the magenta coupler 1-(2,4,6-trichlorophenyl)-3-[3-(2,4-diamylphenoxyacetamido)-benzamido]-5-pyrazolone (0.12 g/m$^2$), the colored coupler 1-(2,4,6-trichlorophenyl)-3-[α-(3-tert-butyl-4-hydroxyphenoxy)tetra- |

-continued

| | |
|---|---|
| | decanamido-2-chloroanilino]-4-(3,4-dimethoxy)phenylazo-5-pyrazolone (0.03 g/m$^2$), and the antistain agent 5-sec-octadecylhydroquinone-2-sulfonate, potassium salt (0.05 g/m$^2$). |
| Layer 6 | Interlayer—comprising gelatin and 2,5-di-sec-dodecylhydroquinone antistain agent. |
| Layer 7 | Yellow Filter Layer—comprising yellow colloidal silver and gelatin. |
| Layer 8 | Slow Yellow Layer—comprising blue-sensitized silver bromoiodide grains, gelatin, a yellow-forming coupler and the antistain agent 5-sec-octadecylhydroquinone. |
| Layer 9 | Fast Yellow Layer—comprising a faster blue-sensitized silver bromoiodide grains, gelatin, a yellow-forming coupler and the antistain agent 5-sec-octadecylhydroquinone. |
| Layer 10 | UV Absorbing Layer—comprising the UV absorber 3-(di-n-hexylamino)alylidenemalononitrile and gelatin. |
| Layer 11 | Protective Overcoat Layer—comprising gelatin and bis(vinylsulfonylmethyl)ether. |

The silver halide emulsions in each color image-forming layer of this coating contained polydisperse, low aspect ratio grains of the type described in Illingsworth U.S. Pat. No. 3,320.069. The emulsions were all optimally sensitized with sulfur and gold in the presence of thiocyanate and were spectrally sensitized to the appropriate regions of the visible spectrum. The emulsion utilized in the Fast Magenta Layer was a polydisperse (0.5 to 1.5 μm) low aspect ratio (≈3:1) silver bromoiodide (12 M% iodide) emulsion which was prepared in a manner similar to Emulsion No. 4 described above.

A second multicolor image-forming photographic element was prepared in the same manner except the Fast Magenta Layer utilized a tabular grain silver bromoiodide (8.4 M% iodide) emulsion in place of the low aspect ratio emulsion described above. The emulsion had an average tabular grain diameter of about 2.5 μm, a tabular grain thickness of less than or equal to 0.12 μm, and an average tabular grain aspect ratio of greater than 20:1, and the projected area of the tabular grains was greater than 75 percent, measured as described above. The high and low aspect ratio emulsions were both similarly optimally chemically and spectrally sensitized according to the teachings of Kofron et al., cited above.

Both photographic elements were exposed for 1/50 second through a multicolor 0–3.0 density step tablet (plus 0.60 neutral density) to a 600 W 5500° K. tungsten light source. Processing was for 3¼ minutes in a color developer of the type described in the *British Journal of Photography Annual,* 1979, pp. 204–206. Sensitometric results are given in Table III below.

TABLE III

Comparison of Tabular (High Aspect Ratio) and Three-Dimensional (Low Aspect Ratio) Grain Emulsions in Multilayer, Multicolor Image-Forming Elements

| Fast Magenta Layer | Red Log. Speed | Green Log Speed | Green rms.* Gran. | Blue Log Speed |
|---|---|---|---|---|
| Control | 225 | 220 | 0.011 | 240 |
| Example | 225 | 240 | 0.012 | 240 |

*Measured at a density of 0.25 above fog; 48 μm aperture.

The results in the above Table III illustrate that the tabular grains of the present invention provided a substantial increase in green speed with very little increase in granularity.

EXAMPLES 11 AND 12

Speed/Granularity of Black-and-White Photographic Materials

To illustrate speed/granularity advantage in black-and-white photographic materials five of the chemically and spectrally sensitized emulsions described above, Emulsion Nos. 6, 9, 3, 4, and 5, were coated on a poly(ethylene terephthalate) film support. Each coated element comprised a silver halide emulsion at 3.21 g/m$^2$ silver and gelatin at 4.16 g/m$^2$ to which had been added the antifoggant 4-hydroxy-6-methyl-1,3,3a-7-tetraazaindene at 3.6 g/silver mole. An overcoat layer, comprising gelatin at 0.88 g/m$^2$ and the hardener bis(vinylsulfonylmethyl)ether at 1.75 percent based on total gelatin content, was applied.

Figure 13:
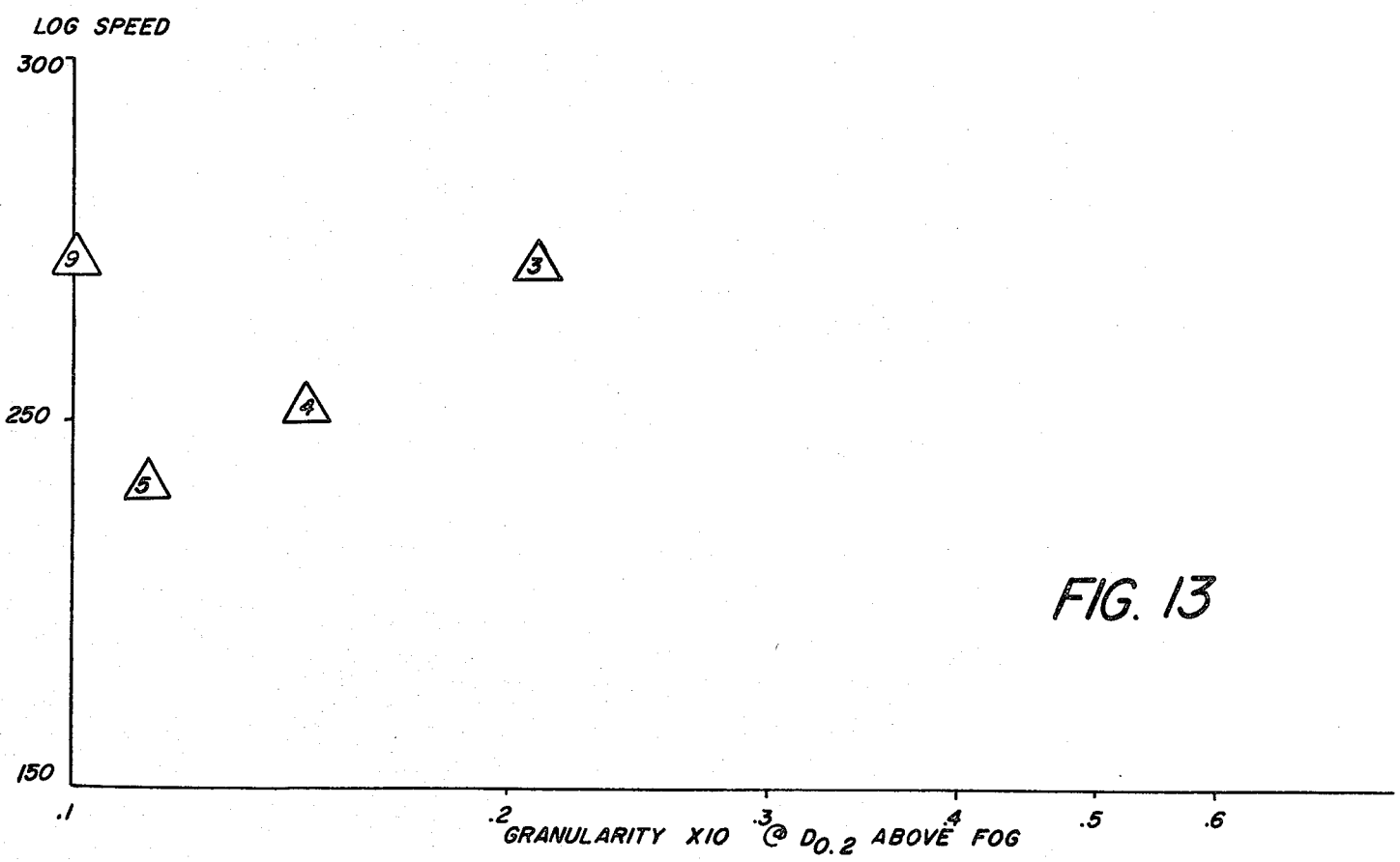

The resulting photographic elements were exposed for 1/100 of a second through a 0–3.0 density step tablet plus a Wratten No. 9 filter and a 1.26 neutral density filter, to a 600 W, 3000° K. tungsten light source. The exposed elements were then developed in an N-methyl-p-aminophenol sulfate-hydroquinone (Kodak DK-50®) developer at 20° C., the low aspect ratio emulsions were developed for 5 minutes while the high aspect ratio emulsions were developed for 3½ minutes to achieve matched curve shape for the comparison. The resulting speed and granularity measurements are shown on a plot of Log Green Speed vs. rms granularity X 10 in FIG. 13. The speed-granularity relationships of Control Emulsions 3, 4, and 5 were clearly inferior to those of the Emulsions 6 and 9 of this invention.

EXAMPLES 13 AND 14

Illustrating Increased Speed Separation of Spectrally Sensitized and Native Sensitivity Regions Four multicolor photographic elements were prepared, hereinafter referred to as Structures I through IV. Except for the differences specifically identified below, the elements were substantially identical in structure.

| Structure I | Structure II | Structure III | Structure IV |
|---|---|---|---|
| Exposure | Exposure | Exposure | Exposure |
| ↓ | ↓ | ↓ | ↓ |
| OC | OC | OC | OC |
| B | B | B | B |
| IL + YF | IL | IL | IL + YF |
| FG | FG | TFG | TFG |
| IL | IL | IL | IL |
| FR | FR | TFR | TFR |
| IL | IL | IL | IL |
| SG | SG | SG | SG |
| IL | IL | IL | IL |
| SR | SR | SR | SR |

OC is a protective gelatin overcoat, YF is yellow colloidal silver coated at 0.69 g/m$^2$ serving as a yellow filter material, and the remaining terms are as previously defined in connection with Layer Order Arrangements I through V. The blue (B), green (G), and red (R) recording color-forming layer units lacking the T prefix contained low aspect ratio silver bromide or bromoiodide emulsions prepared as taught by Illingsworth U.S. Pat. No. 3,320,069. Corresponding layers in the separate structures were of the same iodide content, except as specifically noted.

The faster tabular grain green-sensitive emulsion layer contained a tabular silver bromoiodide emulsion prepared in the following manner:

To a 2.25 liter aqueous 0.17 moles potassium bromide bone gelatin solution (1.5 percent by weight gelatin) (Solution A) at 80° C. and pBr 0.77 were added simultaneously by double-jet addition over a two minute period at a constant flow rate (consuming 0.61 percent of the total silver) aqueous 2.19 molar potassium bromide (Solution B-1) and 2.0 molar silver nitrate (Solution C-1) solutions.

After the initial two minutes, Solution B-1 was halted while Solution C-1 was continued until pBr 1.00 at 80° C. was attained (2.44% of total silver used). An aqueous phthalated gelatin solution (0.4 liter of 20 percent by weight gelatin solution) containing potassium bromide (0.10 molar, Solution D) was added next at pBr 1.0 and 80° C.

Solutions B-1 and C-1 were added then to the reaction vessel by double-jet addition over a period of 24 minutes (consuming 44.0 percent of the total silver) at an accelerated flow rate (4.0X from start to finish). After 24 minutes Solution B-1 was halted and Solution C-1 was continued until pBr 1.80 at 80° C. was attained.

Solution C-1 and an aqueous solution (Solution B-2) of potassium bromide (2.17 molar) and potassium iodide (0.03 molar) were added next to the reaction vessel by double-jet addition over a period of 12 minutes (consuming 50.4 percent of the total silver) at an accelerated flow rate (1.37X from start to finish).

Aqueous solutions of potassium iodide (0.36 molar, Solution B-3) and silver nitrate (2.0 molar, Solution C-2) were added next by double-jet addition at a constant flow rate until pBr 2.16 at 80° C. was attained (2.59 percent of total silver consumed). 6.57 Moles of silver were used to prepare this emulsion.

The emulsion was cooled to 35° C., combined with 0.30 liter of aqueous phthalated gelatin solution (13.3 percent by weight gelatin) and coagulation washed twice.

The resulting tabular grain silver bromoiodide emulsion had an average tabular grain diameter of 5.0 μm and an average tabular grain thickness of about 0.11 μm. The tabular grains accounted for about 90 percent of the total grain projected area and exhibited an average aspect ratio of about 45:1.

The emulsion was then optimally spectrally and chemically sensitized through the addition of 350 mg/Ag mole of anhydro-5-chloro-9-ethyl-5'-phenyl3'-(3-sulfobutyl)-3-(3-sulfopropyl)oxacarbocyanine hydroxide, sodium salt, 101 mg/Ag mole of anhydro-11-ethyl-1,1'-bis(3-sulfopropyl)-naph-[1,2-d]oxazolocarbocyanine hydroxide, sodium salt, 800 mg/Ag mole of sodium thiocyanate, 6 mg/Ag mole of sodium thiosulfate pentahydrate and 3 mg/Ag mole of potassium tetrachloroaurate.

The faster tabular grain red-sensitive emulsion layer contained a tabular grain silver bromiodide emulsion prepared and optimally sensitized in a manner similar to the tabular green-sensitized silver bromoiodide emulsion described directly above, differing only in that 144 mg/Ag mole of anhydro-5,6-dichloro-1-ethyl-3-(3-sulfobutyl)-3'-(3-sulfopropyl)benzimidazolonaphtho[1,2-d]-thiazolocarbocyanine hydroxide and 224 mg/Ag mole of anhydro-5,5'-dichloro-3,9-diethyl-3'-(3-sulfobutyl)thiazarbocyanine hydroxide were utilized as spectral sensitizers. The faster green- and red-sensitive emulsion layers of Structures I and II contained 9 mole percent iodide while the faster tabular green- and red-sensitive emulsions of Structures III and IV contained 1.5 and 1.2 mole percent iodide, respectively.

Other details relating to Structures I through IV will be readily apparent from Eeles et al. U.S. Pat. No. 4,184,876.

Structures I through IV were identically neutrally exposed with a 600 watt 2850° K. source at 1/100 second using a Daylight 5 filter and a 0 to 4 density step tablet having 0.20 density steps. Separate samples of Structures I through IV were exposed as described above, but with the additional interposition of a Wratten 98 filter to obtain blue exposures. Separate samples of Structures I through IV were exposed as described above, but with the additional interposition of a Wratten 9 filter to obtain minus blue exposures. All samples were identically processed using the C-41 Color Negative Process described in *British Journal of Photography Annual*, 1979, p. 204. Development was for 3 minutes 15 seconds at 38° C. Yellow, magenta, and cyan characteristic curves were plotted for each sample. Curves from different samples were compared by matching minimum density levels—that is, by superimposing the minimum density portions of the curves.

Results are summarized in Table IV.

TABLE IV

| | Structures | | | |
|---|---|---|---|---|
| | I (Control) | II (Control) | III (Ex. 13) | IV (Ex. 14) |
| Green Structure Differences | FG | FG | TFG | TFG |
| Red Structure Differences | FR | FR | TFR | TFR |
| Yellow Filter | Yes | No | No | Yes |
| Log E Blue/-Minus Blue Speed Differences | | | | |
| A | 1.3 | 0.55 | 0 95 | 1.75 |
| B | 1.9 | 0.95 | 1.60 | >2.40 |
| C | 1.8 | 0.95 | 1.35 | 2.25 |
| D | 2.5 | 1.55 | 2.20 | >3.10 |

A is the difference in the log of the blue speed of the blue recording color-forming unit and the log of the blue speed of the green recording color-forming unit, as determined by Equation (A) above; $(B_{W98}-G_{W98})-(B_N-G_N)$;

B is the difference in the log of the blue speed of the blue recording color-forming unit and the log of the blue speed of the red recording color-forming unit, as determined by Equation (B) above; $(B_{W98}-G_{W98})-(B_N-R_N)$;

C is the difference in the log of the green speed of the green recording color-forming unit and the log of the blue speed of the green recording color-forming unit, as determined by Equation (C) above; $G_{W9}-G_{W98}$; and D is the difference in the log of the red speed of the red recording color-forming unit and the log of the blue speed of the red recording color-forming unit, as determined by Equation (D) above, $R_{W9}-R_{W98}$.

In comparing Structures II and III, it can be seen that superior speed separations are obtained with Structure III employing tabular grains according to the present invention. Although Structure III did not attain the speed separations of Structure I, Structure III did not employ a yellow filter material and therefore did not encounter the disadvantages already discussed attendant to the use of such materials. Although Structure IV employed larger amounts of yellow filter material than necessary for use in the photographic elements of this invention, Structure IV does show that the speed separations of Structure III could be increased, if desired, by employing even small yellow filter densities.

A monochrome element was prepared by coating the faster green-sensitized tabular grain emulsion layer composition, described above, on a film support and overcoating with a gelatin protective layer. The blue to minus blue speed separation of the element was then determined using the exposure and processing techniques described above. The quantitative difference determined by Equation (C), $G_{W9}-G_{W98}$, was 1.28 Log E. This illustrates that adequate blue to minus blue speed separation can be achieved according to the present invention when the high aspect ratio tabular grain minus blue recording emulsion layer lies nearest the exposing radiation source and is not protected by any overlying blue absorbing layer.

EXAMPLES 15 THROUGH 19

Relating to Improved Image Sharpness in Multilayer Photographic Elements Containing Tablular Grain Emulsions The following examples illustrate the improved image sharpness which is achieved by the use of high aspect ratio tabular grain emulsions in photographic materials. In these examples the control elements utilize low aspect ratio silver bromoiodide emulsions of the type described in Illingsworth U.S. Pat. No. 3,320,069. For the purpose of these examples the low aspect ratio emulsions will be identified as conventional emulsions, their physical properties being described in Table V.

TABLE

| Conventional Emulsion No. | Average Grain Diameter | Average Aspect Ratio |
|---|---|---|
| C1 | 1.1μm | 3:1 |
| C2 | 0.4–0.8 μm | 3:1 |
| C3 | 0.8 μm | 3:1 |
| C4 | 1.5 μm | 3:1 |
| C5 | 0.4–0.5 μm | 3:1 |
| C6 | 0.4–0.8 μm | 3:1 |

Four tabular grain (high aspect ratio) silver bromoiodide emulsions were prepared by methods similar to those described in relation to speed/granularity improvements. The physical descriptions of these emulsions are described in Table VI.

TABLE VI

| Tabular Emulsion No. | Tabular Grain | | | Tabular Grain Percentage of Projected Area |
|---|---|---|---|---|
| | Average Diameter | Thickness | Average Aspect Ratio | |
| T1 | 7.0–8.0 μm | ≈0.19 μm | 35–45:1 | ≈65 |
| T2 | 3.0 μm | ≈0.07 μm | 35–45:1 | >50 |
| T3[1] | 2.4 μm | ≈0.09 μm | 25–30:1 | >70 |
| T3[1] | 1.5–1.8 μm | ≈0.06 μm | 25–30:1 | >70 |

[1]Similar to Example 4 in being formed by an abrupt increase in iodide in the annular regions of the tabular grains.

The silver bromoiodide emulsions described above (C1–C6 and T1–T4) were then coated in a series of multilayer elements. The specific variations are shown in the tables containing the results. Although the emulsions were chemically and spectrally sensitized, sensitization is not essential to produce the sharpness results observed.

| Common Structure A |
|---|
| Overcoat Layer |
| Fast Blue-Sensitive, Yellow Dye-Forming Layer |
| Slow Blue-Sensitive, Yellow Dye-Forming Layer |
| Interlayer (Yellow Filter Layer) |
| Fast Green-Sensitized, Magenta Dye-Forming Layer |
| Interlayer |
| Fast Red-Sensitized, Cyan Dye-Forming Layer |
| Interlayer |
| Slow Green-Sensitized, Magenta Dye-Forming Layer |
| Interlayer |
| Slow Red-Sensitized, Cyan Dye-Forming Layer |
| SUPPORT |

EXPOSURE AND PROCESS

The samles were exposed and developed as described hereinafter. The sharpness determinations were made by determining the Modulation Transfer Functions (MTF) by the procedure described in *Journal of Applied Photographic Engineering,* 6 (1):1–8, 1980.

Modulation Transfer Functions for red light were obtained by exposing the multilayer coatings for 1/15 sec at 60 percent modulation using a Wratten 29 and an 0.7 neutral density filter. Green MTF's were obtained by exposing for 1/15 sec at 60 percent modulation in conjunction with a Wratten 99 filter.

Processing was through the C-41 Color Negative Process as described in *British Journal of Photography Annual* 1979, p. 204. Development time was 3¼ min at 38° C. (100° F.). Following process, Cascaded Modulation Transfer (CMT) Acutance Ratings at 16 mm magnification were determined from the MTF curves.

RESULTS

The composition of the control and experimental coatings along with CMT acutance values for red and green exposures are shown in Table VII.

TABLE VII

Sharpness in Structure A Varied in Conventional and Tabular Grain Emulsion Layer Content

| Coating No. | 1 | 2 | (Ex. 15) 3 | (Ex. 16) 4 | (Ex. 17) 5 | (Ex. 18) 6 | (Ex. 19) 7 |
|---|---|---|---|---|---|---|---|
| FY | C1 | C1 | T-1 | T-1 | T-1 | T-1 | T-1 |
| SY | C2 | C2 | T-2 | T-2 | T-2 | T-2 | T-2 |
| FM | C3 | T-3 | T-3 | T-3 | C3 | T-2 | T-2 |
| FC | C4 | C4 | C4 | C4 | C4 | C4 | T-2 |
| SM | C5 | T-4 | T-4 | C5 | C5 | C5 | C5 |
| SC | C6 | C6 | C6 | C6 | C6 | C6 | C6 |
| Red CMT Acutance | 79.7 | 78.7 | 82.7 | 84.0 | 83.1 | 85.3 | 86.3 |
| Δ CMT Units | — | −1.0 | +3.0 | +4.3 | +3.4 | +5.6 | +6.6 |
| Green CMT Acutance | 86.5 | 87.8 | 93.1 | 92.8 | 90.1 | 92.8 | 92.1 |
| Δ CMT Units | — | +2.3 | +6.6 | +6.3 | +3.6 | +6.3 | +5.6 |

Unexpectedly, as shown in Table XII, placing tabular grain emulsions in multilayer color coatings can lead to a decrease in sharpness. Considering Red CMT Acutance, one observes that Coating 2, containing TWO tabular grain layers, is less sharp (−1.0 CMT units) than control Coating 1, an all conventional emulsion structure. Similarly, Coating 3 (four tabular grain layers) is less sharp than Coating 4 (three tabular grain layers) by 1.3 CMT units and less sharp than Coating 5 (two tabular grain layers) by 0.4 CMT units. However, Coatings 6 and 7 demonstrate that by proper placement of specific tabular grain emulsions (note that Coating 6 is sharper in Red CMT Acutance than Coating 4 by 1.3 units) in layers nearest the source of exposing radiation, very significant improvements can be obtained over the control coating containing all conventional emulsions. As seen in the above table, Coating 6 is 6.3 green CMT units sharper than Coating 1, and Coating 7 is 6.6 Red CMT units sharper than Coating 1.

| Common Structure B |
|---|
| Overcoat Layer |
| Fast Blue-Sensitive, Yellow Dye-Forming Layer |
| Slow Blue-Sensitive, Yellow Dye-Forming Layer |
| Interlayer (Yellow Filter Layer) |
| Fast Green-Sensitized, Magenta Dye-Forming Layer |
| Slow Green-Sensitized, Magenta Dye-Forming Layer |
| Interlayer |
| Fast Red-Sensitized, Cyan Dye-Forming Layer |
| Slow Red-Sensitized, Cyan Dye-Forming Layer |
| Interlayer |
| SUPPORT |

After coating, the multicolor photographic elements of Common Structure B were exposed and processed according to the procedure described in the preceding example. The composition variations of the control and experimental coatings along with CMT acutance ratings are shown in Table VIII.

TABLE VIII

| Sharpness of Structure B Varied on Conventional and Tabular Grain Emulsion Layer Content | | | | |
|---|---|---|---|---|
| Coating No. | 1 | 2 | 3 | 4 |
| FY | C1 | C1 | T-1 | T-1 |
| SY | C2 | C2 | T-2 | T-2 |
| FM | C3 | T-3 | T-3 | C3 |
| SM | C5 | T-4 | T-4 | C5 |
| FC | C4 | C4 | C4 | C4 |
| SC | C6 | C6 | C6 | C6 |
| Red CMT Acutance | 80.0 | 78.4 | 83.9 | 82.8 |
| ΔCMT Units | — | −1.6 | +3.9 | +2.8 |
| Green CMT Acutance | 87.3 | 88.9 | 94.3 | 92.3 |
| ΔCMT Units | — | +1.6 | +7.0 | +5.0 |

The data presented in Table VIII illustrates beneficial changes in sharpness in photographic materials which can be obtained through the use of tabular grain emulsions lying nearest the source of exposing radiation and detrimental changes when the tabular grain emulsions in intermediate layers underlie light scattering emulsion layers.

| Common Structure C |
|---|
| Fast Magenta |
| Slow Magenta |
| SUPPORT |

Two monochrome elements, A (Control) and B (Example), were prepared by coating fast and slow magenta layer formulations on a film support.

TABLE IX

| Emulsions | | |
|---|---|---|
| Element A | Element B | Layer |
| C3 | T3 | Fast Magenta |
| C5 | T4 | Slow Magenta |

The monochrome elements were then evaluated for sharpness according to the method described for the previous examples, with the following results.

TABLE X

| Element | CMT Acutance (16 mm) |
|---|---|
| A (Control) | 93.9 |
| B (Tabular Grain Emulsion) | 97.3 |

EXAMPLE 20

Illustrating Reduced High-Angle Scattering by High Aspect Ratio Tabular Grain Emulsions To provide a specific illustration of the reduced high-angle scattering of high aspect ratio tabular grain emulsions according to this invention as compared to non-tabular emulsions of the same average grain volume, the quantitative angular light scattering detection procedure described above with reference to FIG. 5 was employed. The high aspect ratio tabular grain emulsion according to the present invention consisted essentially of dispersing medium and tabular grains having an average diameter of 5.4 microns and an average thickness of 0.23 micron, and an average aspect ratio of 23.5:1. Greater than 90% of the projected area of the grains was provided by the tabular grains. The average grain volume was 5.61 cubic microns. A control nontabular emulsion was employed having an average grain volume of 5.57 cubic microns. (When resolved into spheres of the same volume—i.e., equivalent spheres—both emulsions had nearly equal grain diameters.) Both emulsions had a total transmittance of 90 percent when they were immersed in a liquid having a matching refractive index. Each emulsion was coated on a transparent support at a silver coverage of 1.08 g/m$^2$.

As more specifically set forth below in Table XI, lower percentages of total transmitted light were received over the detection surface areas subtended by $\phi$ up to values of $\phi$ of 84° with the high aspect ratio tabular grain emulsion of this invention as compared to the control emulsion of similar average grain volume. From Table XVI it is also apparent that the collection angle for both emulsions was substantially below 6°. Thus neither emulsion would be considered a turbid emulsion in terms of its light scattering characteristics. When $\phi$ was 70° the emulsion of the present invention exhibited only half of the high-angle scattering of the control emulsion.

TABLE XI

| Percent of Transmitted Light Contained Within Angle Phi | | | |
|---|---|---|---|
| $\phi$ | Tabular Nontabular Emulsion (Example) | Emulsion (Control) | Percent Reduction |
| 30° | 2% | 6% | 67% |
| 50° | 5% | 15% | 67% |
| 70° | 12% | 24% | 50% |
| 80° | 25% | 33% | 24% |
| 84° | 40% | 40% | 0% |

EXAMPLE 21

Illustrating Blue Spectral Sensitization of A Tabular Grain Emulsion

A tabular grain silver bromoiodide emulsion (3 M% iodide) was prepared in the following manner:

To 3.0 liters of a 1.5 percent gelatin, 0.17 M potassium bromide solution at 60° C. were added to with stirring and by double-jet, 4.34 M potassium bromide in a 3 percent gelatin solution and 4.0 M silver nitrate solution over a period of 2.5 minutes while maintaining a pBr of 0.8 and consuming 4.8 percent of the total silver used. The bromide solution was then stopped and the silver solution continued for 1.8 minutes until a pBr of 1.3 was attained consuming 4.3 percent of the silver used. A 6 percent gelatin solution containing 4.0 M potassium bromide and 0.12 M potassium iodide was then run concurrently with the silver solution for 24.5 minutes maintaining pBr 1.3 in an accelerated flow (2.0X from start to finish) (consuming 87.1 percent of the total silver used). The bromide solution was stopped and the silver solution run for 1.6 minutes at a rate consuming 3.8 percent of the total silver used, until a pBr of 2.7 was attained. The emulsion was then cooled to 35° C., 279 g of phthalated gelatin dissolved in 1.0 liters of distilled water was added and the emulsion was coagulation washed. The resulting silver bromoiodide emulsion (3 M% iodide) had an average grain diameter of about 1.0 μm, a average thickness of about 0.10 μm, yielding an aspect ratio of about 10:1. The tabular grains accounted for greater than 85% of the total projected area of the silver halide grains present in the emulsion layer. The emulsion was chemically sensitized with sodium thiocyanate, sodium thiosulfate, and potassium tetrachloroaurate.

COATING 1

A portion of the chemically sensitized emulsion was coated on a cellulose triacetate film support. The emulsion coating was comprised of tabular silver bromoiodide grains (1.08 g Ag/m$^2$) and gelatin (2.9 g/m$^2$) to which had been added the magenta dye-forming coupler 1-(6-chloro-2,4-dimethylphenyl)-3-[α-(m-pentadecylphenoxy)butyramido]-5-pyrazolone (0.79 g/m$^2$), 2-octadecyl-5-sulfohydroquinone (1.69 g/mole Ag), and 4-hydroxy-6-methyl-1,3,3a,7-tetraazaindene (3.62 g/Ag mole).

COATING 2

A second portion of the tabular grain silver bromoiodide emulsion was spectrally sensitized to blue light by the addition of $3\times10^{-4}$ mole/mole of silver of anhydro-5,6-dimethoxy-5-methylthio-3,3'-di(3-sulfopropyl)thioacyanine hydroxide, triethylamine salt (λmax 490 nm). The spectrally sensitized emulsion was then constituted using the same magenta dye-forming coupler as in Coating 1 and coated as above.

The coatings were exposed for 1/25 second through a 0–3.0 density step tablet to a 500 W 5400° K. tungsten light source. Processing was for 3 minutes in a color developer of the type described in the *British Journal of Photography Annual,* 1979, Pages 204–206.

Coating 2 exhibited a photographic speed 0.42 log E faster than Coating 1, showing an effective increase in speed attributable to blue sensitization.

The invention has been described in detail with particular reference to preferred embodiments thereof, but it will be understood that variations and modifications can be effected within the spirit and scope of the invention.

What is claimed is:

1. A radiation-sensitive emulsion comprised of:

a dispersing medium and silver bromoiodide grains, wherein at least 50 percent of the total projected area of said silver bromoiodide grains is provided by tabular silver bromoiodide grains having first and second opposed, substantially parallel major faces, a thickness of less than 0.3 micron, a diameter of at least 0.6 micron, and an average aspect ratio of greater than 8:1, said tabular silver bromoiodide grains being comprised of, in an amount sufficient to improve the photographic response of said emulsion, tabular silver bromoiodide grains having a central region extending between said major faces, said central region having a lower proportion of iodide than at least one laterally displaced region also extending between said major faces.

2. A radiation-sensitive emulsion according to claim 1 in which said tabular silver bromoiodide grains have an average aspect ratio of at least 12:1.

3. A radiation-sensitive emulsion according to claim 1 in which said tabular silver bromoiodide grains have an average aspect ratio in the range of at least 20:1.

4. A radiation-sensitive emulsion according to claim 1 in which said laterally displaced region and said central region differ in the proportion of iodide present by at least 1 mole percent.

5. A radiation-sensitive emulsion according to claim 4 in which said central region contains less than 5 mole percent iodide and said laterally displaced region contains up to 20 mole percent iodide.

6. A radiation-sensitive emulsion according to claim 1 in which said central region contains less than 5 mole percent iodide within 0.035 micron of at least one of said major surfaces.

7. A radiation-sensitive emulsion according to claim 1 in which said laterally displaced region is an annular region surrounding said central region and the iodide concentration of said tabular silver bromoiodide grains increases progressively from said central region to said annular region.

8. A radiation-sensitive emulsion according to claim 1 in which said iodide present in said tabular silver bromoiodide grains increases abruptly at the interface of said central and laterally displaced regions.

9. A tabular grain silver halide emulsion according to claim 1 wherein said dispersing medium is comprised of a peptizer.

10. A tabular grain silver halide emulsion according to claim 9 wherein said peptizer is gelatin or a gelatin derivative.

11. A radiation-sensitive emulsion according to claim 1 wherein said tabular silver bromoiodide grains account for at least 70 percent of the total projected area of said silver bromoiodide grains.

12. A radiation-sensitive emulsion according to claim 1 wherein said tabular silver bromoiodide grains account for at least 90 percent of the total projected area of said silver bromoiodide grains.

13. A radiation-sensitive emulsion according to claim 1 wherein said tabular silver bromoiodide grains are internally doped.

14. A radiation-sensitive emulsion according to claim 13 wherein said tabular silver bromoiodide grains are internally doped with a Group VIII metal.

15. A radiation-sensitive emulsion according to claim 1 wherein said tabular silver bromoiodide grains are surface chemically sensitized with noble metal sensitizer, middle chalcogen sensitizer, reduction sensitizer, or a combination of said sensitizers.

16. A radiation-sensitive emulsion according to claim 1 wherein said tabular silver bromoiodide grains are chemically sensitized in the presence of a ripening agent.

17. A radiation-sensitive emulsion according to claim 16 wherein said tabular silver bromoiodide grains are chemically sensitized in the presence of a sulfur containing ripening agent.

18. A radiation-sensitive emulsion according to claim 1 wherein said tabular silver bromoiodide grains are spectrally sensitized to a portion of the spectrum in the minus blue region.

19. A radiation-sensitive emulsion comprised of
gelatin or a gelatin derivative and
silver bromoiodide grains, wherein tabular silver bromoiodide grains having first and second opposed, substantially parallel major faces, a central region extending between said major faces containing less than 5 mole percent iodide, a laterally surrounding annular region extending between said major faces containing at least 6 mole percent iodide, a thickness of less than 0.3 micron, and a diameter of at least 0.6 micron exhibit an average aspect ratio of at least 12:1 and account for at least 70 percent of the total projected area of said silver bromoiodide grains.

20. A radiation-sensitive emulsion comprised of
gelatin or a gelatin derivative and
silver bromoiodide grains, wherein tabular silver bromoiodide grains having first and second opposed, substantially parallel major faces, a central region extending between said major faces containing less than 5 mole percent iodide, a laterally surrounding annular region extending between said major faces containing at least 6 mole percent iodide, a thickness of less than 0.5 micron, and a diameter of at least 0.6 micron exhibit an average aspect ratio of at least 12:1 and account for at least 70 percent of the total projected area of said silver bromoiodide grains.

21. A radiation-sensitive emulsion comprised of
gelatin or a gelatin derivative and
chemically sensitized silver bromoiodide grains, wherein tabular silver bromoiodide grains having first and second opposed, substantially parallel major faces, a central region extending between said major faces containing less than 5 mole percent iodide, a laterally surrounding annular region extending between said major faces containing at least 6 mole percent iodide, a thickness of less than 0.3 micron, and a diameter of at least 0.6 micron exhibit an average aspect ratio of at least 12:1 and account for at least 70 percent of the total projected area of said silver bromoiodide grains, and
a blue or minus blue spectral sensitizer adsorbed to the surface of said silver bromoiodide grains.

22. A radiation-sensitive emulsion according to claim 21 wherein said tabular silver bromoiodide grains are substantially optimally chemically sensitized with gold in combination with at least one of sulfur and selenium in the presence of a thiocyanate ripening agent and with a spectral sensitizing dye having an absorption peak in the minus blue portion of the visible spectrum.

23. A radiation-sensitive emulsion according to claim 21 wherein said tabular grains have an average aspect ratio of from 20:1 to 100:1.

24. A radiation-sensitive emulsion according to claim 22 wherein said grains are chemically sensitized in the presence of at least a portion of said spectral sensitizing dye.

25. A radiation-sensitive emulsion according to claim 22 wherein additional silver halide is present on the surface of said silver bromoiodide grains in an amount sufficient to increase sensitivity.

26. A photographic element comprised of a support and at least one radiation-sensitive emulsion layer, the improvement wherein said emulsion layer is comprised of an emulsion according to claim 1, 2, 3, 4, 5, 6, 7, 8, 9, 10, 11, 12, 13, 14, 15, 16, 17, 18, 19, 20, 21, 22, 23, 24, or 25.

27. In a photographic element comprised of
a support and, located thereon,
a first silver halide emulsion layer positioned to receive substantially specularly transmitted light and
a second silver halide emulsion layer positioned to receive light transmitted through said first silver halide emulsion layer,
the improvement wherein, said first silver halide emulsion layer contains tabular silver bromoiodide grains having first and second opposed, substantially parallel major faces, at least 1 mole percent less iodide in a central region extending between said major faces than in a laterally displaced region extending between said major faces, a thickness of less than 0.5 micron, and a diameter of at least 0.6 micron, said tabular grains exhibiting an average aspect ratio of at least 12:1, exhibiting an average diameter of at least 1.0 micron, and accouting for at least 70 percent of the total projected area of the silver bromoiodide grains present in said first emulsion layer.

28. An improved photographic element according to claim 27 wherein said tabular silver bromoiodide grains have an average diameter of at least 2 microns.

29. In a black-and-white photographic element capable of producing a viewable silver image comprised of
a support and, located thereon,
at least one chemically and spectrally sensitized emulsion layer contaning silver bromoiodide grains in a dispersing medium,
the improvement wherein, tabular silver bromoiodide grains having first and second opposed, substantially parallel major faces, at least 1 mole percent less iodide in a central region extending between said major faces than in a laterally displaced region, a thickness of less than 0.5 micron, and a diameter of at less than 0.3 micron, and a diameter of at least 0.6 micron, said tabular grains exhibiting an average aspect ratio of at least 12:1, exhibiting an average diameter of at least 1.0 micron, accounting for at least 70 percent of the total projected area of the silver bromoiodide grains present, and being substantially optimally chemically sensitized and orthochromatically or panchromatically spectrally sensitized.

30. An improved black-and-white photographic element according to claim 29 wherein the emulsion layer overlies at least one other image-forming silver halide emulsion layer and is positioned to receive during imagewise exposure light that is free of significant scattering in an overlying light transmissive layer.

31. An improved black-and-white photographic element according to claim 30 wherein the emulsion layer is the outermost emulsion layer of the photographic element.

32. An improved black-and-white photographic element according to claim 29 wherein said silver bromoiodide grains are chemically sensitized with at least one of gold, sulfur, and selenium in the presence of a thiocyanate ripening agent.

33. In a multicolor photographic element comprised of a support and, located thereon, emulsion layers for separately recording blue, green, and red light each comprised of a dispersing medium and silver bromoiodide grains, said green and red recording emulsion layers containing green and red spectral sensitizing dyes, respectively, the improvement wherein in at least one of said green and red recording emulsion layers contains chemically and spectrally sensitized tabular silver bromoiodide grains having first and second opposed, substantially parallel major faces, at least one mole percent less iodide in a central region extending between said major faces than in a laterally displaced region extending between said major faces, a thickness of less than 0.3 micron, a diameter of at least 0.6 micron, and an average aspect ratio of greater than 8:1, which account for at least 50 percent of the total projected area of said silver bromoiodide grains.

34. An improved multicolor photographic element according to claim 33 wherein one of said emulsion layers containing said tabular silver bromoiodide grains is positioned to receive exposing radiation prior to remaining emulsion layers of said multicolor photographic element.

35. An improved multicolor photographic element according to claim 33 wherein one of said emulsion layers containing said tabular silver bromoiodide grains is positioned to receive substantially specularly transmitted light and overlies at least one other emulsion layer of said multicolor photographic element.

36. An improved multicolor photographic element according to claim 35 wherein said tabular silver bromoiodide grains have an average diameter of at least 2 microns.

37. An improved multicolor photographic element according to claim 33 wherein said blue recording emulsion layer is comprised of chemically and spectrally sensitized tabular silver bromoiodide grains having a thickness of less than 0.5 micron and a diameter of at least 0.6 micron having an average aspect ratio of greater than 8:1, and accounting for at least 50 percent of the total projected area of said silver halide grains present in the same emulsion layer.

38. In a multicolor photographic element comprised of a film support and, located thereon, emulsion layers for separately recording blue, green, and red light each comprised of a dispersing medium and silver bromoiodide grains, said green and red recording emulsion layers containing green and red spectral sensitizing dyes, respectively, the improvement wherein tabular silver bromoiodide grains in at least one of said green and one of said red recording emulsion layers having first and second opposed, substantially parallel major faces, at least one mole percent less iodide in a central region extending between said major faces than in a laterally displaced region extending between said major faces, a thickness of less than 0.3 micron, a diameter of at least 0.6 micron, and an average aspect ratio of at least 12:1, account for at least 70 percent of the total projected area of said silver bromoiodide grains present in the same emulsion layer and are surface chemically sensitized with gold and at least one of sulfur and selenium.

39. An improved multicolor photographic element according to claim 38 wherein said tabular silver bromoiodide grains are substantially optimally chemically sensitized in the presence of a sulfur containing ripening agent.

40. An improved multicolor photographic element according to claim 39 wherein said sulfur containing ripening agent is a thiocyanate.

41. In a multicolor photographic element comprised of a support and, located thereon, emulsion layers for separately recording blue, green, and red light each comprised of a dispersing medium and silver bromoiodide grains, said green and red recording emulsion layers containing green and red spectral sensitizing dyes, respectively, and being chemically sensitized, the improvement wherein at least one of said green and red recording emulsion layers contain tabular silver bromoiodide grains having first and second opposed, substantially parallel major faces, at least one mole percent less iodide in a central region extending between said major faces than in a laterally displaced region extending between said major faces, a thickness of less than 0.30 micron, a diameter of at least 0.6 micron, and an average aspect ratio of at least 12:1, account for at least 70 percent of the total projected area of said silver halide grains in the same emulsion layer, and at least one of said tabular grain containing emulsion layers is positioned to receive during exposure of the photographic element at a color temperature of 5500° K., blue light in addition to light the layer is intended to record, and $\Delta$ log E for said emulsion layer being less than 0.6, where $$\Delta \log E = \log E_T - \log E_B$$

log $E_T$ being the log of exposure to red or green light said tabular grain containing emulsion layer is intended to record and log $E_B$ being the log of concurrent exposure to blue light of said tabular grain containing emulsion layer.

42. A multicolor photographic element according to claim 41 in which said element is substantially free of yellow filter material interposed between exposing radiation incident upon said element and at leat one of said tabular grain containing emulsion layers.

43. A multicolor photographic element according to claim 41 in which at least one of said layers containing tabular grains is positioned to receive exposing radiation prior to said blue recording emulsion layer.

44. A multicolor photographic element according to claim 41 in which at least one of said layers containing said tabular grains is positioned to receive exposing radiation prior to all other silver halide emulsion layers of said photographic element.

45. A multicolor photographic element according to claim 41 in which said tabular grains are present in said green recording emulsion layer.

46. A multicolor photographic element according to claim 41 in which said tabular grains are present in said red recording emulsion layer.

47. A multicolor photographic element according to claim 41 in which said tabular grains are present in each of said green and red recording emulsion layers.

48. In a multicolor photographic element comprised of a film support and, located thereon, color-forming layer units for separately recording blue, green, and red light, said color-forming layer units being chosen so that when said photographic element is exposed at a color temperature of 5500° K. through a spectrally nonselective step wedge and processed said photographic element exhibits in relation to blue contrast and speed green and red contrast variations of less than 20 percent and green and red speed variations of less than 0.3 log E, using blue, green, and red densities determined according to American Standard PH2.1-1952, each of said color-forming layer units including at least one emulsion layer comprised of a dispersing medium and silver bromoiodide grains, said silver bromoiodide grains of a triad of said emulsion layers for separately recording blue, green, and red light being positioned to receive exposing radiation prior to any remaining emulsion layers and having an average diameter of at least 0.7 micron, an improvement wherein tabular silver bromoiodide grains in said green and red recording emulsion layers of said triad having first and second opposed, substantially parallel major faces, less than 3 mole percent iodide in a central region extending between said major faces, at least 6 mole percent iodide in a laterally displaced region extending between said major faces, a thickness of less than 0.3 micron, a diameter of at least 0.6 micron, and have an average aspect ratio of at leat 12:1, account for at least 70 percent of the total projected area of said silver bromoiodide grains present in the same emulsion layer, and are surface chemically sensitized with gold and at least one of sulfur and selenium, and said element is substantially free of yellow filter material interposed between exposing radiation incident upon said element and said red and green recording emulsion layers of said triad.

49. A multicolor photographic element according to claim 48 in which said green and red recording color-forming layer units of said triad exhibit a minus blue speed which is at least 10 times greater than their blue speed.

50. A multicolor photographic element according to claim 49 in which said green and red recording color-forming layer units of said triad exhibit a minus blue speed which is at least 20 times greater than their blue speed.

51. A multicolor photographic element according to claim 49 in which the blue speed of the blue record produced by said element is at least 6 times greater than the blue speed of the minus blue record produced by said element.

52. A multicolor photographic element according to claim 51 in which the blue speed of the blue record produced by said element is at least 10 times greater than the blue speed of the minus blue record produced by said element.

53. A multicolor photographic element according to claim 48 in which said color forming layer units for separately recording blue, green, and red light contain yellow, magenta, and cyan dye-forming couplers, respectively.

54. A multicolor photographic element according to claim 53 in which the blue recording emulsion layer of said triad contains a higher mole percentage of iodide than said green and red emulsion layers of said triad.

55. A multicolor photographic element comprised of a film support and, located thereon, color-forming layer units for separately recording blue, green, and red light containing yellow, magenta, and cyan dye image formers, respectively, and each containing at least one silver halide emulsion layer, said color-forming layer units being chosen so that when said photographic element is exposed at a color temperature of 5500° K. through a spectrally non-selective step wedge and processed said photographic element exhibits, in relation to blue contrast and speed, green and red contrast variations of less than 20 percent and green and red speed variations of less than 0.3 log E, using blue, green, and red densities determined according to the American Standard PH2.1-1952, a triad of said emulsion layers for separately recording blue, green, and red light being positioned to receive exposing relation prior to any remaining emulsion layers, at least one of said green and red recording emulsion layers of said triad, being positioned to receive substantially specularly transmitted exposing radiation prior to at least one other emulsion layer and, during exposure of the photographic element at a color temperature of 5500° K., blue light in addition to light the layer is intended to record, $\Delta$ log E for said emulsion layer being less than 0.6, where $$\Delta \log E = \log E_T - \log E_B$$

log $E_T$ being the log of exposure to red or green light said emulsion layer is intended to record and log $E_B$ being the log of concurrent exposure of said emulsion layer to blue light, and containing silver bromoiodide grains having an average diameter of at least 1.0 micron including substantially optimally chemically and spectrally sensitized tabular silver bromoiodide grains having first and second opposed, substantially parallel major faces, less than 3 mole percent iodide in a central region extending betwen said major faces, at least 6 mole percent iodide in a laterally displaced region extending between said major faces, a thickness of less than 0.3 micron, a diameter of at least 0.6 micron, and an average aspect ratio of at least 12:1 accounting for at least 70 percent of the total projected area of said silver bromoiodide grains.

56. A process of producing a viewable photographic image by processing in an aqueous alkaline solution in the presence of a developing agent an imagewise exposed photographic element according to claim 26.

57. A process of producing a viewable photographic image by processing in an aqueous alkaline solution in the presence of a developing agent an imagewise exposed photographic element according to claim 27, 28, 29, 30, 31, or 32.

58. A process of producing a viewable multicolor image by processing in an aqueous alkaline solution in the presence of a developing agent an imagewise exposed photographic element according to claim 33, 34, 35, 36, 37, 38, 39, 40, 41, 42, 43, 44, 45, 46, 47, 48, 49, 50, 51, 52, 53, 54, or 55.

* * * * *

UNITED STATES PATENT AND TRADEMARK OFFICE

CERTIFICATE OF CORRECTION

PATENT NO. : 4,433,048

DATED : February 21, 1984

INVENTOR(S) : Solberg et al

It is certified that error appears in the above-identified patent and that said Letters Patent are hereby corrected as shown below:

Title page, second column, under OTHER PUBLICATIONS, after line 26 thereof,

--Claes, "Crystal Growth and Reactivity Sites of Twinned-Tabular Grains", Photo. Korr. 101(9), pp 139-144, 1965.

Claes, "Crystal Habit Modification of AgBr by Incorporation of I-Ions", Photo. Korr., 103(10), pp 161-164, 1967.--

Signed and Sealed this

Second Day of September 1986

[SEAL]

Attest:

DONALD J. QUIGG

Attesting Officer

Commissioner of Patents and Trademarks